US010207495B2

(12) United States Patent
Aoyagi et al.

(10) Patent No.: US 10,207,495 B2
(45) Date of Patent: Feb. 19, 2019

(54) IMAGE FORMING APPARATUS, METHOD FOR CALCULATING ACTUAL DISTANCE OF DEVIATION, AND COMPUTER PROGRAM PRODUCT STORING SAME

(71) Applicants: Kohta Aoyagi, Kanagawa (JP); Suguru Yokozawa, Kanagawa (JP); Masaya Kawarada, Kanagawa (JP); Nobuyuki Satoh, Kanagawa (JP)

(72) Inventors: Kohta Aoyagi, Kanagawa (JP); Suguru Yokozawa, Kanagawa (JP); Masaya Kawarada, Kanagawa (JP); Nobuyuki Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/808,813

(22) Filed: Nov. 9, 2017

(65) Prior Publication Data

US 2018/0141329 A1 May 24, 2018

(30) Foreign Application Priority Data

Nov. 22, 2016 (JP) ..... 2016-227252
Nov. 25, 2016 (JP) ..... 2016-229571

(51) Int. Cl.
*B41J 2/045* (2006.01)
*B41J 29/393* (2006.01)
(Continued)

(52) U.S. Cl.
CPC ..... *B41J 2/04505* (2013.01); *B41J 2/04586* (2013.01); *B41J 2/2135* (2013.01);
(Continued)

(58) Field of Classification Search
CPC .. B41J 2/04505; B41J 2/04586; B41J 2/2135; B41J 11/46; B41J 19/145; B41J 29/02; B41J 29/13
See application file for complete search history.

(56) References Cited

U.S. PATENT DOCUMENTS

2009/0316164 A1 12/2009 Takahashi et al.
2011/0148971 A1 6/2011 Suzuki et al.
(Continued)

FOREIGN PATENT DOCUMENTS

EP 2298565 A2 3/2011
JP 2001-322261 11/2001
(Continued)

OTHER PUBLICATIONS

European Search Report; Appl No. EP17201995; dated Apr. 11, 2018.

*Primary Examiner* — Lamson Nguyen
(74) *Attorney, Agent, or Firm* — Duft & Bornsen, PC

(57) ABSTRACT

An image forming apparatus includes a conveyor to convey a recording medium; an image forming device including a recording head to form a test pattern including a first mark and a pair of second marks; an imaging device; and a processor. The processor includes a pattern forming unit to cause the image forming device to form one of the first and second marks and form the other after the conveyor conveys the recording medium by a predetermined conveyance amount, a position detector to detect positions of the first and second marks in the captured image, a ratio calculator to calculate a ratio between a distance between the second marks and deviation of the first mark in the captured image, and a distance calculator to calculate an actual distance of the deviation based on a theoretical distance between the second marks and the ratio.

14 Claims, 37 Drawing Sheets

(51) Int. Cl.

| | |
|---|---|
| ***B41J 2/21*** | (2006.01) |
| ***B41J 11/46*** | (2006.01) |
| ***B41J 19/14*** | (2006.01) |
| ***B41J 29/02*** | (2006.01) |
| ***B41J 29/13*** | (2006.01) |

(52) U.S. Cl.
CPC ..... *B41J 11/46* (2013.01); *B41J 19/145* (2013.01); *B41J 29/02* (2013.01); *B41J 29/13* (2013.01); *B41J 29/393* (2013.01)

(56) References Cited

U.S. PATENT DOCUMENTS

| | | | |
|---|---|---|---|
| 2012/0069411 | A1 | 3/2012 | Satoh et al. |
| 2012/0218568 | A1 | 8/2012 | Yorimoto et al. |
| 2012/0236308 | A1 | 9/2012 | Satoh |
| 2013/0135484 | A1 | 5/2013 | Satoh et al. |
| 2014/0300722 | A1 | 10/2014 | Garcia |
| 2016/0347052 | A1 | 12/2016 | Kawarada et al. |

FOREIGN PATENT DOCUMENTS

| | | |
|---|---|---|
| JP | 2009-137015 | 6/2009 |
| JP | 2011-131399 | 7/2011 |
| JP | 2016-221719 | 12/2016 |

IMAGE FORMING APPARATUS, METHOD FOR CALCULATING ACTUAL DISTANCE OF DEVIATION, AND COMPUTER PROGRAM PRODUCT STORING SAME

CROSS-REFERENCE TO RELATED APPLICATIONS

This patent application is based on and claims priority pursuant to 35 U.S.C. § 119(a) to Japanese Patent Application Nos. 2016-227252 filed on Nov. 22, 2016 and 2016-229571 filed on Nov. 25, 2016, in the Japan Patent Office, the entire disclosure of each of which is hereby incorporated by reference herein.

BACKGROUND

Technical Field

This disclosure relates to an image forming apparatus, a method for calculating an actual distance of deviation, and a computer program product to cause a computer to execute the method.

Description of the Related Art

Many of inkjet image forming apparatuses discharge ink from a recording head mounted on a carriage while moving the carriage back and forth in a main scanning direction and repeatedly convey, with a conveyance roller, a recording medium (i.e., a conveyed object) in a sub-scanning direction, thereby forming an image. At that time, the landing position of ink may deviate from an intended position.

For example, the deviation can be detected using a two-dimensional sensor. In such a method, the two-dimensional sensor detects a position of a mark on a chart conveyed by a conveyance roller when the conveyance roller has made one rotation. Then, the difference between the detected position and a theoretical position of the mark is calculated. Based on the calculated difference, the amount by which the amount of feeding of the mark is to be corrected is calculated.

SUMMARY

According to an embodiment of this disclosure, an image forming apparatus includes a conveyor to convey a recording medium and an image forming device including at least one recording head to form, on the recording medium, a test pattern including at least one mark set including a first mark and a pair of second marks. The at least one recording head includes a plurality of nozzles to discharge ink. The image forming apparatus further includes an imaging device to obtain a captured image of the test pattern and at least one processor. The processor includes a pattern forming unit configured to cause the image forming device to form one of the first mark and the pair of second marks on the recording medium and cause the image forming device to form the other of the first mark and the pair of second marks after the conveyor conveys the recording medium by a predetermined conveyance amount. The processor further includes a position detector configured to detect a position of the first mark and a position of the pair of second marks in the captured image, a ratio calculator configured to calculate a ratio between a distance between the pair of second marks in the captured image and an amount of deviation of the first mark in the captured image. The processor further includes a distance calculator configured to calculate an actual distance of the deviation of the first mark based on a theoretical distance between the pair of second marks and the ratio.

Another embodiment provides a method for calculating an actual distance of a deviation, performed in an image forming apparatus. The method includes forming one of a first mark and a pair of second marks on a recording medium, conveying the recording medium by a predetermined conveyance amount after forming the one of the first mark and the pair of second marks, forming the other of the first mark and the pair of second marks after conveying the recording medium by the predetermined conveyance amount, obtaining a captured image of a test pattern including the first mark and the pair of second marks, detecting a position of the first mark and a position of the pair of second marks in the captured image, and calculating an actual distance of a deviation of the first mark, based on a distance between the pair of second marks in the captured image, a position of the first mark in the captured image, and a theoretical distance between the pair of second marks.

Another embodiment provides a computer-readable non-transitory recording medium storing a program for causing a computer to execute the following method. The method includes forming one of a first mark and a pair of second marks on a recording medium, conveying the recording medium by a predetermined conveyance amount after forming the one of the first mark and the pair of second marks, forming the other of the first mark and the pair of second marks after conveying the recording medium by the predetermined conveyance amount, obtaining a captured image of a test pattern including the first mark and the pair of second marks, detecting a position of the first mark and a position of the pair of second marks in the captured image, calculating a ratio between a distance between the pair of second marks in the captured image and a deviation of the first mark in the captured image, and calculating an actual distance of the deviation of the first mark based on a theoretical distance between the pair of second marks and the ratio.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
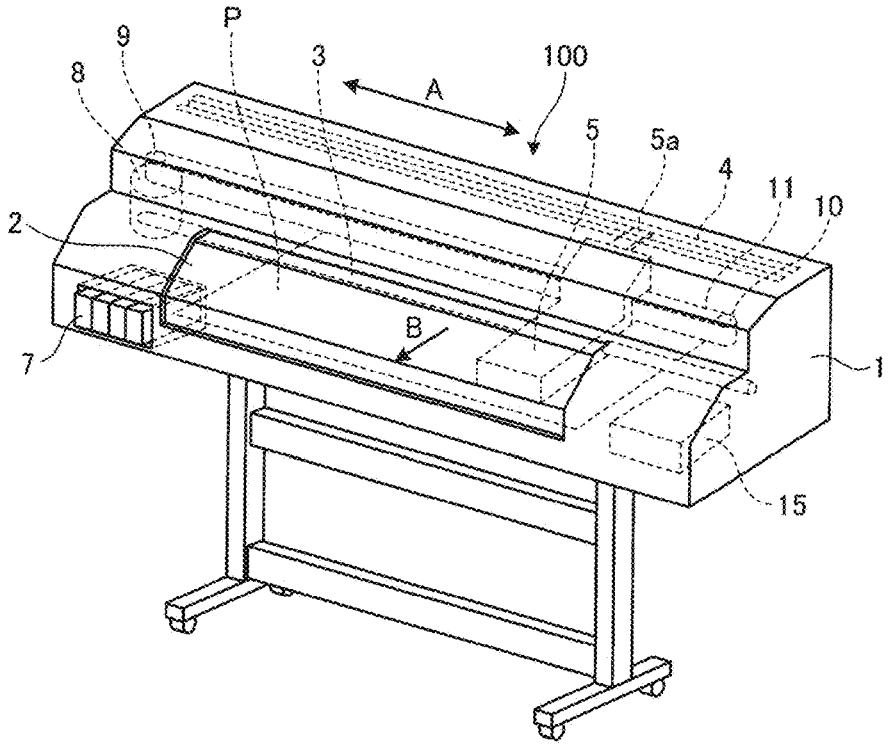
FIG. 1 is a perspective view of an interior of an image forming apparatus according to Embodiment 1.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming apparatus, a distance calculation method, and a program to execute the method according to exemplary embodiments of this disclosure are described. As used herein, the singular forms "a", "an", and "the" are intended to include the plural forms as well, unless the context clearly indicates otherwise. The suffixes y, m, c, and k attached to each reference numeral indicate only that components indicated thereby are used for forming yellow, magenta, cyan, and black images, respectively, and hereinafter may be omitted when color discrimination is not necessary.

Note that an inkjet printer configured to discharge ink on a recording medium (an example of the conveyed object) to form an image will be described as an example image forming apparatus in the embodiments described below. The image forming apparatus has a function of capturing an image of a test pattern on a recording medium, and a function of calculating, using the captured image, a distance corresponding to the amount of deviation of the landing position of ink when the deviation of the landing position occurs. The image forming apparatus further has a function of adjusting a parameter relating to the amount of conveyance of the recording medium. However, examples to which aspect of this disclosure are applicable are not limited to the embodiments described below. Aspects of present disclosure can be widely applied to various types of image forming apparatuses configured to capture an image of a test pattern in order to calculate the distance corresponding to the amount of deviation using the captured image.

Embodiment 1

[Mechanical Configuration of Image Forming Apparatus]

Figure 2:
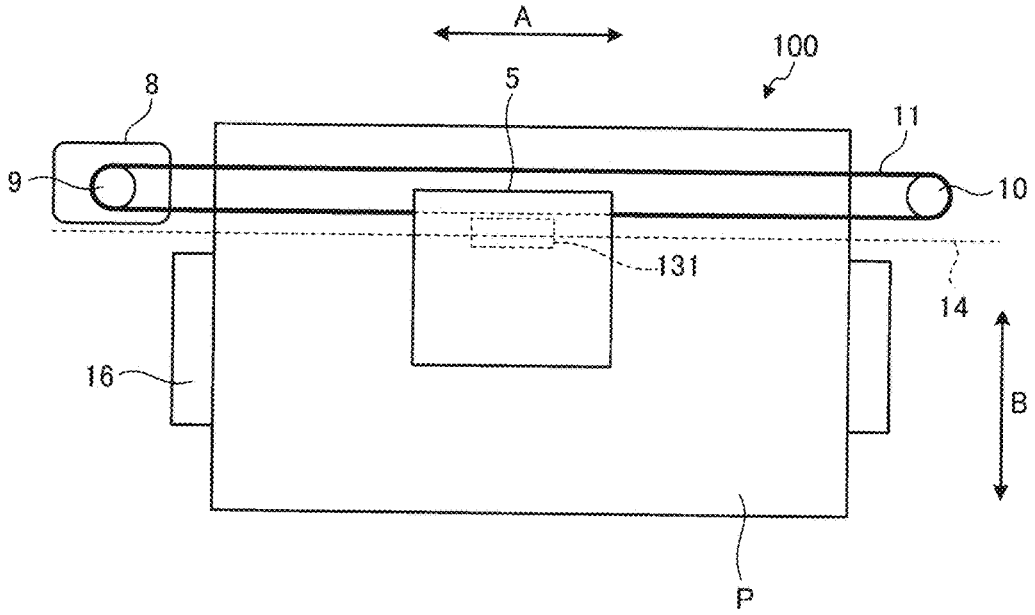
FIG. 2 is a top view of a mechanical configuration of the image forming apparatus according to Embodiment 1.
Figure 3:
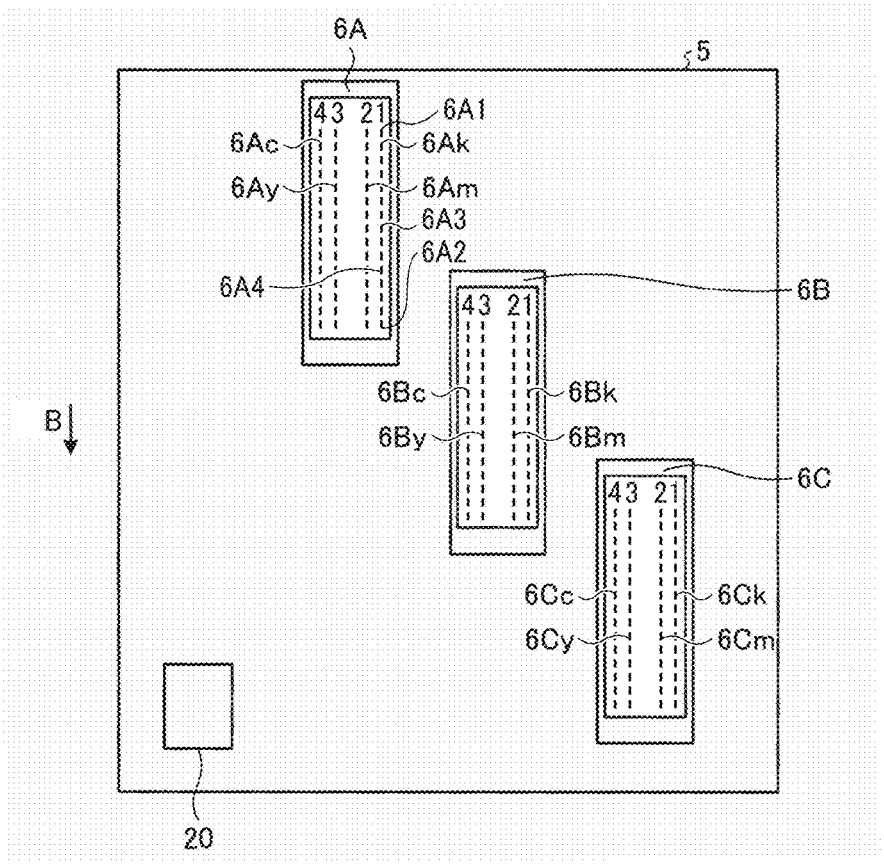
FIG. 3 is a view of a carriage according to Embodiment 1.

An exemplary mechanical configuration of an image forming apparatus 100 will be described first referring to the appended drawings. FIG. 1 is a perspective view of the inside of the image forming apparatus according to Embodiment 1. FIG. 2 is a top view illustrating the mechanical structure inside the image forming apparatus according to Embodiment 1. FIG. 3 is a view of a carriage of the image forming apparatus illustrated in FIG. 1.

As illustrated in FIG. 1, the image forming apparatus 100 according to the present embodiment includes a carriage 5 to reciprocate in a main scanning direction A in the drawings (hereinafter also "main scanning direction A", serving as the direction of travel of the carriage). The carriage 5 is supported by a main guide rod 3 extending in the main scanning direction. In addition, the carriage 5 includes a coupler 5*a*. The coupler 5*a* engages with a sub guide 4 disposed parallel to the main guide rod 3 to stabilize the posture of the carriage 5.

The carriage 5 is coupled to a timing belt 11 extending between a driving pulley 9 and a driven pulley 10. The driving pulley 9 rotates by the driving of the main scanning motor 8. The driven pulley 10 includes a mechanism to adjust the distance with the driving pulley 9 in order to give a predetermined degree of tension to the timing belt 11. The driving of the main scanning motor 8 causes the timing belt 11 to convey the carriage 5. This causes the carriage 5 to reciprocate in the main scanning direction. For example, a main-scanning encoder sensor 131 is disposed on the carriage 5 as illustrated in FIG. 2. The main-scanning encoder sensor 131 detects a mark on an encoder sheet 14 and outputs an encoder value. The travel amount and travel speed of the carriage 5 are controlled based on the encoder value.

The carriage 5 includes recording heads 6A, 6B, and 6C as illustrated in FIG. 3. The recording head 6A includes a nozzle line 6Ay in which many nozzles to discharge yellow (Y) ink are arranged, a nozzle line 6Ac in which many nozzles to discharge cyan (C) ink are arranged, a nozzle line 6Am in which many nozzles to discharge magenta (M) ink are arranged, and a nozzle line 6Ak in which many nozzles to discharge black (K) ink are arranged. Similarly, the recording head 6B includes nozzle lines 6By, 6Bc, 6Bm, and 6Bk. The recording head 6C includes nozzle lines 6Cy, 6Cc, 6Cm, and 6Ck. Hereinafter, the recording heads 6A, 6B, and 6C will collectively be referred to as recording heads 6. The recording head 6 is supported by the carriage 5 so that a discharge face (nozzle face) of the recording head 6 faces down (toward a recording medium P).

A cartridge 7, from which ink is supplied to the recording head 6, is not mounted on the carriage 5. A cartridge 7 is disposed at a predetermined position in the image forming apparatus 100. The cartridge 7 and the recording head 6 are coupled with a pipe so that ink is supplied through the pipe from the cartridge 7 to the recording head 6.

A platen 16 is disposed at a position facing the discharge face of the recording head 6 as illustrated in FIG. 2. The platen 16 is used to support the recording medium P when ink is discharged from the recording head 6 onto the recording medium P. The platen 16 includes many through holes penetrating in the thickness direction and rib-shaped projections surrounding each of the through holes. The platen 16 includes a suction fan on a face opposite to the face supporting the recording medium P. Activating the suction fan prevents the recording medium P from falling from the platen 16. The recording medium P is held between a conveyance roller pair and intermittently conveyed on the platen 16 in a sub-scanning direction indicated by arrow B (hereinafter also "sub-scanning direction B" serving as the direction of conveyance of the recording medium) in the drawings. The conveyance roller is driven by a sub-scanning motor 12 to be described below (see FIG. 13).

The recording head 6 includes many nozzles arranged in the sub-scanning direction as described above. The image forming apparatus 100 according to the present embodiment intermittently conveys the recording medium P in the sub-scanning direction. Meanwhile, the image forming apparatus 100 causes the carriage 5 to reciprocate in the main scanning direction, selectively drives the nozzles of the recording head 6 according to the image data, and discharges the ink from the recording head 6 to the recording medium P on the platen 16 while the conveyance of the recording medium P stops in order to record an image on the recording medium P.

The image forming apparatus 100 according to the present embodiment further includes a maintenance mechanism 15 to maintain the reliability of the recording head 6. For example, the maintenance mechanism 15 cleans the discharge face of the recording head 6, puts a cap on the recording head 6, and discharges unnecessary ink from the recording head 6.

The carriage 5 further includes an imaging unit 20 (an imaging device) to capture an image of a test pattern TP (see FIG. 15) on the recording medium P as illustrated in FIG. 3. The test pattern TP will be described later. The imaging unit 20 will be described in detail later.

Each of the components described above and included in the image forming apparatus 100 according to the present embodiment is disposed in an enclosure 1. The enclosure 1 includes a cover 2 to open and close. When maintenance of the image forming apparatus 100 is performed or when paper jam occurs, the cover 2 is opened, and work relating to the components in the enclosure 1 can be performed.

In an embodiment, the imaging unit 20 illustrated in FIG. 3 includes a reference chart to be simultaneously captured together with the test pattern TP. In another embodiment, the imaging unit 20 does not include such a reference chart. The reference chart is used to calculate the colorimetric value of the test pattern TP, for example, according to the RGB value of each reference patch (see FIG. 9).

[Example 1 of Imaging Unit]

Figure 4:
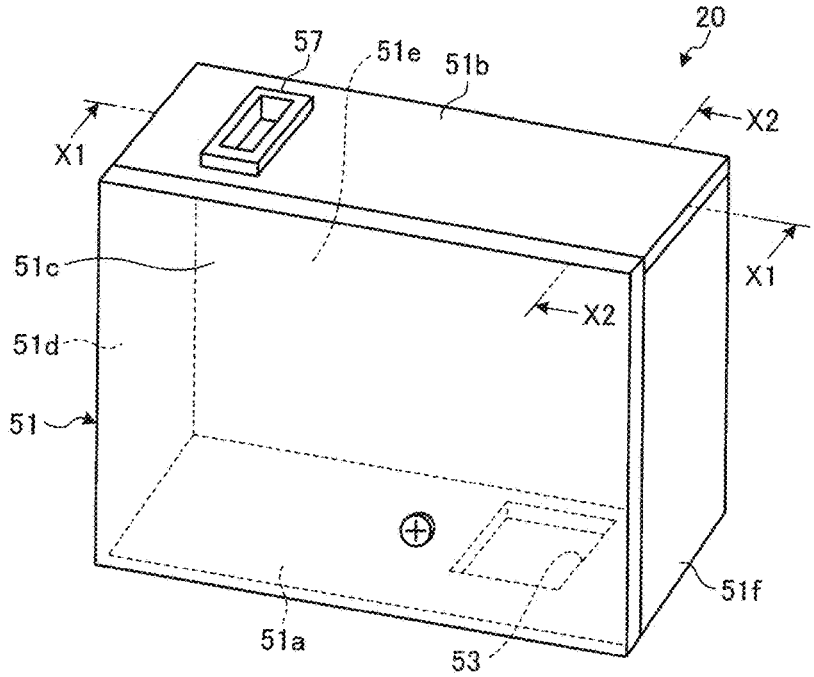
FIG. 4 is a perspective view of an appearance of an imaging unit according to Embodiment 1.
Figure 5:
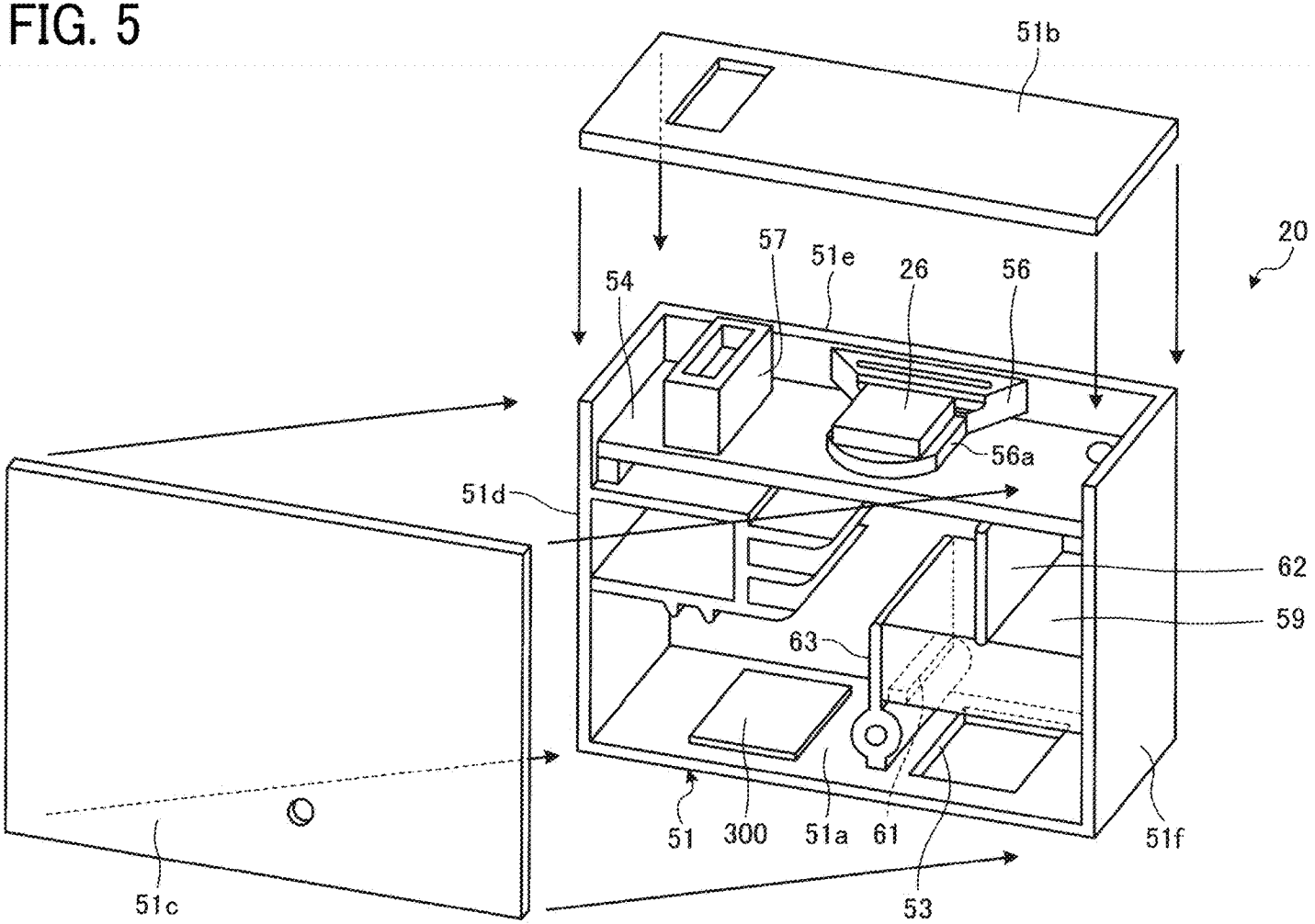
FIG. 5 is an exploded perspective view of the imaging unit.
Figure 6:
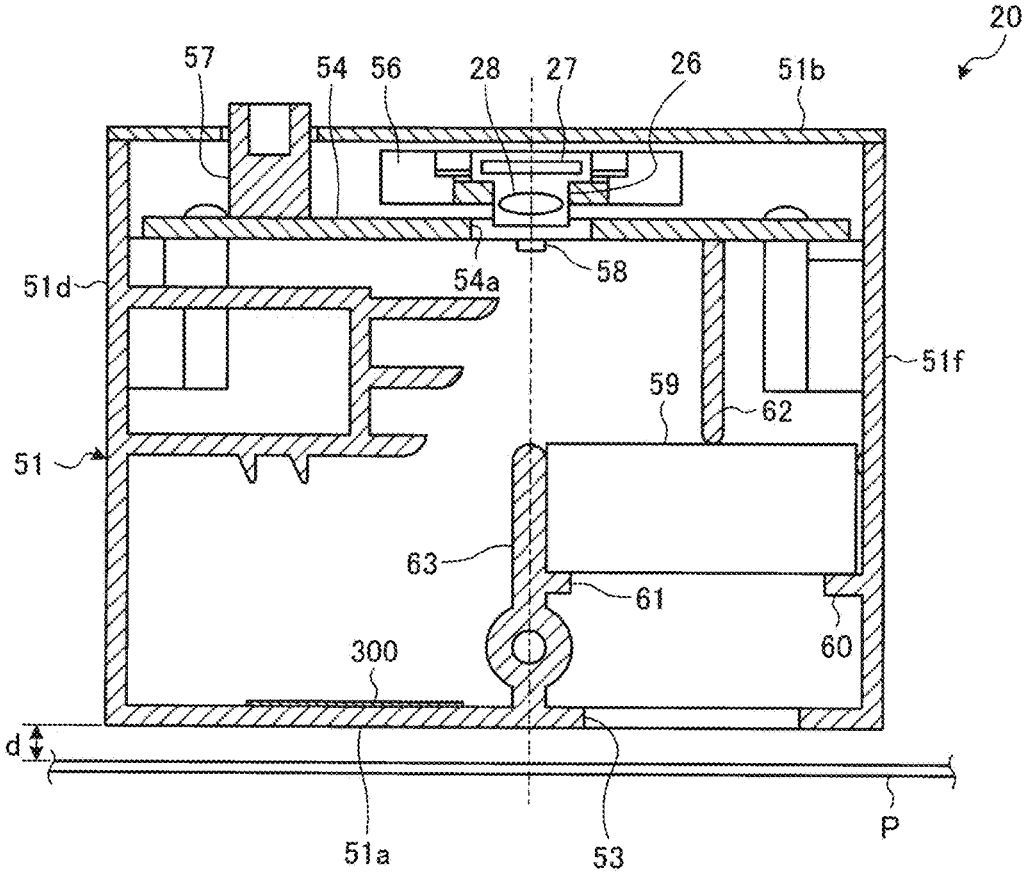
FIG. 6 is a vertical cross-sectional view of the imaging unit, viewed in a direction indicated by arrow X1 in FIG. 4.
Figure 7:
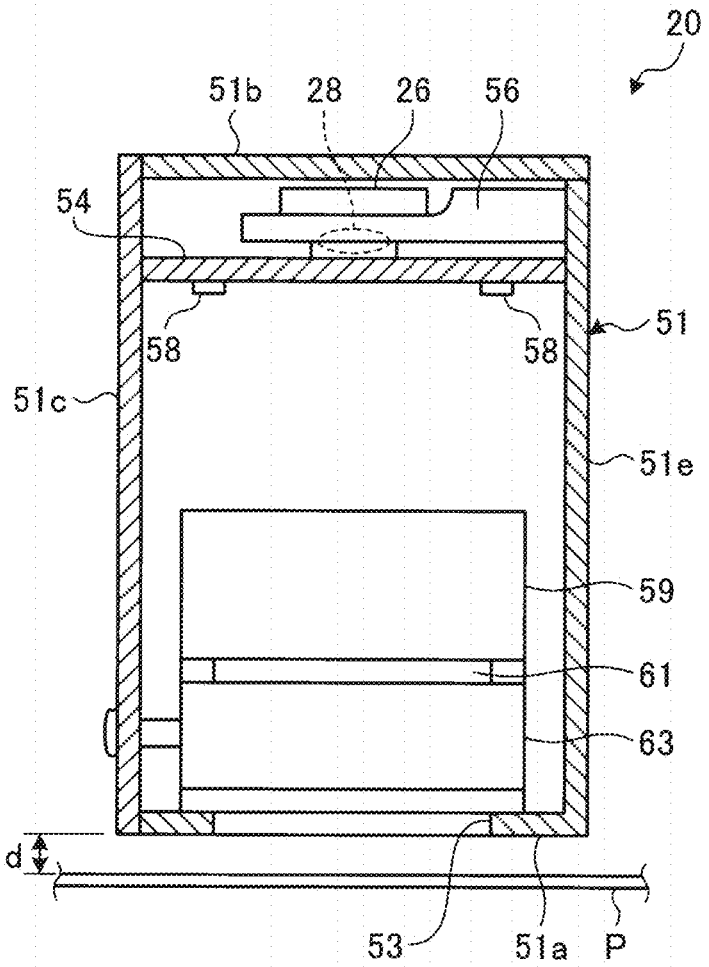
FIG. 7 is a vertical cross-sectional view of the imaging unit, viewed in a direction indicated by arrow X2 in FIG. 4.
Figure 8:
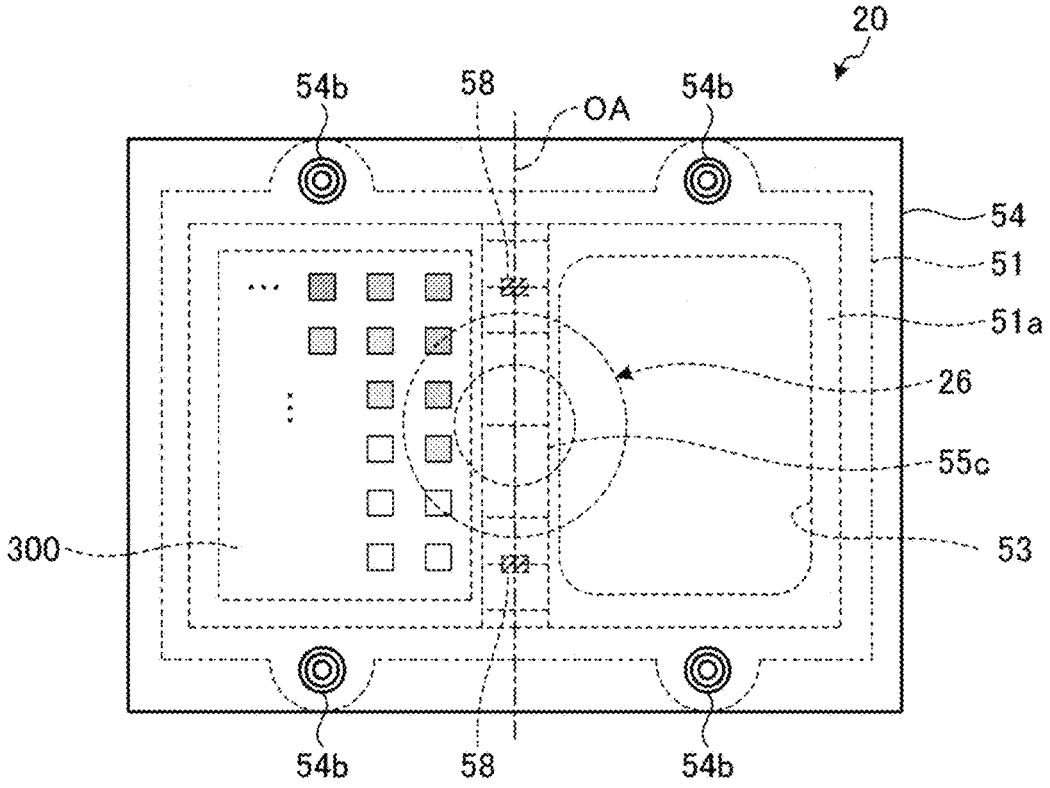
FIG. 8 is a plan view of the imaging unit.

An example in which the imaging unit 20 includes a reference chart will be described first. FIG. 4 is a perspective view of the appearance of the imaging unit. FIG. 5 is an exploded perspective view of the imaging unit. FIG. 6 is a vertical cross-sectional view of the imaging unit, as viewed in the direction indicated by arrow X1 in FIG. 4. FIG. 7 is a vertical cross-sectional view of the imaging unit, viewed in the direction indicated by arrow X2 in FIG. 4. FIG. 8 is a plan view of the imaging unit.

The imaging unit 20 includes a housing 51, for example, formed into a rectangular box. The housing 51 includes, for example, a bottom board 51*a*, a top board 51*b*, and sidewalls 51*c*, 51*d*, 51*e*, and 51*f*. The bottom board 51*a* and top board 51*b* face each other and at a predetermined interval from each other. The sidewalls 51*c*, 51*d*, 51*e*, and 51*f* couple the bottom board 51*a* to the top board 51*b*. The bottom board 51*a* and the sidewalls 51*d*, 51*e*, and 51*f* of the housing 51 are formed as a single piece by, for example, molding. The top board 51*b* and the sidewall 51*c* are detachably attached thereto. FIG. 5 illustrates the state in which the top board 51*b* and the sidewall 51*c* are detached.

For example, the imaging unit 20 is disposed on a conveyance passage in a state in which a portion of the housing 51 is supported by a predetermined support. The recording medium P on which the test pattern TP is formed is conveyed on the conveyance passage. Meanwhile, the imaging unit 20 is supported by the predetermined support so that the bottom board 51*a* of the housing 51 faces the conveyed recording medium P approximately in parallel with a gap d secured therebetween, as illustrated in FIGS. 6 and 7.

The bottom board 51*a* of the housing 51 facing the recording medium P on which the test pattern TP is formed includes an opening 53 that enables the imaging unit 20 to capture an image of the test pattern TP outside the housing 51 from the inside of the housing 51.

In addition, the housing 51 includes a reference chart 300 on an inner face of the bottom board 51*a*. The reference chart 300 is disposed next to the opening 53 via the supporting member 63. A sensor unit 26, which is described later, captures an image of the reference chart 300 together with an image of the test pattern TP for colorimetry of the test pattern TP and obtains the RGB (red green blue) values. The reference chart 300 will be described in detail later.

Meanwhile, a circuit board 54 is disposed near the top board 51*b* in the housing 51. As illustrated in FIG. 8, the housing 51 is secured to the circuit board 54 by a securing member 54*b*, and the housing 51 is shaped like a rectangular box that is open on the side of the circuit board 54. Note that the shape of the housing 51 is not limited to a rectangular box but can be a cylindrical or elliptical box including the bottom board 51*a* having the opening 53.

The housing 51 further includes the sensor unit 26 disposed between the top board 51*b* and the circuit board 54 and configured to capture an image. The sensor unit 26 includes a two-dimensional sensor 27 and an imaging lens 28 as illustrated in FIG. 6. The two-dimensional sensor 27 is, for example, a Charge Coupled Device (CCD) sensor or a Complementary Metal Oxide Semiconductor (CMOS) sensor. The imaging lens 28 forms an optical image in a capture range of the sensor unit 26 on a light-receiving face (imaging region) of the two-dimensional sensor 27. The two-dimensional sensor 27 is a light-receiving element array including two-dimensionally arranged arrays of light-receiving elements to receive the light reflected from the object to be captured (i.e., a captured object).

The sensor unit 26 is held, for example, by a sensor holder 56 integrally formed with the sidewall 51*e* of the housing 51. The sensor holder 56 includes a ring 56*a* at a position facing the through hole 54*a* on the circuit board 54. The ring 56*a* includes a through hole having a size corresponding to the external shape of a protruding portion of the sensor unit 26 including the imaging lens 28. In the sensor unit 26, as the protruding portion including the imaging lens 28 is inserted into the ring 56*a* of the sensor holder 56, the sensor holder 56 holds the imaging lens 28 so that the imaging lens 28 faces the bottom board 51*a* of the housing 51 through the through hole 54*a* of the circuit board 54.

At that time, as the sensor unit 26 is positioned and held by the sensor holder 56, an optical axis illustrated as an alternate long and short dash line in FIG. 6 is approximately perpendicular to the bottom board 51*a* of the housing 51, and the opening 53 and the reference chart 300 are included in the image capture range. With this structure, with a portion of the imaging region of the two-dimensional sensor 27, the sensor unit 26 captures an image of the test pattern TP outside the housing 51, through the opening 53. In addition, with another portion of the imaging region of the two-dimensional sensor 27, the sensor unit 26 can capture an image of the reference chart 300 in the housing 51.

Note that the sensor unit 26 is electrically coupled to the circuit board 54 mounting various electronic components, for example, via a flexible cable. The circuit board 54 further includes an external coupling connector 57 including a coupling cable to couple the imaging unit 20 to a main control board of the image forming apparatus 100.

The imaging unit 20 includes a pair of light sources 58 disposed on the circuit board 54, on a central line OA passing through the center of the sensor unit 26 in the sub-scanning direction. The light sources 58 are equally away from the center of the sensor unit 26 in the sub-scanning direction. The light sources 58 approximately evenly illuminate the range captured by the sensor unit 26. The light source 58 is, for example, a light emitting diode (LED) that effectively saves space and power.

In the present embodiment, the pair of LEDs is used as the light sources 58, and the LEDs are equally arranged with respect to the center of the imaging lens 28 in a direction perpendicular to a direction in which the opening 53 and the reference chart 300 are arranged as illustrated in FIGS. 7 and 8.

The two LEDs used as the light sources 58 are mounted, for example, on a face of the circuit board 54 facing the bottom board 51*a*. However, the light source 58 can be disposed at any position at which the diffusion light can approximately evenly illuminate the range captured by the sensor unit 26. Thus, the light source 58 is not necessarily mounted on the circuit board 54 directly. In addition, placing the two LEDs symmetrically with respect to the two-dimensional sensor 27 enables the imaging unit 20 to capture an image capture face under an illumination condition same as an illumination condition under which the reference chart 300 is captured. In addition, the type of the light source 58 is not limited to the LED although the LED is used as the light source 58 in the present embodiment. For example, organic electro luminescence (EL) can be used as the light source 58. Using the organic EL as the light source 58 can provide illumination light having spectral distribution similar to the spectral distribution of sunlight. This can improve the colorimetric accuracy.

As illustrated in FIG. 8, the sensor unit 26 further includes a light absorber 55*c* immediately below the light source 58 and the two-dimensional sensor 27. The light absorber 55*c* absorbs the light from the light source 58 or reflects the light in a direction in which the two-dimensional sensor 27 is not disposed. The light absorber 55*c* has an acute shape to reflect the incident light from the light source 58 to the inner face of the light absorber 55*c* and not to reflect the light in a direction in which the incident light enters.

Inside the housing 51, a light path length changer 59 is disposed on a light path between the sensor unit 26 and the test pattern TP outside the housing 51 to be captured by the sensor unit 26 through the opening 53. The light path length changer 59 is an optical element having a refractive index n that has sufficient transmittance enabling the light of the light source 58 to pass through. The light path length changer 59 is to bring the imaging face where the test pattern TP outside the housing 51 is optically imaged close to the imaging face where the reference chart 300 inside the housing 51 is optically imaged. In other words, in the imaging unit 20, placing the light path length changer 59 on a light path between the sensor unit 26 and the captured object outside the housing 51 changes the light path length.

With this structure of the imaging unit 20, both of the imaging face where the test pattern TP outside the housing 51 is optically imaged and the imaging face where the reference chart 300 inside the housing 51 is optically imaged are adjusted for the light receiving surface of the two-dimensional sensor 27 of the sensor unit 26. Thus, the sensor unit 26 can capture an image in which the test pattern TP outside the housing 51 and the reference chart 300 inside the housing 51 are in focus.

For example, a pair of ribs 60 and 61 supports both edges of the face of the light path length changer 59 facing the bottom board 51*a* as illustrated in FIG. 6. In addition, placing a pressing member 62 between the face of the light path length changer 59 facing the top board 51*b* and the circuit board 54 prevents the light path length changer 59 from moving in the housing 51. The light path length changer 59 is disposed at a position where the light path length changer 59 seals the opening 53 on the bottom board 51*a* of the housing 51. Thus, the light path length changer 59 also has a function of preventing impurities such as an ink mist or dust entering the housing 51 from the outside of the housing 51 through the opening 53 from adhering, for example, to the sensor unit 26, the light sources 58, and the reference chart 300.

Note that the mechanical configuration of the imaging unit 20 described above is merely an example, and the mechanical configuration is not limited to the example. The imaging unit 20 can has any structure as long as the sensor unit 26 in the housing 51 captures an image of the test pattern TP outside the housing 51 through the opening 53 while the light sources 58 in the housing 51 are on (emit light). The imaging unit 20 can be variously modified from the above-described structure.

For example, the imaging unit 20 described above includes the reference chart 300 on the inner face of the bottom board 51*a* of the housing 51. Alternatively, the imaging unit haves a structure in which another opening different from the opening 53 is disposed at the position on the bottom board 51*a* of the housing 51 where the reference chart 300 is disposed so that the reference chart 300 is attached to the position where the opening is disposed from the outside the housing 51. In this example, the sensor unit 26 captures an image of the test pattern TP on the recording medium P through the opening 53 and simultaneously captures an image of the reference chart 300 attached to the bottom board 51*a* of the housing 51 from the outside through the opening different from the opening 53. This example has an advantage to make it easy to exchange the reference chart 300 at the occurrence of a problem such as a smudging of the reference chart 300.

Figure 9:
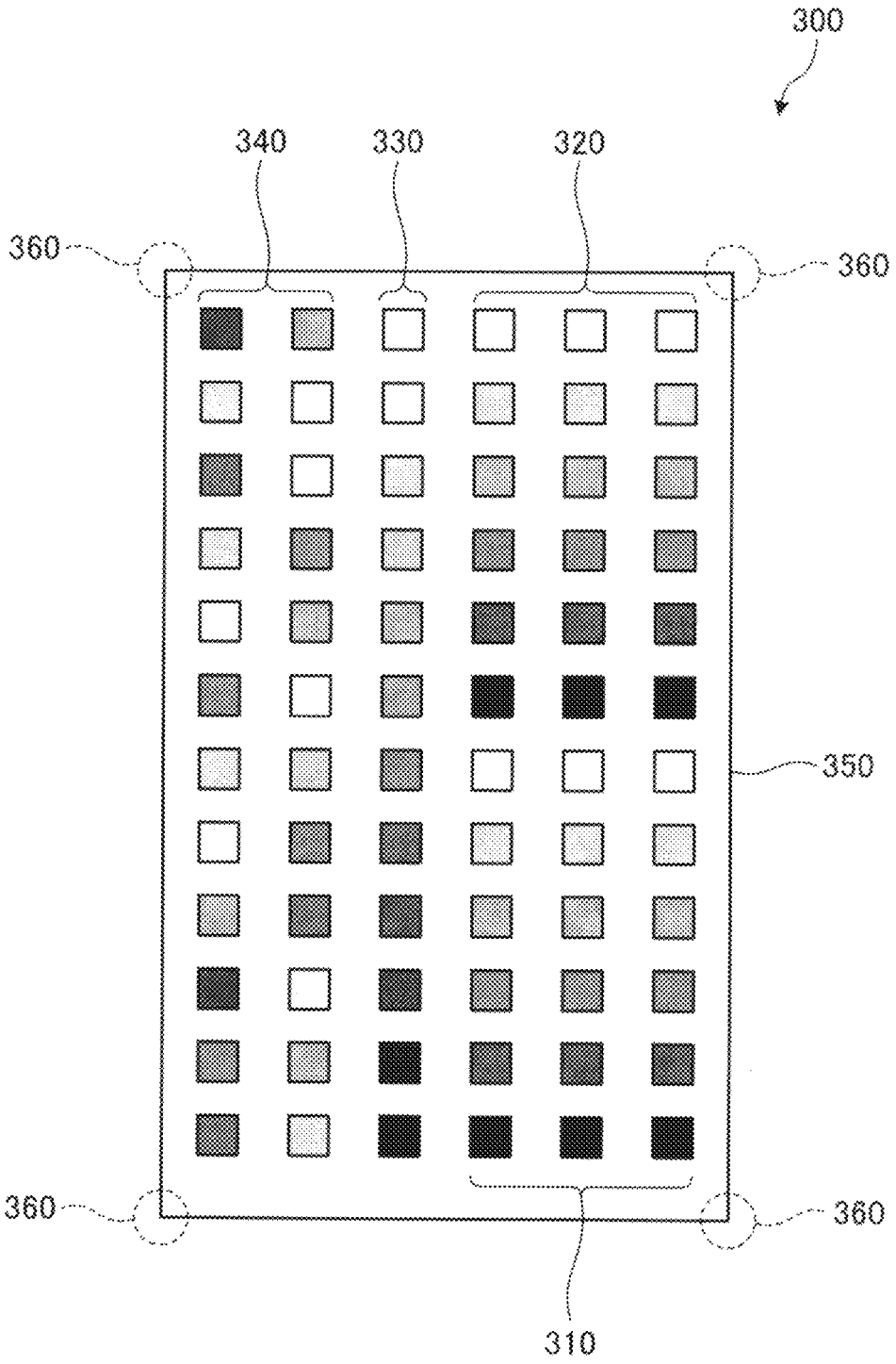
FIG. 9 is a diagram of an example of a reference chart according to Embodiment 1.

Next, an example of the reference chart 300 disposed in the housing 51 of the imaging unit 20 will be described referring to FIG. 9. FIG. 9 illustrates an example of the reference chart.

The reference chart 300 illustrated in FIG. 9 includes a plurality of colorimetric patch lines 310 to 340 in which colorimetric patches for colorimetry are lined, a distance measurement line 350, and chart position determination marks 360.

The colorimetric patch line 310 includes colorimetric patches for primary colors, yellow (Y), magenta (M), cyan (C), and black (K), arranged in gradation order. The colorimetric patch line 320 includes colorimetric patches for secondary colors, red (R), green (G), and blue (B), arranged in gradation order. The colorimetric patch line 330 (an achromatic gradation pattern) includes colorimetric patches for gray scale arranged in gradation order. The colorimetric patch line 340 includes colorimetric patches for tertiary colors arranged in gradation order.

The distance measurement line 350 is a rectangular frame surrounding the plurality of colorimetric patch lines 310 to 340. The chart position determination marks 360 are disposed on the four corners of the distance measurement line 350 and function as markers to determine the position of each of the colorimetric patches. In the image of the reference chart 300 captured with the sensor unit 26, the distance measurement line 350 and the chart position determination marks 360 on the four corners thereof are identified to determine the position of the reference chart 300 and the position of each of the colorimetric patches.

Each of the colorimetric patches included in the colorimetric patch lines 310 to 340 for colorimetry is used as a reference to determine the color tone reflecting the condition under which the sensor unit 26 captures the image. Note that the structures of the colorimetric patch lines 310 to 340 for colorimetry in the reference chart 300 are not limited to the example illustrated in FIG. 9, and an arbitrary colorimetric patch line can be used. For example, a colorimetric patch that can determine colors in a color range as wide as possible can be used. Alternatively, the colorimetric patch line 310 for the primary colors YMCK or the colorimetric patch line 330 for gray scale can include a patch having a colorimetric value of the coloring material used in the image forming apparatus 100. Alternatively, the colorimetric patch line 320 for the secondary colors RGB can include a patch having a colorimetric value to be reproduced with the coloring material used in the image forming apparatus 100. Furthermore, a reference color patch having a colorimetric value specified in Japan Color can be used.

Note that, although the reference chart 300 according to the present embodiment uses the colorimetric patch lines 310 to 340 including patches (color patches) of a typical shape, the reference chart 300 does not necessarily include such colorimetric patch lines 310 to 340. The reference chart 300 can have any configuration in which a plurality of colors for colorimetry is arranged so that the positions thereof can be identified.

As described above, the reference chart 300 is disposed on the inner face of the bottom board 51*a* of the housing 51 and on a side of the opening 53. Accordingly, the sensor unit 26 can simultaneously capture an image of the reference chart 300 and an image of the test pattern TP outside the housing 51. Note that the simultaneous image capture in this example means that acquiring image data of a frame including the test pattern TP outside the housing 51 and the reference chart 300. In other words, even if the data of each pixel is obtained at a different time, as long as image data of a frame including the test pattern TP outside the housing 51 and the reference chart 300 is acquired, the test pattern TP outside the housing 51 and the reference chart 300 are captured at the same time as one image.

[Example 2 of Imaging Unit]

Figure 10:
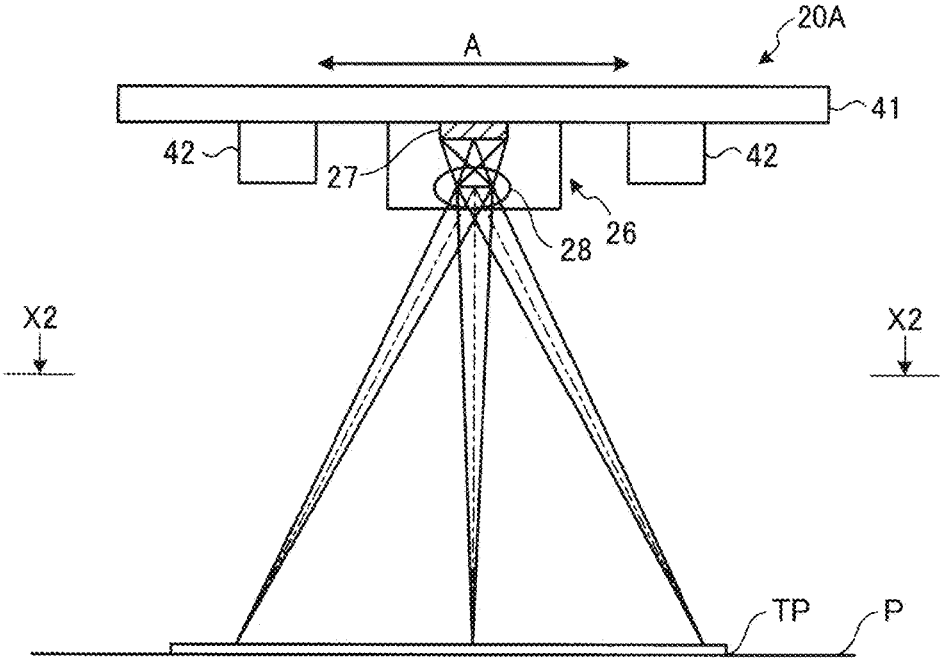
FIG. 10 is a vertical cross-sectional view of another structure of the imaging unit according to Embodiment 1.
Figure 11:
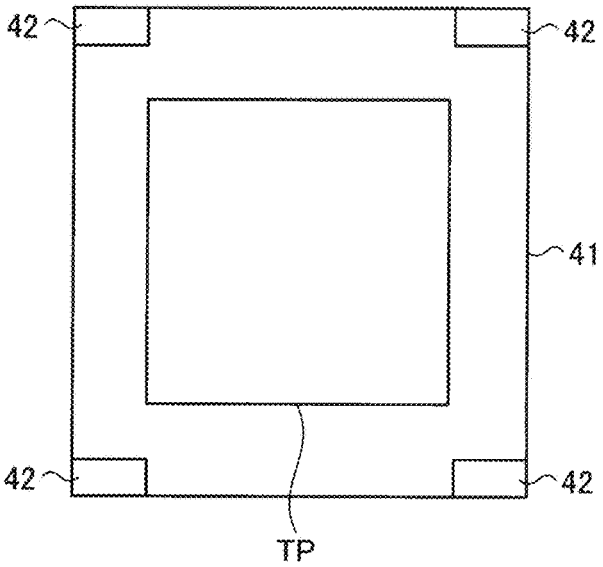
FIG. 11 is a plan view of the imaging unit of FIG. 10, viewed in the direction indicated by arrow X2.

An example of an imaging unit without a reference chart will be described below, referring to FIGS. 10 and 11. FIG. 10 is a vertical cross-sectional view of the imaging unit. FIG. 11 is a plan view of the imaging unit of FIG. 10, as viewed in the direction indicated by arrow X2.

As illustrated in FIG. 10, an imaging unit 20A includes a substrate 41 secured to a carriage 5, light sources 42, and a sensor unit 26. The light source 42 and the sensor unit 26 are mounted on the substrate 41.

For example, an LED is used as the light source 42. The test pattern TP on the recording medium P that is a captured object is irradiated with illumination light, and the light reflected (diffusely or specularly) therefrom enters the sensor unit 26. As illustrated in FIG. 11, four light sources 42 are disposed to surround the test pattern TP on the recording medium P so as to evenly irradiate the test pattern TP with the illumination light.

The sensor unit 26 includes a two-dimensional sensor 27 such as a CCD sensor or a CMOS sensor and an imaging lens 28. The sensor unit 26 causes the reflected light of the illumination light, emitted from the light source 42 to the test pattern TP, to enter the two-dimensional sensor 27 through the imaging lens 28. The two-dimensional sensor 27 converts the entering light into an analog signal by photoelectric conversion, and outputs the signal as the captured image of the test pattern TP.

[Detailed Description of Conveyor]

Figure 12:
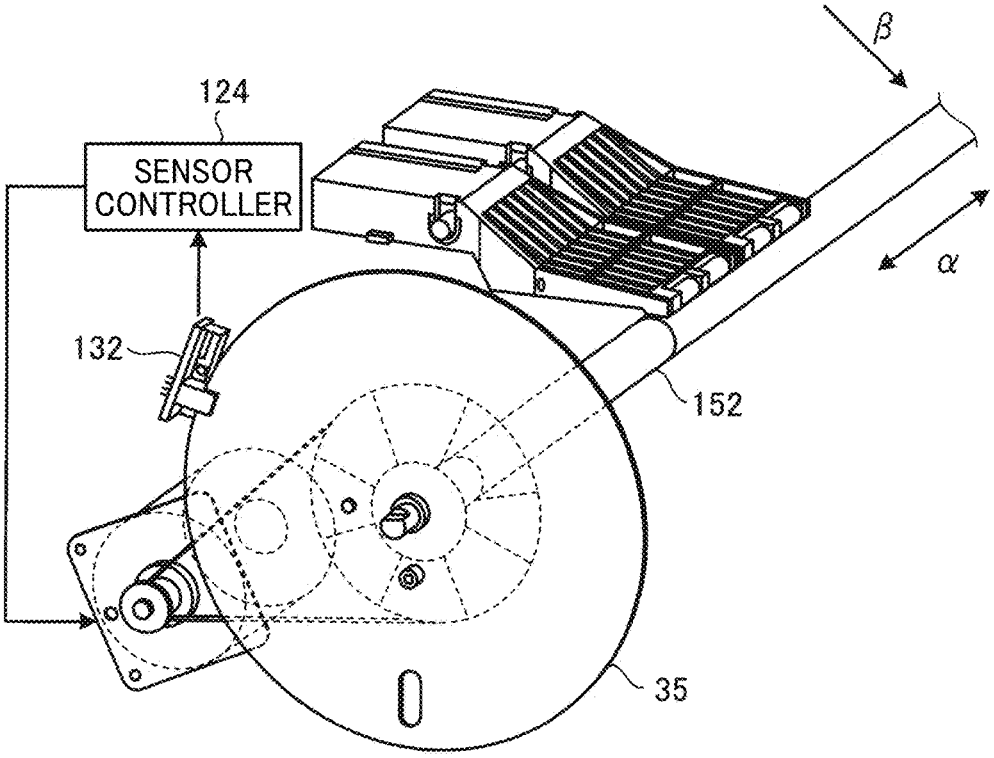
FIG. 12 is a view of an arrangement around a conveyance roller according to Embodiment 1.

A conveyor to convey the recording medium P that is a conveyed object will be described. FIG. 12 is a schematic view of an arrangement around a conveyance roller. As illustrated in FIG. 12, the recording medium P is intermittently conveyed in the sub-scanning direction (indicated by arrow B in the drawings) perpendicular to the main scanning direction A in which the carriage 5 moves. In the conveyance, a sub-scanning encoder sensor 132 on a side plate reads an encoder 35 coaxially disposed with a conveyance roller 152.

The amount of conveyance of the recording medium P is controlled, based on the information read as described above, by a sensor controller 124 (see FIG. 13) electrically coupled to the sub-scanning encoder sensor 132. In this example, the encoder 35 is a rotary encoder including a disc-shaped optical grid. Thus, the angle, rotation amount, and rotation rate of the encoder can be detected.

[Hardware Configuration of Image Forming Apparatus]

Figure 13:
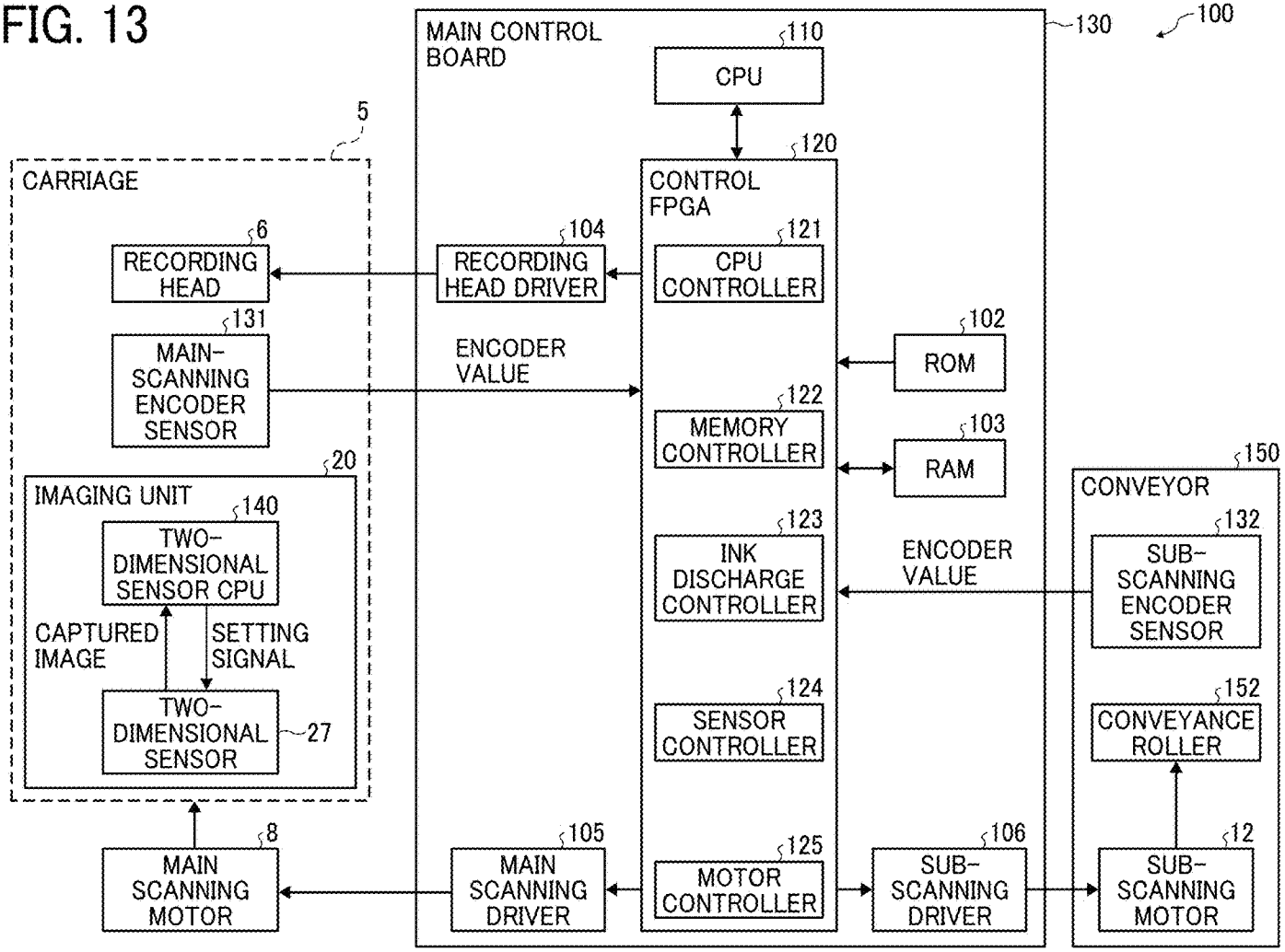
FIG. 13 is a block diagram of a hardware configuration of the image forming apparatus according to Embodiment 1.

A hardware configuration of the image forming apparatus 100 according to the present embodiment will be described referring to FIG. 13. FIG. 13 is a block diagram of the hardware configuration of the image forming apparatus according to Embodiment 1.

As illustrated in FIG. 13, the image forming apparatus 100 according to the present embodiment includes a central processing unit (CPU) 110, a read-only memory (ROM) 102, a random access memory (RAM) 103, a recording head driver 104, a main scanning driver 105, a sub-scanning driver 106, a control Field-Programmable Gate Array (FPGA) 120, a recording head 6, a main-scanning encoder sensor 131, the imaging unit 20, a main scanning motor 8, and the conveyor 150.

The CPU 110, the ROM 102, the RAM 103, the recording head driver 104, the main scanning driver 105, the sub-scanning driver 106, and the control FPGA 120 are mounted on a main control board 130. Meanwhile, the recording head 6, the main-scanning encoder sensor 131, and the imaging unit 20 are mounted on the carriage 5 as described above. In addition, the sub-scanning encoder sensor 132, the conveyance roller 152, and the sub-scanning motor 12 are mounted on the conveyor 150.

The CPU 110 controls the entire image forming apparatus 100. For example, the CPU 110 uses the RAM 103 as a work area to execute various control programs stored on the ROM 102 in order to output a control command to control each operation in the image forming apparatus 100. In particular, the image forming apparatus 100 according to the present embodiment uses the CPU 110 to implement, for example, a function to form the test pattern TP, a function as a distance measurement device, and a function to adjust a parameter relating to the amount of conveyance of the recording medium P based on the distance. Those functions will be described in detail later.

The recording head driver 104, the main scanning driver 105, and the sub-scanning driver 106 drive the recording head 6, the main scanning motor 8, and the sub-scanning motor 12, respectively.

The control FPGA 120 cooperates with the CPU 110 to control various types of operation in the image forming apparatus 100. The control FPGA 120 includes, for example, a CPU controller 121, a memory controller 122, an ink discharge controller 123, a sensor controller 124, and a motor controller 125 as functional components.

The CPU controller 121 communicates with the CPU 110 to transmit various types of information that the control FPGA 120 obtains to the CPU 110 and input a control command output from the CPU 110.

The memory controller 122 performs memory control to enable the CPU 110 to access the ROM 102 or the RAM 103.

The ink discharge controller 123 controls the operation of the recording head driver 104 in response to the control command from the CPU 110 in order to control the discharge timing at which ink is discharged from the recording head 6 driven by the recording head driver 104.

The sensor controller 124 processes a sensor signal such as encoder values output from the main-scanning encoder sensor 131 and the sub-scanning encoder sensor 132. For example, the sensor controller 124 performs a process for calculating, for example, the position, travel speed, and travel direction of the carriage 5 based on the encoder value output from the main-scanning encoder sensor 131. For example, the sensor controller 124 similarly performs a process for calculating the rotation speed or rotation direction of the conveyance roller 152 conveying the recording medium P based on the encoder value output from the sub-scanning encoder sensor 132.

The motor controller 125 controls the operation of the main scanning driver 105 in response to the control command from the CPU 110 to control the main scanning motor 8 driven by the main scanning driver 105 in order to control the movement of the carriage 5 in the main scanning direction. The motor controller 125 similarly controls the operation of the sub-scanning driver 106 in response to the control command from the CPU 110 to control the sub-scanning motor 12 driven by the sub-scanning driver 106 in order to control the movement (conveyance) of the recording medium P with the conveyance roller 152 in the sub-scanning direction.

Note that each component described above is an exemplary control function implemented by the control FPGA 120, and other control functions than the functions described above can also be implemented by the control FPGA 120. Alternatively, all or some of the control functions described above can be implemented by the program executed by the CPU 110 or another general-purpose CPU. Alternatively, some of the control functions described above can be implemented by dedicated hardware such as another FPGA different from the control FPGA 120 or an application specific integrated circuit (ASIC).

The recording head 6 includes a plurality of nozzles to discharge ink to form an image (see FIG. 3). The CPU 110 and the control FPGA 120 control the operation of the recording head driver 104. The recording head driver 104 drives the recording head 6 so that the recording head 6 discharges ink onto the recording medium P on the platen 16 to form an image.

The main-scanning encoder sensor 131 detects the mark of the encoder sheet 14 to obtain an encoder value, and outputs the obtained encoder value to the control FPGA 120. The sensor controller 124 of the control FPGA 120 uses the output encoder value to calculate the position, travel speed, and travel direction of the carriage 5. The position, travel speed, and travel direction of the carriage 5, which are calculated by the sensor controller 124 according to the encoder value, are transmitted to the CPU 110. The CPU 110 generates a control command to control the main scanning motor 8 according to the calculated position, travel speed, and travel direction of the carriage 5, and outputs the control command to the motor controller 125.

The imaging unit 20 captures an image of the test pattern TP on the recording medium P and performs various processing of the captured image, controlled by the CPU 110. The imaging unit 20 includes a two-dimensional sensor CPU 140 and the two-dimensional sensor 27.

The two-dimensional sensor 27 is, for example, a CCD sensor or a CMOS sensor as described above. The two-dimensional sensor 27 captures an image of the test pattern TP under predetermined operation conditions according to various setting signals transmitted from the two-dimensional sensor CPU 140. Then, the two-dimensional sensor 27 transmits the captured image to the two-dimensional sensor CPU 140.

The two-dimensional sensor CPU 140 controls the two-dimensional sensor 27 and processes the image captured by the two-dimensional sensor 27. In specific, the two-dimensional sensor CPU 140 transmits various setting signals to the imaging unit 20 in order to set various operation condition under which the two-dimensional sensor 27 operates. In addition, the two-dimensional sensor CPU 140 implements detection of the mark of the test pattern TP in the captured image of the test pattern TP, and calculation of the ratio between the distance in the captured image and the actual distance. Those functions will be described in detail later.

The imaging unit 20 further includes a RAM and a ROM so that, for example, the two-dimensional sensor CPU 140 uses the RAM as a work area to execute various control programs stored on the ROM in order to output a control command to control each operation of the imaging unit 20. In addition, the two-dimensional sensor CPU 140 has functions of converting the analog signal obtained in the photoelectric conversion by the two-dimensional sensor 27 into the digital image data in AD conversion and processing the digital image data in various image processing processes such as shading correction, white-balance correction, γ correction, and image data format conversion. Some of or the entire image processing processes for the captured image can be performed outside the imaging unit 20.

The sub-scanning encoder sensor 132 outputs the encoder value read from the encoder 35 to the control FPGA 120. The sensor controller 124 of the control FPGA 120 uses the encoder value to calculate the rotation speed and rotation direction of the conveyance roller 152 conveying the recording medium P. The rotation speed and rotation direction of the conveyance roller 152 calculated according to the encoder value by the sensor controller 124 are transmitted to the CPU 110. The CPU 110 generates a control command to control the sub-scanning motor 12 according to the calculated rotation speed and rotation direction of the conveyance roller 152 and outputs the control command to the motor controller 125.

As the sub-scanning motor 12 rotates at the rotation speed in the rotation direction according to the control command received from the motor controller 125, the conveyance roller 152 conveys the recording medium P by a predetermined amount.

In the image forming apparatus 100 according to the present embodiment, the recording head driver 104, the main scanning driver 105, the sub-scanning driver 106, the recording head 6, the main scanning motor 8, and the sub-scanning motor 12 together function as an image forming device to form an image on the recording medium P. The recording head driver 104, the main scanning driver 105, and the sub-scanning driver 106 are controlled by the CPU 110 and the control FPGA 120. The recording head 6, the main scanning motor 8, and the sub-scanning motor 12 are driven by those drivers.

In FIG. 13, the two-dimensional sensor CPU 140 and the imaging unit 20 are mounted on the carriage 5. However, the two-dimensional sensor CPU 140 and the imaging unit 20 can be disposed at any positions where the two-dimensional sensor CPU 140 and the imaging unit 20 can appropriately capture an image of the test pattern TP on the recording medium P. Thus, the two-dimensional sensor CPU 140 and the imaging unit 20 are not necessarily mounted on the carriage 5.

[Functional Configuration of Image Forming Apparatus]

Figure 14:
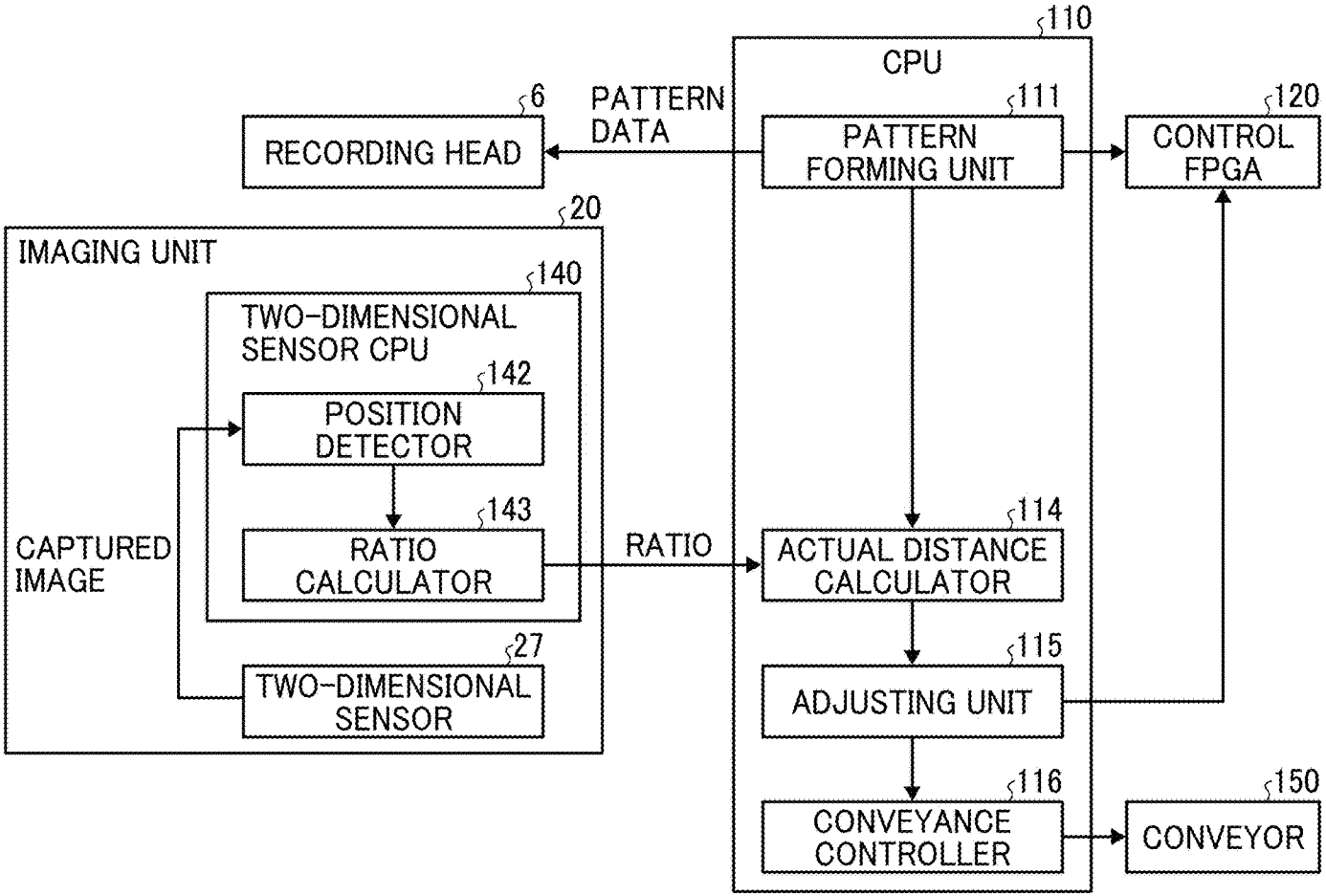
FIG. 14 is a block diagram of a functional configuration of the image forming apparatus according to Embodiment 1.

Characteristic functions implemented by the CPU 110 and two-dimensional sensor CPU 140 of the image forming apparatus 100 will be described, referring to FIG. 14. FIG. 14 is a block diagram of a functional configuration of the image forming apparatus according to Embodiment 1.

For example, the CPU 110 uses the RAM 103 as a work area to execute a control program stored on the ROM 102 in order to implement, for example, the functions of the pattern forming unit 111, the actual distance calculator 114, the adjusting unit 115, and the conveyance controller 116. For example, the two-dimensional sensor CPU 140 of the imaging unit 20 similarly uses the RAM as a work area to execute a control program stored on the ROM in order to implement, for example, the functions of the position detector 142 and the ratio calculator 143.

The conveyance controller 116 of the CPU 110 controls the conveyance roller 152 of the conveyor 150 to convey the recording medium P. For example, the conveyance controller 116 determines the rotation speed and rotation direction of the conveyance roller 152 based on the encoder value output from the sub-scanning encoder sensor 132. Then, the conveyance controller 116 transmits a control command indicating the determined rotation speed and rotation direction via the control FPGA 120 to the sub-scanning motor 12 of the conveyor 150, thereby controlling the conveyance roller 152 to convey the recording medium P.

The pattern forming unit 111 of the CPU 110 reads the pattern data preliminarily stored, for example, on the ROM 102 and causes the image forming device described above to form, according to the pattern data, the test pattern TP on the recording medium P. The imaging unit 20 captures an image of the test pattern TP on the recording medium P formed by the pattern forming unit 111.

The test pattern TP according to the present embodiment is a mark set M including, at least, a first mark M1 and a pair of second marks M2*a* and M2*b*. The test pattern TP will be described in detail later (see FIG. 15). The pattern forming unit 111 causes the image forming device to form one of the first mark M1 and the pair of second marks M2*a* and M2*b* on the recording medium P. After the recording medium P is conveyed by a predetermined amount, the pattern forming unit 111 causes the image forming device to form the other (either the first mark M1 or the pair of second marks M2*a* and M2*b*).

In the present embodiment, a description is given of an example in which the pattern forming unit 111 causes the recording head 6 to form the first mark M1 on the recording medium P and, after the recording medium P is conveyed by a predetermined amount, to form the pair of second marks M2*a* and M2*b*. As described above, the order of formation of the marks is not limited. The pattern forming unit 111 can form the second marks M2*a* and M2*b* on the recording medium P and then form the first mark M1 after the recording medium P is conveyed by the predetermined amount.

Figure 15:
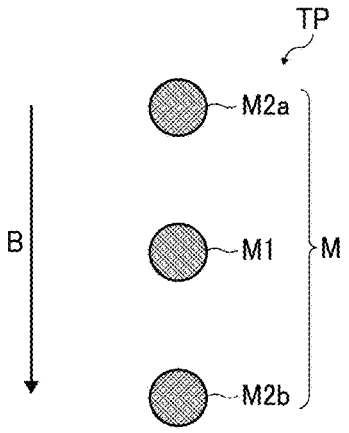
FIG. 15 illustrates an example of a test pattern on a recording medium, according to am embodiment.

Here, the test pattern TP will be described. FIG. 15 illustrates an example of the test pattern on a recording medium. As illustrated in FIG. 15, the test pattern TP is the mark set M including, at least, the first mark M1 and the pair of second marks M2*a* and M2*b*. In the test pattern TP illustrated in FIG. 15, the first mark M1 is disposed at a midpoint position between the second marks M2*a* and M2*b*. The first mark M1 and the pair of second marks M2*a* and M2*b* are formed as dots and lined up in the sub-scanning direction B, in which the recording medium P is conveyed.

Figure 16A:
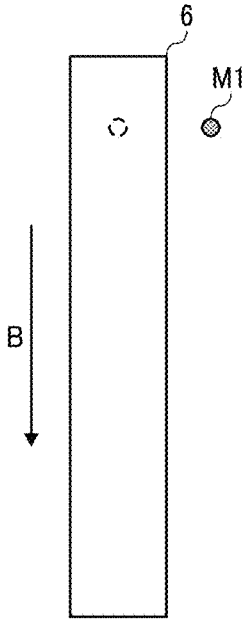
FIGS. 16A, 16B, and 16C illustrate a method of forming the test pattern illustrated in FIG. 15.
Figure 16B:
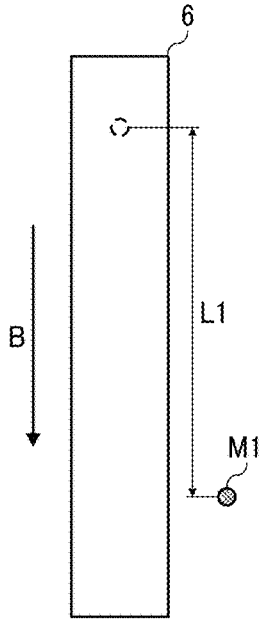
Figure 16C:
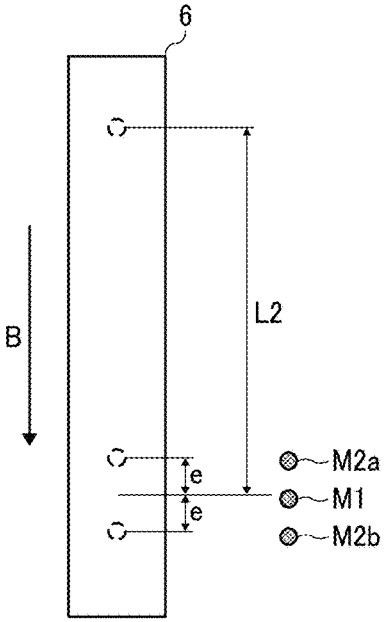

Next, a method of forming the test pattern is described with reference to FIGS. 16A, 16B, and 16C. Initially, the pattern forming unit 111 causes the recording head 6 to form the first mark M1 on the recording medium P as illustrated in FIG. 16A. Subsequently, as illustrated in FIG. 16B, the conveyance controller 116 controls the conveyance roller 152 to convey the recording medium P for a predetermined amount L2 in the sub-scanning direction B, which is an ideal amount by which the recording medium P is conveyed in formation of the test pattern TP (i.e., ideal conveyance distance). The amount by which the recording medium P is actually conveyed at that time is a conveyance amount L1 (also referred to as "actual conveyance amount L1"). After the conveyance of the conveyance amount L1, as illustrated in FIG. 16C, the pattern forming unit 111 causes the recording head 6 to form the second marks M2*a* and M2*b*. Here, referring also to FIG. 3, when the nozzle to form the first mark M1 is referred to as a first mark nozzle 6A1 (illustrated in FIG. 3), a nozzle located at a distance L2 from the first mark nozzle 6A1 is referred to as a reference nozzle (e.g., a nozzle 6A4). The pair of second marks M2*a* and M2*b* are formed with two nozzles 6A2 and 6A3, each of which is at a distance e forward or backward from the reference nozzle 6A4 in the sub-scanning direction B. Hereinafter, the two nozzles 6A2 and 6A3 at the distance e from the reference nozzle 6A4 in the sub-scanning direction are referred to as "specified nozzles".

Accordingly, when the actual conveyance amount L1 is identical to the ideal conveyance distance L2, in the test pattern TP, the first mark M1 is located at an ideal position that is a midpoint between the second marks M2*a* and M2*b* in the sub-scanning direction. By contrast, when the actual conveyance amount L1 is different from the ideal conveyance distance L2, in the test pattern TP, the first mark M1 is located, for example, between the second marks M2*a* and M2*b* and closer to either the second mark M2*a* or M2*b* in the sub-scanning direction.

Then, the imaging unit 20 captures (images) the test pattern TP and the two-dimensional sensor CPU 140 calculates the relative positions of the first mark M1 and the pair of second marks M2*a* and M2*b* to obtain the amount of difference (hereinafter referred to as "deviation amount") between the ideal conveyance distance L2 and the actual conveyance amount L1. Note that, although the ideal position of the first mark M1 is intermediate (at the midpoint in particular) between the second marks M2*a* and M2*b* in the present embodiment, the ideal position of the first mark M1 is not limited thereto. In other words, the first mark M1 can be formed at any position as long as the first mark M1 can be captured together with the second marks M2*a* and M2*b* and formed at a predetermined position. For example, the ideal position of the first mark M1 can be closer to either the second mark M2*a* or M2*b* and not necessarily between the second marks M2*a* and M2*b*.

In one embodiment, the pattern forming unit 111 uses nozzles (e.g., the nozzles 6A1, 6A2, and 6A3 illustrated in FIG. 3) on the same line to form the first mark M1 and the pair of second marks M2*a* and M2*b*. Alternatively, the nozzles to form the first mark M1 and the pair of second marks M2*a* and M2*b* can be on different lines as long as each of the nozzles to form the second marks M2*a* and M2*b* is at the distance e from the reference nozzle (e.g., the nozzle 6A4) in the sub-scanning direction B. In other words, the second marks M2*a* and M2*b* can be formed at positions different in the main scanning direction A.

Specifically, as described above with reference to FIG. 3, each of the recording heads 6A, 6B, and 6C according to the present embodiment includes one nozzle line for each color (four lines in total) in which a large number of nozzles are lined in the sub-scanning direction B. For example, the pattern forming unit 111 can cause the recording head 6A to discharge ink from nozzles of the same line (e.g., the nozzle line 6Ak) of the four nozzle lines 6Ac, 6Ay, 6Am, and 6Ak, to form the first mark M1 and the second marks M2*a* and M2*b*. That is, the first mark M1 and the second marks M2*a* and M2*b* are formed with the ink discharged from the nozzle line 6Ak of the recording head 6A.

Alternatively, the pattern forming unit 111 can form the second marks M2*a* and M2*b* with ink discharged from nozzles of on the line different from the nozzle line to form the first mark M1. For example, the first mark M1 is formed with the ink discharged from the nozzle line 6Ak of the recording head 6A and the second marks M2*a* and M2*b* are formed with the ink discharged from the nozzle line 6Am of the recording head 6A. In this case, although the second marks M2*a* and M2*b* are shifted from the first mark M1 in the main scanning direction, the second marks M2*a* and M2*b* can be formed with the specified nozzles disposed at the distances e forward and backward from the reference nozzle in the sub-scanning direction B.

Note that, in forming the test pattern TP, the relative positions between the first mark M1 and the second marks M2*a* and M2*b* are not limited, as long as the first mark M1 is formed before the recording medium P is conveyed by the predetermined amount (conveyance amount L1) and the second marks M2*a* and M2*b* are formed after the recording medium P is conveyed by the predetermined conveyance amount L1. In addition, the position and timing to form each of the first mark M1 and the pair of second marks M2*a* and M2*b* of the test pattern TP are indicated in the pattern data described above. According to the timing mentioned here, the mark is formed in either the forward movement of the carriage 5 or the backward movement of the carriage 5.

Additionally, the pattern forming unit 111 can form the first mark M1 on the recording medium P and, after the recording medium P is conveyed by an integral multiple of the conveyance amount L1 to be adjusted, form the pair of second marks M2*a* and M2*b*. Specifically, although the ideal conveyance distance is equivalent to the distance L2 between the reference nozzle (e.g., 6A4 in FIG. 3) and the first mark nozzle (e.g., 6A1 in FIG. 3) in the description above, the ideal distance can be an integral multiple of the distance L2 (n×L2), and the recording medium P can be conveyed by a distance represented as n×L1 after the first mark M1 is formed. In this case, as the recording medium P is conveyed by the distance n×L1, the effect of error due to a bend of the nozzle to form the mark is dispersed in the distance n times of the distance L1. That is, the error due to the bend of the nozzle can be reduced to one nth (1/n). When the distance L2 between the reference nozzle and the nozzle for the first mark M1 is small or the width of pattern formation in the sub-scanning direction is large, multiplying (n times) the conveyance amount L1 in forming the test pattern TP is advantageous in obtaining a more accurate deviation amount. Note that, when the effect of bent of the nozzle is small enough to be ignored, it is not necessary to disperse the error of nozzle bend to be averaged as described above.

Referring back to FIG. 14, the position detector 142 of the two-dimensional sensor CPU 140 processes the image captured with the imaging unit 20 in a predetermined process such as a binarization process to detect each of the first mark M1 and the pair of second marks M2*a* and M2*b* from the captured image.

The ratio calculator 143 of the two-dimensional sensor CPU 140 calculates the ratio between the distance between the second marks M2*a* and M2*b* in the captured image and the amount of deviation of the first mark M1 in the captured image based on the positions of the first mark M1 and the pair of second marks M2*a* and M2*b* in the captured image.

Figure 17:
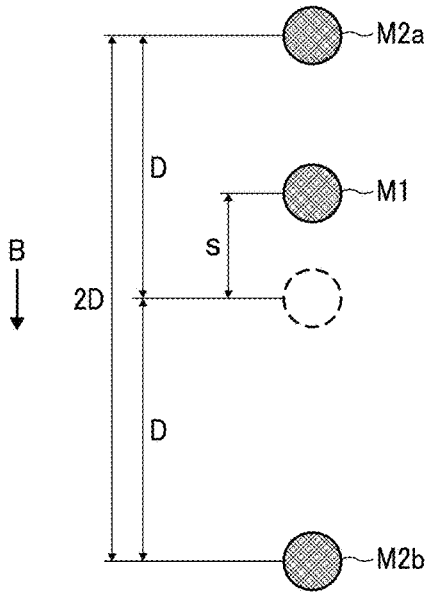
FIG. 17 is a diagram illustrating a method for calculating the ratio between the distance between the pair of second marks and the amount of deviation in a captured image of the first mark illustrated in FIG. 15.

Referring to FIG. 17A, descriptions are given below of a method for calculating the ratio between the distance between the second marks M2*a* and M2*b* and the amount of deviation of the first mark M1 in the captured image. As illustrated in FIG. 17, the ratio calculator 143 obtains the distance 2D between the second marks M2*a* and M2*b* in the captured image from the detected positions of the second marks M2*a* and M2*b*. Then, the ratio calculator 143 obtains a deviation amount s of the first mark M1 in the captured image based on the difference between the detected position of the first mark M1 and the ideal position of the first mark M1. In the example described here, the ideal position of the first mark M1 is the midpoint of the pair of second marks M2*a* and M2*b*, in other words, a position away from each of the second marks M2*a* and M2*b* by half the distance between the second marks M2*a* and M2*b*. In FIG. 17, the ideal position of the first mark M1 is indicated by broken circle in FIG. 17, which is equidistant (at a distance D in FIG. 17) from the second mark M2*a* and the second mark M2*b*. Then, the deviation amount s of the first mark M1 in the captured image is divided by the distance 2D between the second marks M2*a* and M2*b* in the captured image, thereby calculating the ratio (s/2D). The ratio calculator 143 transmits the calculated ratio to the actual distance calculator 114.

Figure 18:
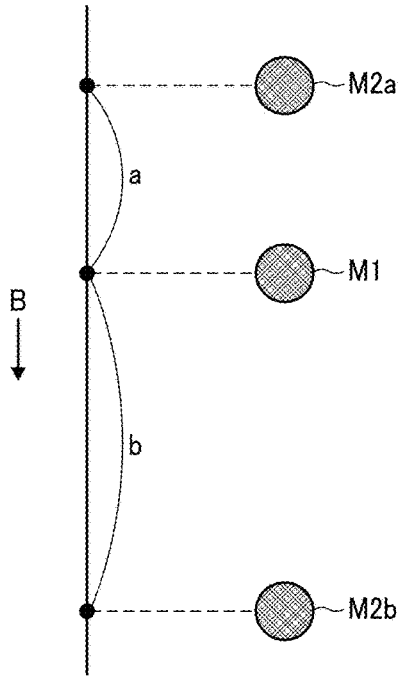
FIG. 18 illustrates an example of occurrence of a deviation in the relative positions between the first mark and the pair of second marks in the test pattern illustrated in FIG. 15.

Next, referring to FIG. 18, a description is given of an example in which deviation occurs in the relative positions between the first mark M1 and the pair of second marks M2*a* and M2*b* in formation of the test pattern TP illustrated in FIG. 15.

As described above, the first mark M1 is expected to be located at the midpoint of the second marks M2*a* and M2*b* (ideal position) in the test pattern TP illustrated in FIG. 15. However, the deviation of ink landing position caused by the variations in amount of conveyance of the recording medium P shifts the first mark M1 closer to the second mark M2*a* as illustrated in FIG. 18. In the captured image based on this assumption, as illustrated in FIG. 18, the first mark M1 is at a distance a from the second mark M2*a* and at a distance b from the first mark M2*b*.

Even if a relative deviation occurs between the pair of second marks M2*a* and M2*b* and the first mark M1, the actual distance between the second marks M2*a* and M2*b* is not changed because the pair of second marks M2*a* and M2*b* is formed under the same conditions (the same amount of conveyance). In other words, the actual distance between the second marks M2*a* and M2*b* expressed as a distance a+b illustrated in FIG. 18 is not changed even if a relative deviation occurs between the pair of second marks M2*a* and M2*b* and the first mark M1.

Figure 19:
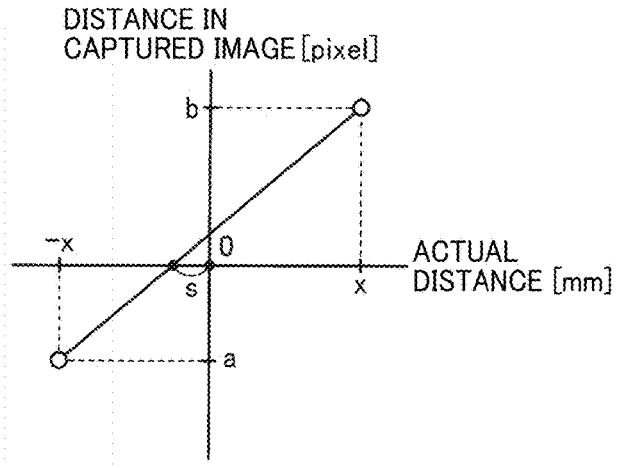
FIG. 19 is a diagram of the amount of deviation of the first mark relative to the pair of second marks of the test pattern illustrated in FIG. 15.

FIG. 19 is a diagram of the amount of deviation of the first mark M1 relative to the pair of second marks M2*a* and M2*b*. FIG. 19 illustrates a coordinate plane including the midpoint of the pair of second marks M2*a* and M2*b* as an origin, the actual distance on a horizontal axis, and the distance in the captured image on a vertical axis. The positions of the second marks M2*a* and M2*b* are plotted on the coordinated plane, respectively. The example illustrated in FIG. 19 is on the assumption that the first mark M1 is deviated relatively to the pair of second marks M2*a* and M2*b* as illustrated in FIG. 18.

The inclination of the line connecting the plotted positions of the second marks M2*a* and M2*b* in FIG. 19 corresponds to the ratio between the distance between the second marks M2*a* and M2*b* in the captured image and the actual distance between the second marks M2*a* and M2*b*. In other words, the inclination of the line indicates the ratio between the distance in the captured image and the actual distance (image magnification). In the case where the relative deviation between the pair of second marks M2*a* and M2*b* and the first mark M1 does not occur, the position of the first mark M1 is plotted on the origin. Accordingly, the distance s between the intersect of the line connecting the plotted positions of the second marks M2*a* and M2*b* and the horizontal axis and the origin represents the amount of deviation of the first mark M1 relative to the pair of second marks M2*a* and M2*b*.

The ratio between the distance in the captured image and the actual distance (the image magnification) varies according to a variation in the distance between the imaging unit 20 and the test pattern TP. The image forming apparatus 100 according to the present embodiment supports the recording medium P on which the test pattern TP is formed on the platen 16 having a rugged shape including the rib-shaped projections as described above. Thus, the rugged shape of the platen 16 varies the distance between the imaging unit 20 and the test pattern TP and may change the ratio.

Figure 20:
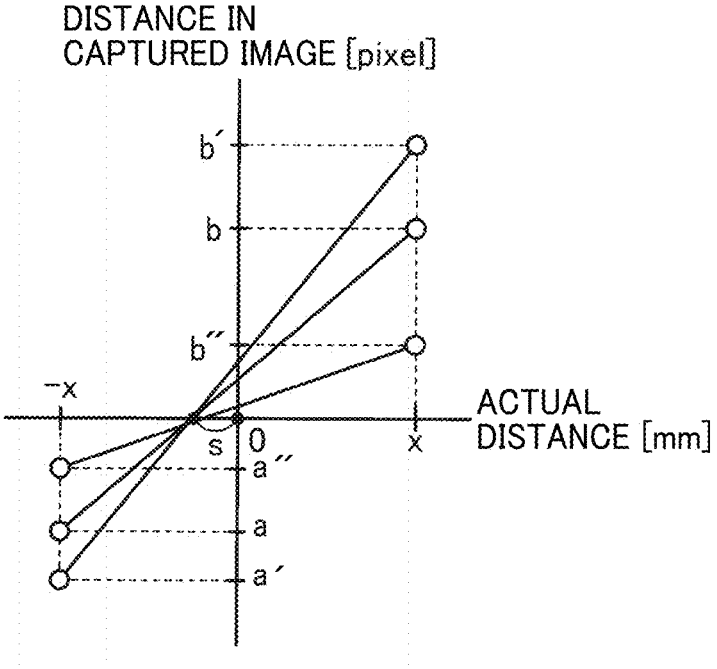
FIG. 20 is a diagram of the amount of deviation of the first mark relative to the pair of second marks of the test pattern illustrated in FIG. 15, when the distance between the imaging unit and the test pattern varies.

FIG. 20 is a diagram of the amount of deviation of the first mark M1 relative to the pair of second marks M2*a* and M2*b* when the distance between the imaging unit 20 and the test pattern TP varies. When the distance between the imaging unit 20 and the test pattern TP decreases, the distance between the second mark M2*a* and the first mark M1 in the captured image has a value a' larger than the distance a illustrated in FIG. 18 and the distance between the second mark M2*b* and the first mark M1 in the captured image has a value b' larger than the distance b illustrated in FIG. 18. Therefore, the inclination of the line connecting the plotted positions of the second marks M2*a* and M2*b* increases in comparison with the inclination in the example in FIG. 19.

On the other hand, when the distance between the imaging unit 20 and the test pattern TP increases, the distance between the second mark M2*a* and the first mark M1 in the captured image has a value a" smaller than the distance a illustrated in FIG. 18 and the distance between the second mark M2*b* and the first mark M1 in the captured image has a value b" smaller than the distance b illustrated in FIG. 18. Thus, the inclination of the line connecting the plotted positions of the second marks M2*a* and M2*b* decreases in comparison with the inclination in the example in FIG. 19. However, the deviation amount s of the first mark M1 relative to the pair of second marks M2*a* and M2*b* is not changed even if the inclination of the line connecting the plotted positions of the second marks M2*a* and M2*b* varies.

The distance between the intersect of the line connecting the plotted positions of the second marks M2*a* and M2*b* and the vertical axis and the origin is the amount of deviation of the first mark M1 relative to the pair of second marks M2*a* and M2*b* in the captured image. As the distance between the imaging unit 20 and the test pattern TP decreases, the distance between the second marks M2*a* and M2*b* increases, and the amount of deviation in the captured image also increases at the same ratio. On the other hand, as the distance between the imaging unit 20 and the test pattern TP increases, the distance between the second marks M2*a* and M2*b* decreases, and the amount of deviation in the captured image also decreases at the same ratio. In other word, even if the distance between the imaging unit 20 and the test pattern TP varies, the ratio between the distance between the second marks M2*a* and M2*b* and the amount of deviation in the captured image does not change.

Referring back to FIG. 14, the actual distance calculator 114 of the CPU 110 multiplies the distance between the specified nozzles (i.e., a theoretical distance between the pair of second marks) used to form the second marks M2*a* and M2*b* by the ratio calculated with the ratio calculator 143, thereby calculating the actual distance of deviation amounts of the first mark M1, relative to the pair of second marks M2*a* and M2*b*. The actual distance calculator 114 transmits the calculated actual distance to the adjusting unit 115.

The adjusting unit 115 of the CPU 110 calculates the correction amount of the parameter relating to the conveyance amount of the recording medium P (controlled by the conveyance controller 116), based on the deviation amount s of the first mark M1 calculated by the actual distance calculator 114. Then, the adjusting unit 115 adjusts the parameter by the calculated correction amount. The parameter relating to the amount of conveyance of the recording medium P (hereinafter also simply "conveyance-related parameter") includes, for example, the parameter to control the rotation speed of the conveyance roller 152. The adjusting unit 115 transmits the adjustment value for the parameters to the control FPGA 120 in order to adjust, for example, the operation of the conveyance controller 116 to control the conveyance roller 152.

[Operation of Image Forming Apparatus]

Figure 21A:
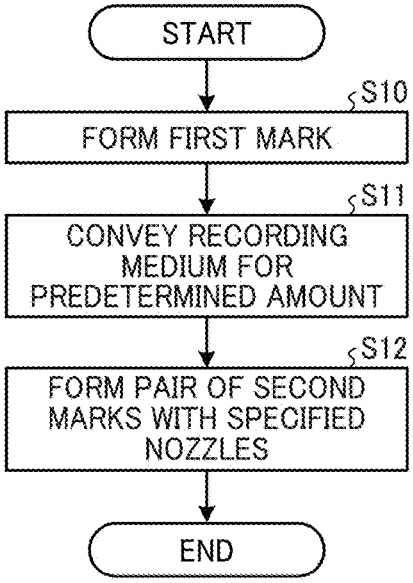
FIGS. 21A, 21B, and 21C are flowcharts of the operation for adjusting the amount of conveyance in the image forming apparatus according to Embodiment 1.
Figure 21B:
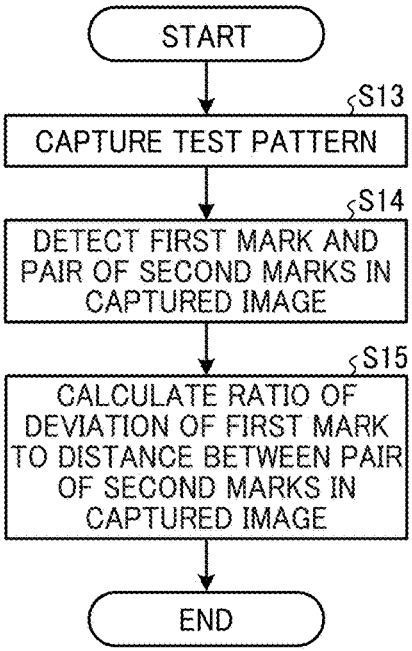
Figure 21C:
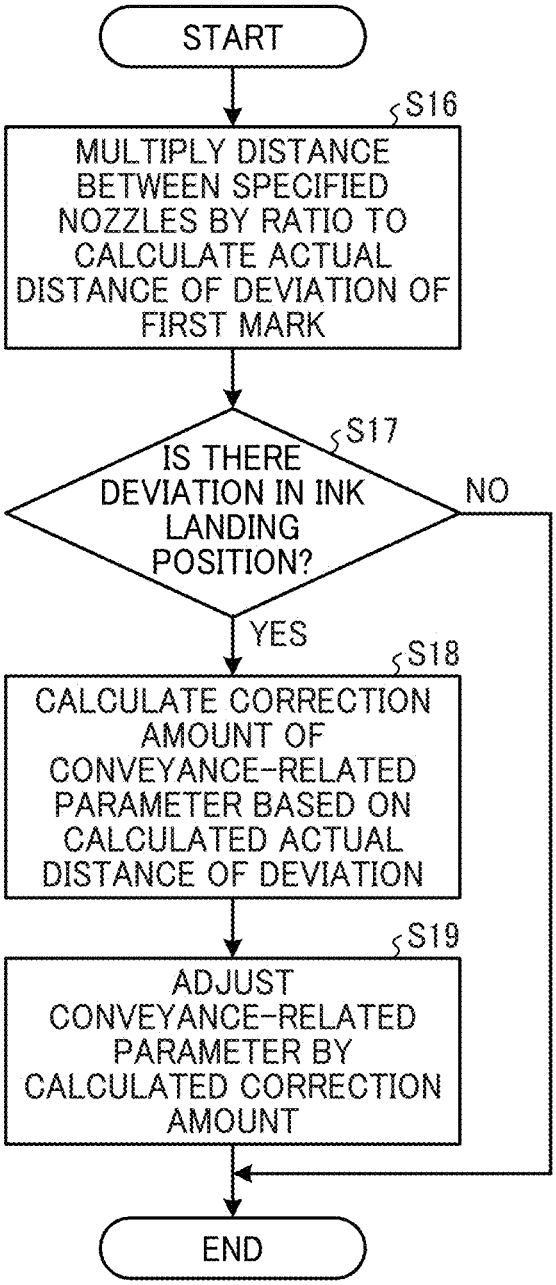

The operation of the image forming apparatus 100 for adjusting the amount of conveyance will be described, referring to FIGS. 21A, 21B, and 21C. FIGS. 21A, 21B, and 21C are flowcharts of the operation for adjusting the amount of conveyance in the image forming apparatus according to Embodiment 1. The steps S13 to S15 in FIG. 21B are performed by the imaging unit 20 controlled by the two-dimensional sensor CPU 140, and steps S10 to S12 in FIG. 21B and steps S16 to S19 in FIG. 21C are controlled by the CPU 110.

When the recording medium P is set on the platen 16, at S10, the pattern forming unit 111 of the CPU 110 forms the first mark M1 on the recording medium P. At S11, the conveyance controller 116 of the causes the conveyance roller 152 to convey the recording medium P for the predetermined conveyance amount L1.

At S12, the pattern forming unit 111 causes the recording head 6A to form the pair of second marks M2*a* and M2*b* with the specified nozzles (e.g., the nozzles 6A2 and 6A3) disposed at the distance e forward and backward, respectively, from the reference nozzle (e.g., the nozzle 6A4) positioned at the distance L2 (ideal conveyance distance) from the first mark nozzle, in the sub-scanning direction B. As a result, the test pattern TP including the first mark M1 and the pair of second marks M2*a* and M2*b* is formed.

Referring to FIG. 21B, at S13, the two-dimensional sensor 27 of the imaging unit 20 captures an image of the test pattern TP formed at steps S10 and S12, and outputs the captured image of the test pattern TP. At S14, the position detector 142 of the two-dimensional sensor CPU 140 detects the position of each of the pair of second marks M2*a* and M2*b* and the first mark M1 in the captured image.

At S15, the ratio calculator 143 of the two-dimensional sensor CPU 140 calculates the ratio of the amount of deviation of the first mark M1 in the captured image relative to the distance between the pair of second marks M2*a* and M2*b* in the captured image, using the detected positions of the first mark M1 and the pair of second marks M2*a* and M2*b* in the captured image.

Referring to FIG. 21C, at S16, the actual distance calculator 114 of the CPU 110 multiplies, by the ratio calculated at S15, the distance between specified nozzles (to form the second marks M2*a* and M2*b*), using the pattern data used to form the test pattern TP at steps S10 and S12 and the ratio calculated at step S15 to calculate the actual distance of deviation of the first mark M1.

At S17, the adjusting unit 115 of the CPU 110 determines, based on the actual distance of deviation of the first mark M1 calculated at step S16, whether the landing position of ink has deviated. When the adjusting unit 115 determines that the landing position of ink has not deviated (No at S17), a sequence of operations is completed.

On the other hand, when the adjusting unit 115 determines that the landing position has deviated (Yes at S17), at S18, the adjusting unit 115 calculates the correction amount of the conveyance-related parameter based on the actual distance of deviation of the first mark M1 calculated at S16. At S19, the adjusting unit 115 adjusts the conveyance-related parameter, using the calculated correction amount. Then, a sequence of operations is completed.

As described above, the image forming apparatus 100 according to the present embodiment forms the first mark M1, conveys the recording medium P for the predetermined amount (the conveyance amount L1), and then forms the pair of second marks M2*a* and M2*b*, thereby forming the test pattern TP including the first mark M1 and the pair of second marks M2*a* and M2*b*. Then, the imaging unit 20 captures an image of the formed test pattern. Next, the image forming apparatus 100 detects the position of each of the pair of second marks M2*a* and M2*b* and the first mark M1 of the test pattern TP in the captured image. Then, the image forming apparatus 100 calculates the ratio between the distance between the second marks M2*a* and M2*b* in the captured image and the amount of deviation of the first mark M1 in the captured image, and multiplies the actual distance between the second marks M2*a* and M2*b* by the ratio to calculate the actual distance of deviation of the first mark M1. Then, the image forming apparatus 100 adjusts the parameter relating to the amount of conveyance of the recording medium P according to the actual distance of deviation.

Therefore, according to the present embodiment, even if the distance between the imaging unit 20 and the test pattern TP varies, the image forming apparatus 100 can calculate the actual distance of deviation of the landing position of ink based on the captured image of the test pattern TP. Then, the image forming apparatus 100 can adjust the parameter relating to the amount of conveyance of the recording medium P based on the amount of deviation, thereby improving the image quality.

<Another Method for Calculating Actual Distance of Deviation of First Mark>

In the embodiment described above, the ratio between the distance between the second marks M2*a* and M2*b* in the captured image and the amount of deviation of the first mark M1 in the captured image is calculated. Then, the distance between the specified nozzles (i.e., the theoretical distance between the second marks M2*a* and M2*b*) is multiplied by the calculated ratio to obtain the actual distance of deviation of the first mark M1. Alternatively, the actual distance of deviation of the first mark M1 can be calculated as follows.

The ratio calculator 143 calculates the ratio between the distance between the second marks M2*a* and M2*b* in the captured image and the distance between one of the second marks M2*a* and M2*b* and the first mark M1 in the captured image. For example, when FIG. 18 is referred to, the calculated ratio in this example is represented as a/(a+b) or b/(a+b).

The actual distance calculator 114 multiplies the distance between the specified nozzles used to form the second marks M2*a* and M2*b* (theoretical distance between the second marks M2*a* and M2*b*) by the ratio calculated with the ratio calculator 143 to calculate the actual distance between one of the second marks M2*a* and M2*b* and the first mark M1. Then, the actual distance calculator 114 subtracts the calculated actual distance between one of the second marks M2*a* and M2*b* and the first mark M1 from the distance between one of the second marks M2*a* and M2*b* and the first mark M1 in the pattern data used to form the test pattern TP in order to calculate the actual distance of deviation of the first mark M1. Then, the parameter relating to the amount of conveyance of the recording medium P is adjusted based on the calculated actual distance of deviation of the first mark M1.

[Modification of Test Pattern]

The test pattern TP used in the present embodiment is not limited to the example illustrated in FIG. 15, and can be variously modified. A modification of the test pattern TP will be described below.

Figure 22:
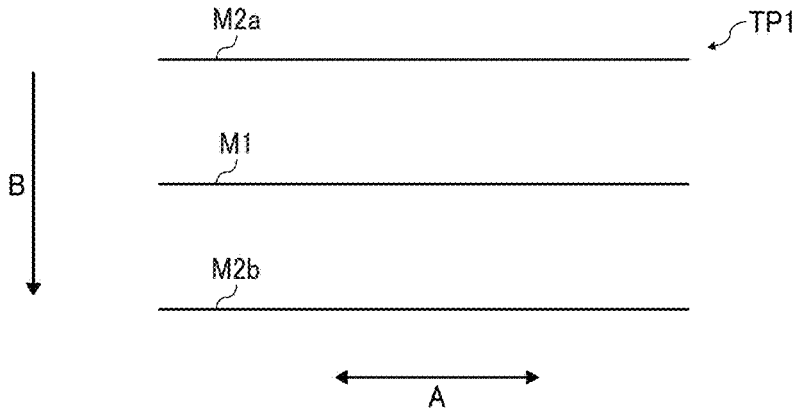
FIG. 22 is a diagram of a test pattern including linear marks according to an embodiment.

Although, in the test pattern TP illustrated in FIG. 15, the first mark M1 and the pair of second marks M2*a* and M2*b* are dots, alternatively, the first mark M1 and the pair of second marks M2*a* and M2*b* can be lines extending in the main scanning direction in which the carriage 5 moves. FIG. 22 illustrates a test pattern TP1 including linear marks. For example, as illustrated in FIG. 22, the pair of second marks M2*a* and M2*b* and the first mark M1 can be lines extending in the main scanning direction A, and the first mark M1 is disposed between the second marks M2*a* and M2*b*. Modifying the marks into lines facilitates the detection of the positions of the marks in the captured image.

Figure 23:
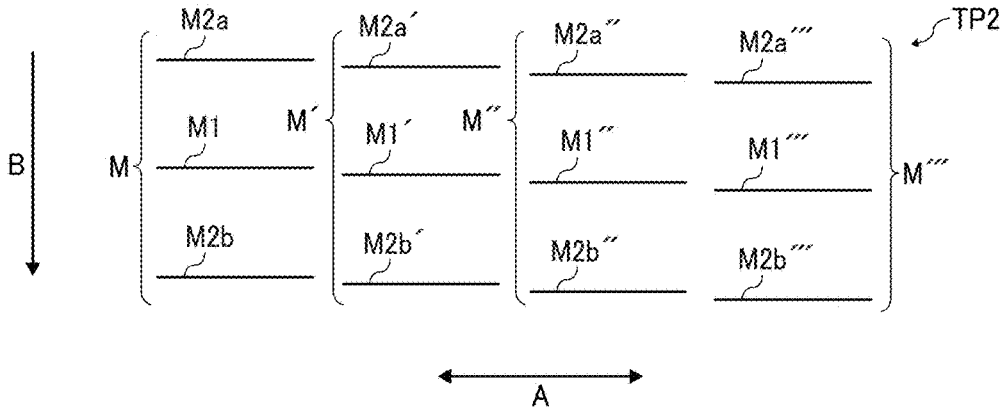
FIG. 23 illustrates an example of a test pattern including a plurality of linear marks according to an embodiment.

The test pattern TP can be formed with a plurality of linear marks extending in the main scanning direction A. FIG. 23 illustrates an example of a test pattern including groups of linear marks. For example, a test pattern TP2 illustrated in FIG. 23 includes a plurality of mark sets M (four mark sets M, M', M", and M"') arranged in the main scanning direction A, and each of the mark sets M includes the pair of second mark M2*a* and M2*b* and the first mark M1 that are lines extending in the main scanning direction A. The first mark M1 is disposed between the second mark M2*a* and M2*b*. In FIG. 23, first marks M1, M1', M1", and M1"', and second marks M2*a*, M2*a*', M2*a*", M2*a*"', M2*b*, M2*b*', M2*b*", and M2*b*"' are formed with different nozzles from each other. Hereinafter, the first marks M1, M1', M1", and M1"' are also collectively referred to as "first marks M1". Similarly, the second marks M2*a*, M2*a*', M2*a*", M2*a*"', M2*b*, M2*b*', M2*b*", and M2*b*"' are also collectively referred to as second marks M2*a* and M2*b*".

In the case where the plurality of mark sets M to M"' formed with line marks extending in the main scanning direction A is formed by same nozzles, the mark sets M to M"' may be affected by the bend (bend in discharge) of the nozzles inherent in those nozzles. By contrast, when the plurality of mark sets M to M"' is formed with different nozzles and the amount of deviation is obtained based on the test pattern TP formed by the different nozzles to calculate the average, the effects of the bends (bend in discharge) inherent in the nozzles can be reduced. For example, in the case illustrated in FIG. 23, since the amount of deviation is obtained based on the test pattern TP2 including the four mark sets M to M"', the error is reduced to one fourth (¼).

Yet in another configuration, in the test pattern TP including the plurality of linear marks extending in the main scanning direction A, a reference line to locate the first mark M1 and the pair of second marks M2*a* and M2*b* can be formed under a condition different from the condition under which the first mark M1 and the pair of second marks M2*a* and M2*b* are formed. The reference line can be a reference frame surrounding the first mark M1 and the pair of second marks M2*a* and M2*b*.

Figure 24:
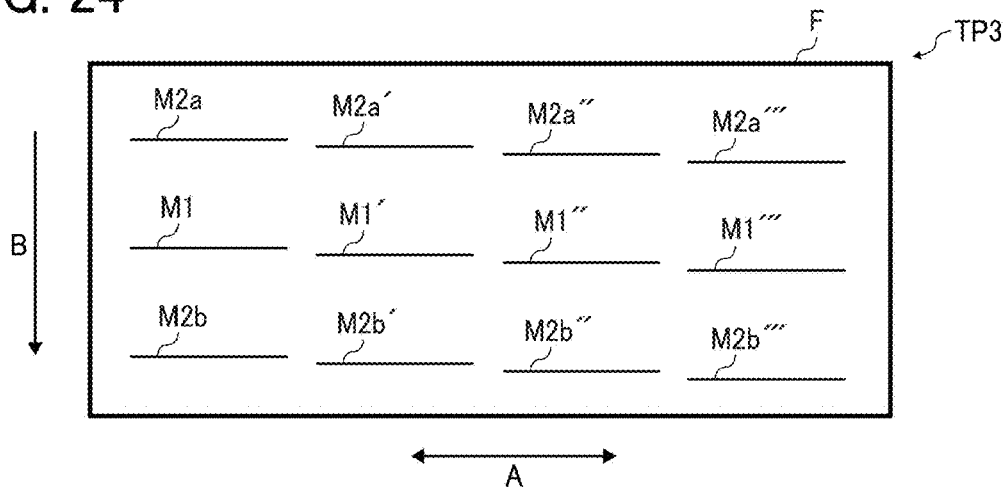
FIG. 24 illustrates an example of a test pattern including plurality of linear marks and a reference frame according to an embodiment.

FIG. 24 illustrates a test pattern TP3 including linear marks and the reference frame. A test pattern TP3 illustrated in FIG. 24 includes the test pattern TP2 illustrated in FIG. 23 and a reference frame F surrounding the test pattern TP. The reference frame F is formed under a condition different from the condition under which the marks of the test pattern TP2 are formed. For example, the reference frame F is formed with a line having a thickness different from the thickness of the marks of the test pattern TP2. This allows the reference frame F to be distinguished from the test pattern TP2 including the plurality of first marks M1 and a plurality of pairs of second marks M2*a* and M2*b* when the positions of the first marks M1 and the pairs of second marks M2*a* and M2*b* in the captured image are detected.

The image forming apparatus 100 detects the position of the reference frame F after obtaining the captured image. Then, the image forming apparatus 100 detects the positions of the first marks M1 and the pairs of second marks M2*a* and M2*b* based on the position of the reference frame F. This enables the image forming apparatus 100 to easily detect the positions of the first marks M1 and the pairs of second marks M2*a* and M2*b* even if the test pattern TP2 is formed at a deviated position in the captured image.

The reference frame F will be described here. When an image of the reference frame F is captured with the imaging unit 20 that does not include the reference chart 300 illustrated in FIG. 9 (see FIGS. 10 and 11), the captured range is preferably set so that the reference frame F is positioned near the center of the image capture range. On the other hand, when an image of the reference frame F is captured with the imaging unit 20 having the reference chart 300 (see FIGS. 4 to 8), the captured range is preferably set to satisfy the following conditions: Conditions 1) the reference frame F is positioned to be captured from the opening 53 without the reference chart 300, and Condition 2) the reference frame F is near the optical axis of the light emitted from the light source 58.

Figure 25A:
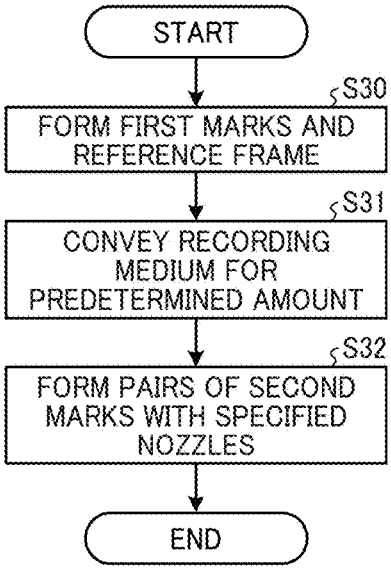
FIGS. 25A, 25B, and 25C are flowcharts of the operation for adjusting the amount of conveyance in the image forming apparatus according to a modification of Embodiment 1.
Figure 25B:
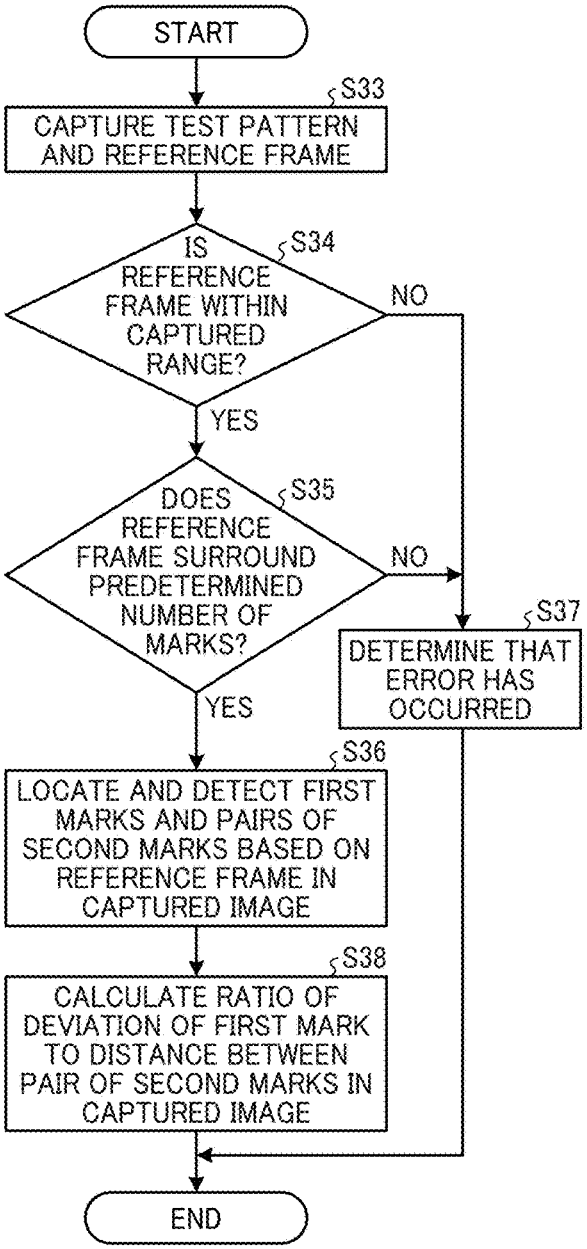
Figure 25C:
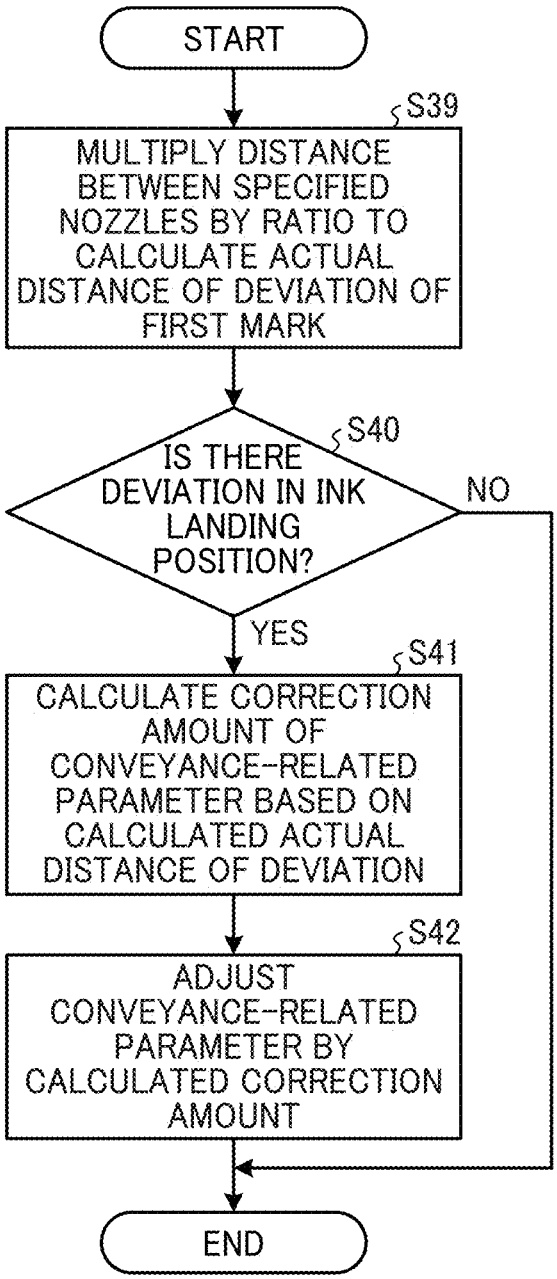

Referring to FIGS. 25A, 25B, and 25C, descriptions are given below of operation of the image forming apparatus 100 for adjusting the amount of conveyance in a case of the test pattern TP3 illustrated in FIG. 24 (including line marks surrounded by the reference frame F). FIGS. 25A, 25B, and 25C are flowcharts of the operation for adjusting the amount of conveyance in the image forming apparatus according to a modification of Embodiment 1.

When the recording medium P is set on the platen 16, at S30, the pattern forming unit 111 of the CPU 110 forms the plurality of first mark M1 (M1 to M1'''') on the recording medium P and forms the reference frame F with given nozzles. At S31, the conveyance controller 116 of the CPU 110 causes the conveyance roller 152 to convey the recording medium P by the predetermined conveyance amount L1.

At S32, the pattern forming unit 111 causes the recording head 6A to form the pairs of second marks M2*a* and M2*b* on the recording medium P, with the specified nozzles each disposed at the distance e forward and backward, respectively, from the reference nozzles (e.g., the nozzle 6A4) in the sub-scanning direction B. The reference nozzle is positioned at the distance L2 (ideal conveyance distance) from the nozzle used to form the first mark M1. As a result, the test pattern TP3 including a predetermined number of marks (the plurality of first marks M1 and the pairs of second marks M2*a* and M2*b*) and the reference frame F is formed.

Referring to FIG. 25B, at S33, the two-dimensional sensor 27 of the imaging unit 20 captures an image of the test pattern TP3 and the reference frame F formed at steps S30 and S32, and outputs the captured image of the test pattern TP.

At S34, the position detector 142 of the two-dimensional sensor CPU 140 analyzes the test pattern TP3 and the reference frame F in the image captured and output at S33 and determines whether or not the reference frame F is located inside the captured range.

When the captured range includes the reference frame F (Yes at S34), at S35, the position detector 142 identifies the reference frame F and determines whether or not the reference frame F surrounds the predetermined number of marks. When the number of the marks inside the reference frame F matches the predetermined number (Yes at S35), at S36, the position detector 142 locates and detects the first marks M1 and the pairs of second marks M2*a* and M2*b* based on the reference frame F in the captured image.

By contrast, when the captured range does not include the reference frame F (No at S34), or the reference frame F does not include the predetermined number of marks (No at S35), at S37 the position detector 142 determines that an error has occurred in the processing and ends the processing.

The processing starting from the ratio calculation performed by the ratio calculator 143 of the two-dimensional sensor CPU 140 to conveyance-related parameter adjustment performed by the adjusting unit 115 (steps S38 to S42) are similar to the processing performed in steps S15 to S19 in FIG. 21C of Embodiment 1. However, as described above, the deviation amount is calculated regarding each of the plurality of mark sets formed with different nozzles, and the mean value is obtained. Note that, although the reference frame F is formed together with the first marks M1 in FIG. 25C, alternatively, the reference frame F can be formed before the first and second marks M1, M2*a* , and M2*b* are formed. Yet alternatively, the reference frame F can be formed after formation of those marks and before capturing of those marks.

In the configuration in which the test pattern TP (or TP1 or TP2) and the reference frame F are formed together, since the reference frame F is identified from the image taken by the imaging unit 20, and the pair of second marks M2*a* and M2*b* and the first mark M1 are located based on the reference frame F, locating the test pattern TP in the captured image can be easy.

Embodiment 2

Although, in the image forming apparatus according to Embodiment 1, the two-dimensional sensor CPU mounted in the carriage performs the position detection of the test pattern in the captured image and the ratio calculation, alternatively, the main control board can perform the position detection and ratio calculation.

Figure 26:
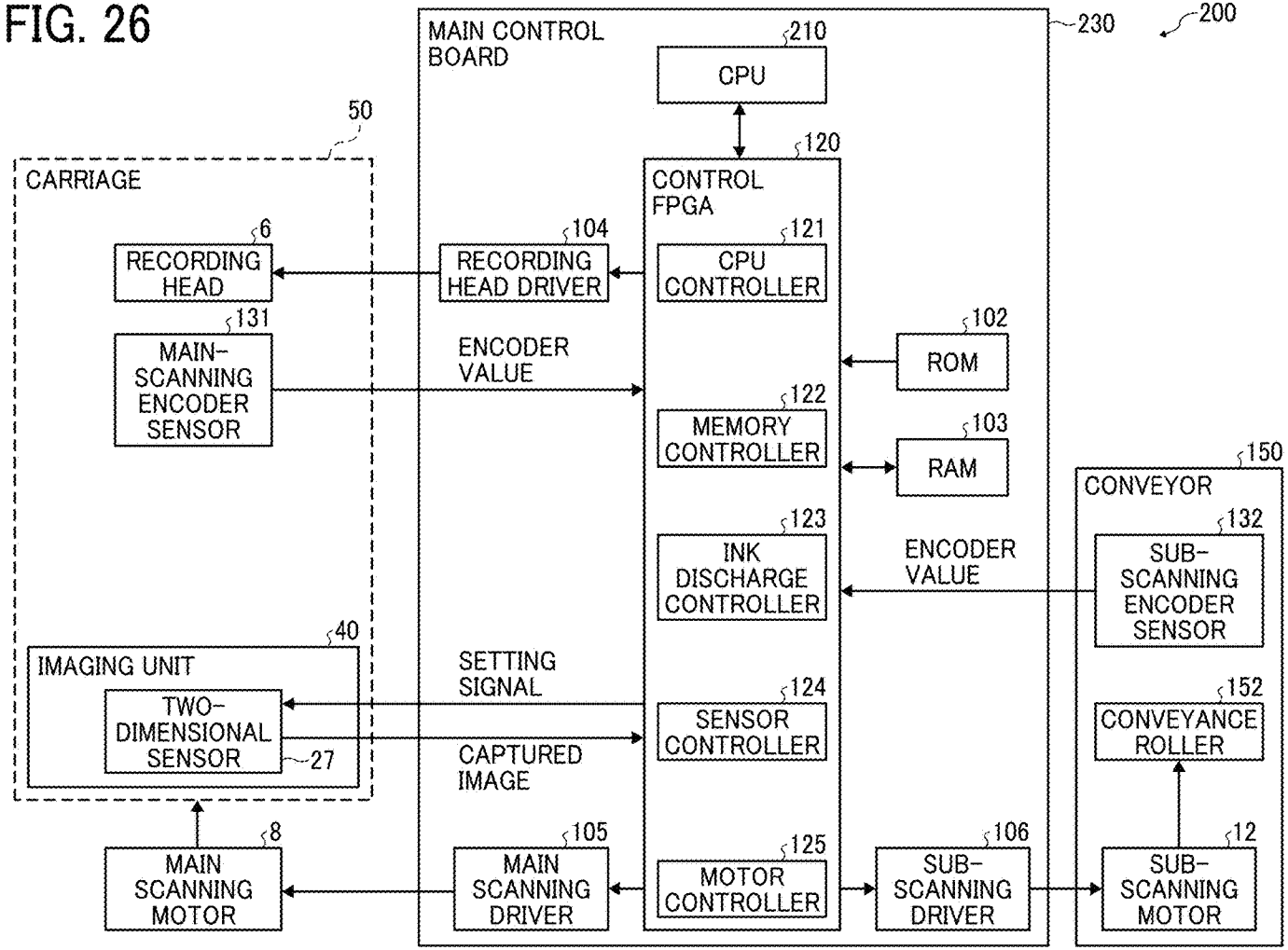
FIG. 26 is a block diagram of a hardware configuration of an image forming apparatus according to Embodiment 2.

A hardware configuration of an image forming apparatus 200 according to the present embodiment will be described referring to FIG. 26. FIG. 26 is a block diagram of the hardware configuration of the image forming apparatus according to Embodiment 2.

As illustrated in FIG. 26, the image forming apparatus 200 according to the present embodiment includes a central processing unit (CPU) 210, the read-only memory (ROM) 102, the random access memory (RAM) 103, the recording head driver 104, the main scanning driver 105, the sub-scanning driver 106, the control Field-Programmable Gate Array (FPGA) 120, the recording head 6, the main-scanning encoder sensor 131, an imaging unit 40, the main scanning motor 8, the conveyor 150, and the sub-scanning motor 12.

The CPU 210, the ROM 102, the RAM 103, the recording head driver 104, the main scanning driver 105, the sub-scanning driver 106, and the control FPGA 120 are mounted on a main control board 230. Meanwhile, the recording head 6, the main-scanning encoder sensor 131, and the imaging unit 40 are mounted on a carriage 50. In addition, the sub-scanning encoder sensor 132 and the conveyance roller 152 are mounted on the conveyor 150.

Configurations except the central processing unit (CPU) 210 and the imaging unit 40 are similar to those of Embodiment 1, and thus redundant descriptions are omitted.

Similar to Embodiment 1, the CPU 210 controls the entire image forming apparatus 200. In particular, the image forming apparatus 200 according to the present embodiment uses the CPU 210 to implement a function of forming the test pattern TP, a function as a distance measurement device, and a function of adjusting a parameter relating to the amount of conveyance of the recording medium P based on the distance.

The imaging unit 40 includes the two-dimensional sensor 27 and captures an image of the test pattern TP (see FIG. 15) on the recording medium P, controlled by the CPU 210.

The two-dimensional sensor 27 is, for example, a CCD sensor or a CMOS sensor as described above. The two-dimensional sensor 27 captures an image of the test pattern TP under predetermined operation conditions according to various setting signals transmitted via the control FPGA 120 from the CPU 210. Then, the two-dimensional sensor 27 transmits the captured image via the control FPGA 120 to the CPU 210.

Figure 27:
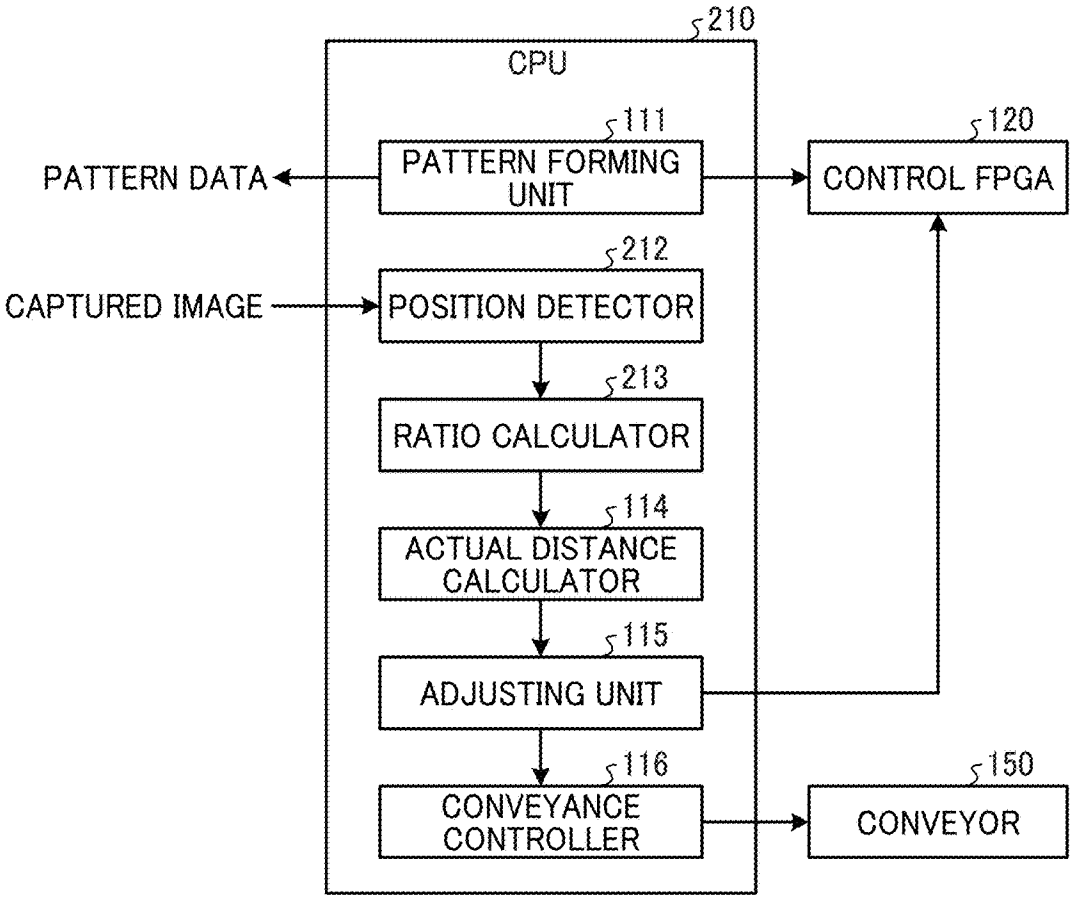
FIG. 27 is a block diagram of a functional configuration of the image forming apparatus according to Embodiment 2.

Referring to FIG. 27, characteristic functions implemented by the CPU 210 of the image forming apparatus 200 will be described. FIG. 27 is a block diagram of a functional configuration of the image forming apparatus according to Embodiment 2.

For example, the CPU 210 uses the RAM 103 as a work area to execute a control program stored on the ROM 102 in order to implement, the functions of the pattern forming unit 111, a position detector 212, a ratio calculator 213, the actual distance calculator 114, the adjusting unit 115, the conveyance controller 116, and the like.

Functions of the pattern forming unit 111, the actual distance calculator 114, the adjusting unit 115, and the conveyance controller 116 are similar to those of Embodiment 1, and thus redundant descriptions are omitted.

Although functions of the position detector 212 and the ratio calculator 213 are similar to those of the position detector 142 and the ratio calculator 143 of Embodiment 1, the position detector 212 and the ratio calculator 213 are implement in the CPU 210, differently from Embodiment 1.

In the image forming apparatus 200 according to Embodiment 2, the sequence of actions relating to conveyance amount at the image formation position is similar to that in Embodiment 1 (see FIGS. 21A to 21C), and thus redundant descriptions are omitted.

Thus, in the image forming apparatus 200 according to the present embodiment, the CPU 210 of the main control board 230 performs all of the functions including the position detector 212 and the ratio calculator 213. This configuration attains the effects similar to those attained by the image forming apparatus 100 according to Embodiment 1.

Embodiment 3

The image forming apparatus according to Embodiment 1 is configured to detect the deviation of landing position of ink based on the amount of conveyance of the recording medium and enable adjustment of the conveyance-related parameter. The image forming apparatus according to Embodiment 3 is configured to further calculate an inclination of the recording head and adjust the inclination of the recording head.

The hardware configuration of the image forming apparatus 100 according to the present embodiment is similar to that of Embodiment 1, illustrated in FIG. 13. In the present embodiment, the CPU 110 is further configured to calculate the amount of inclination (i.e., inclination angle) of the recording head 6. Those functions will be described in detail later.

[Functional Configuration of Image Forming Apparatus]

Figure 28:
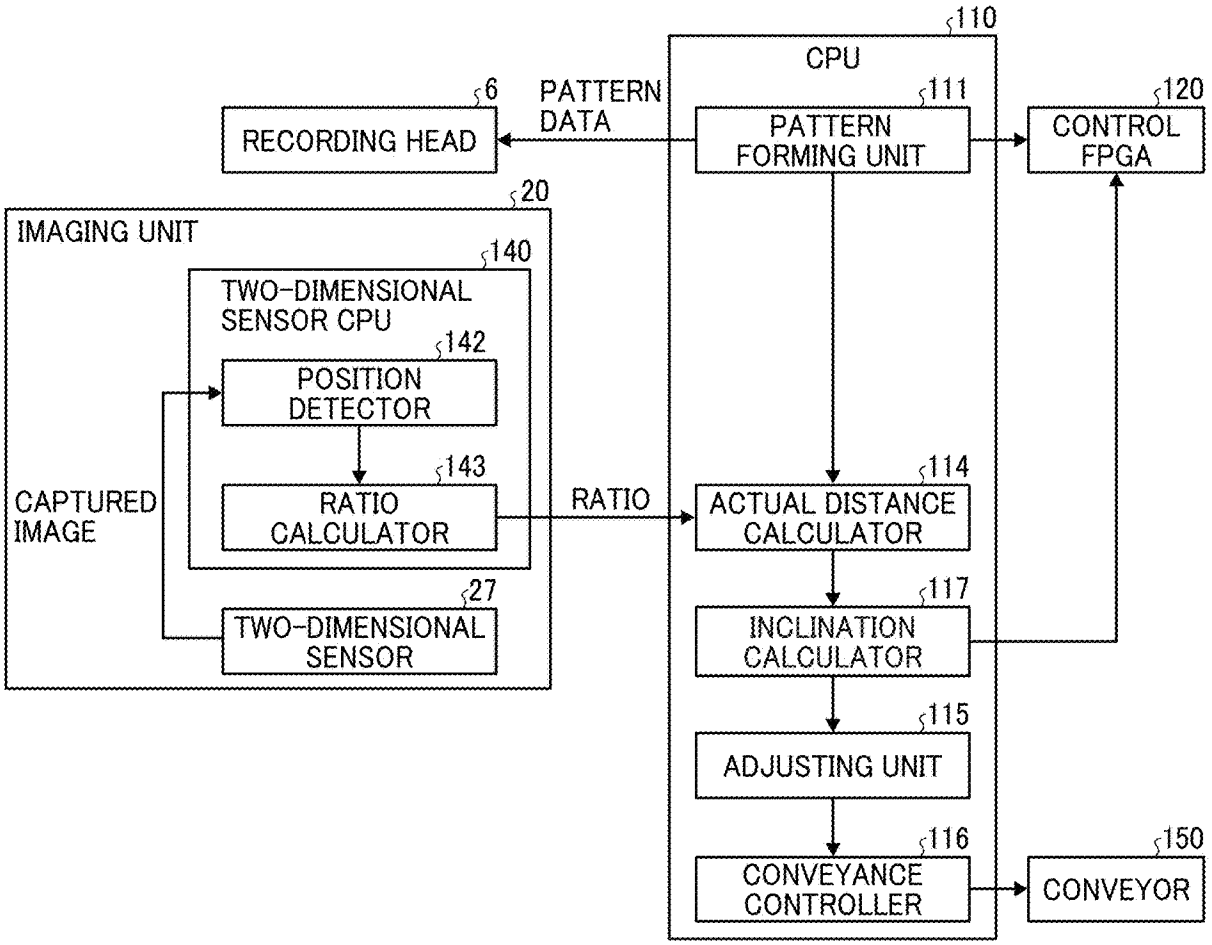
FIG. 28 is a block diagram of a functional configuration of an image forming apparatus according to Embodiment 3.

Referring to FIG. 28, characteristic functions implemented by the CPU 110 of the image forming apparatus 100 will be described.

For example, the CPU 110 uses the RAM 103 as a work area to execute a control program stored on the ROM 102 in order to implement, for example, the functions of the pattern forming unit 111, the actual distance calculator 114, the adjusting unit 115, the conveyance controller 116, and an inclination calculator 117.

Functions of the actual distance calculator 114 and the conveyance controller 116 are similar to those of Embodiment 1, and thus redundant descriptions are omitted.

Figure 29A:
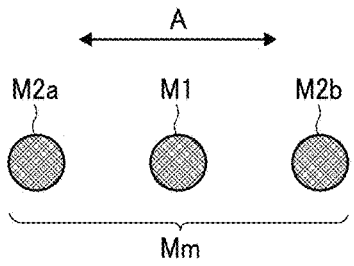
FIGS. 29A and 29B illustrate an example of a test pattern on a recording medium, according to Embodiment 3.
Figure 29B:
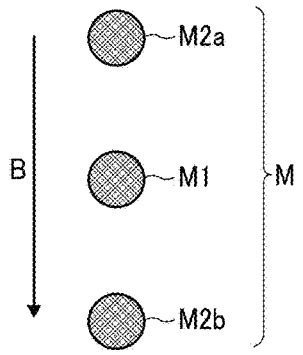

In Embodiment 3, first and second test patterns are used. FIGS. 29A and 29B illustrate an example of the first and second on a recording medium. As illustrated in FIGS. 29A and 29B, each of the first and second test patterns is at least one set of marks, and each set includes, at least, the first mark M1 and the pair of second marks M2*a* and M2*b*. In the present embodiment, a mark set Mm including marks arranged in the main scanning direction A, illustrated in FIG. 29A, and the mark set M including marks arranged in the sub-scanning direction B, illustrated in FIG. 29B, are used.

The mark set Mm illustrated in FIG. 29A is an example of a first test pattern. In the mark set Mm, the first mark M1 is disposed between the second marks M2*a* and M2*b* in the main scanning direction A. The first mark M1 and the pair of second marks M2*a* and M2*b* are formed as dots and lined up in the main scanning direction A, in which the carriage 5 moves. The mark set Mm is used to detect the amount of deviation of ink landing position in the main scanning direction A.

Figure 31A:
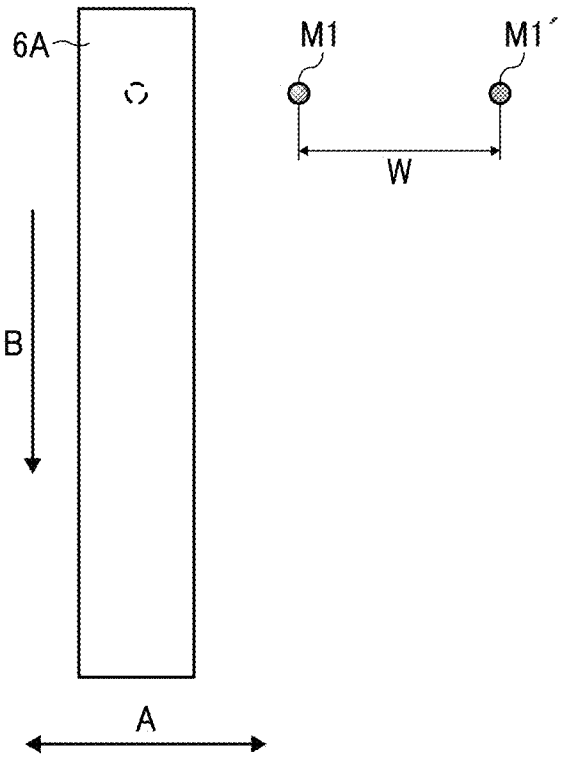
FIGS. 31A and 31B illustrate a method of forming the test pattern illustrated in FIG. 29B.
Figure 31B:
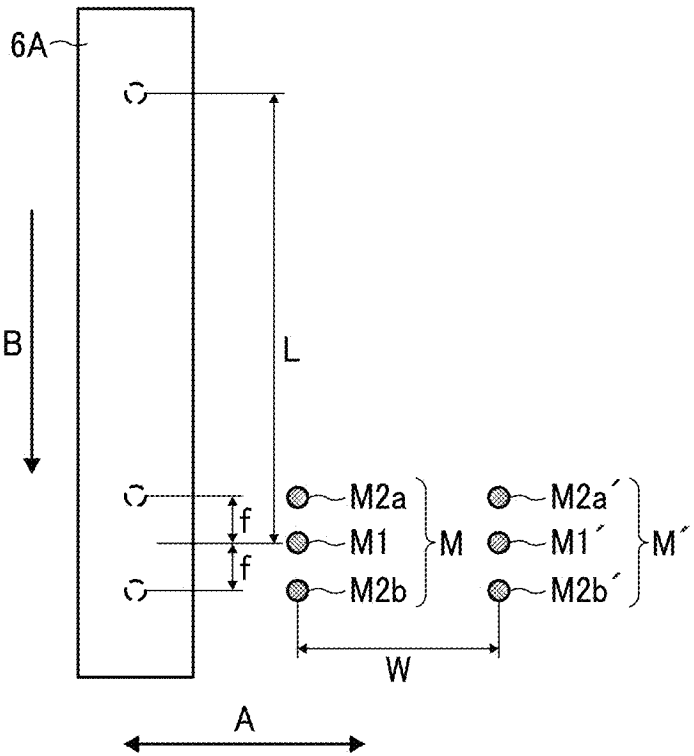

In the mark set M illustrated in FIG. 29B, the first mark M1 is disposed between the second marks M2*a* and M2*b* in the sub-scanning direction B. The first mark M1 and the pair of second marks M2*a* and M2*b* are formed as dots and lined up in the sub-scanning direction B, in which the recording medium P is conveyed. The mark set M is used to detect the amount of deviation in the sub-scanning direction B. Referring to FIG. 31B, an example of the second test pattern includes the mark set M illustrated in FIG. 29B and a mark set M' similar thereto, arranged in the main scanning direction A.

Figure 30A:
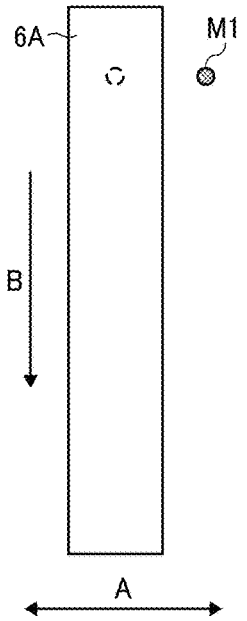
FIGS. 30A, 30B, and 30C illustrate a method of forming the test pattern illustrated in FIG. 29A.
Figure 30B:
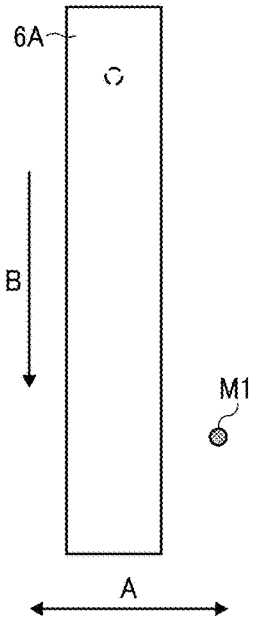
Figure 30C:
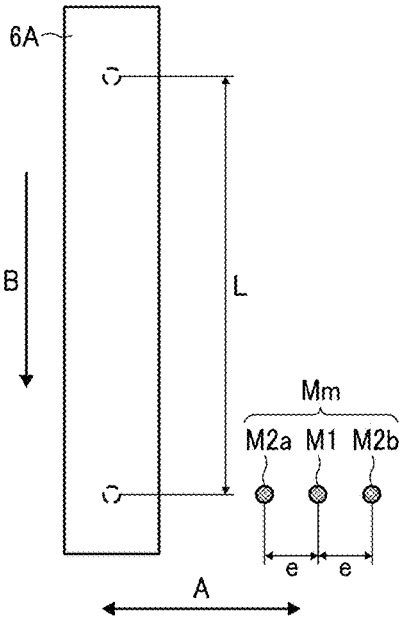

A method for forming the first test pattern (the mark set Mm) illustrated in FIG. 29A will be described, with reference to FIGS. 30A, 30B, and 30C. Initially, as illustrated in FIG. 30A, the pattern forming unit 111 causes the recording head 6A to form, with an upstream nozzle in the sub-scanning direction B, the first mark M1 on the recording medium P. Subsequently, as illustrated in FIG. 30B, the conveyance controller 116 controls the conveyance roller 152 to convey the recording medium P by the predetermined distance L in the sub-scanning direction B. The amount by which the recording medium P is conveyed at that time is referred to as the conveyance mount L1 (i.e., the actual conveyance amount L1). After the recording medium P is conveyed by the conveyance amount L1, as illustrated in FIG. 30C, the pattern forming unit 111 causes the recording head 6A to form the second marks M2*a* and M2*b* with a nozzle on the downstream side in the sub-scanning direction B.

The nozzle (specified nozzle) to form the second marks M2*a* and M2*b* is positioned in the nozzle line including the upstream nozzle (the first mark nozzle) to form the first mark M1 and at the predetermined distance L from the upstream nozzle. With the downstream nozzle (the specified nozzle), the second marks M2*a* and M2*b* are formed at positions equally away (by a distance e) from the first mark M1 on both sides in the main scanning direction A.

Accordingly, when the recording head 6A is not tilted and there is neither skew of the recording medium P nor error in the amount of conveyance thereof, the first mark M1 is located at a midpoint between the second marks M2*a* and M2*b* in the first test pattern. By contrast, when the recording head 6A is tilted or there is skew of the recording medium P or error in the amount of conveyance thereof, the first mark M1 is located between the second marks M2*a* and M2*b* but closer to one of the second marks M2*a* and M2*b* . Then, the imaging unit 20 captures an image of the test pattern and the two-dimensional sensor CPU 140 calculates the position of the first mark M1 relative to the pair of second marks M2*a* and M2*b* to obtain the amount of deviation in the main scanning direction A.

A method for forming the second test pattern illustrated in FIG. 29B will be described, with reference to FIGS. 31A and 31B. In the method illustrated in FIGS. 31A and 31B, two mark sets M (see FIG. 29B) and M' are arranged in the main scanning direction indicated by arrow A. Initially, as illustrated in FIG. 31A, the pattern forming unit 111 causes the recording head 6A to form, with the upstream nozzle in the sub-scanning direction B, the first mark M1 on the recording medium P and a first mark M1' at a distance W from the first mark M1 in the main scanning direction. Subsequently, the conveyance controller 116 controls the conveyance roller 152 to convey the recording medium P by the distance L in the sub-scanning direction B. The distance by which the recording medium P is actually conveyed is referred to as the conveyance amount L1 (i.e., the actual conveyance amount L1).

After the recording medium P is conveyed by the conveyance amount L1, as illustrated in FIG. 31B, the pattern forming unit 111 causes the recording head 6A to form the second marks M2*a* , M2*b*, M2*a*', and M2*b*' with two nozzles on the downstream side in the sub-scanning direction B. The pair of second marks M2*a* and M2*b* are formed with the two nozzles (i.e., second mark nozzles), which are equally away in the sub-scanning direction B from the reference nozzle positioned at the distance L from the first mark nozzle. Similarly, the second marks M2*a*' and M2*b*' are formed with the two second mark nozzles.

The pair of second marks M2*a* and M2*b* and the pair of second marks M2*a*' and M2*b*' are formed at positions at a distance W from each other in the main scanning direction A. The two second mark nozzles each of which is disposed at the distance f from the reference nozzle in the sub-scanning direction B are referred to as "specified nozzles". The distance L from the upstream nozzle to the downstream nozzle is equivalent to an ideal distance of the actual conveyance amount L1.

Accordingly, when the conveyance amount L1 is identical to the ideal distance (the distance L) or the recording head 6A is not tilted and there is no skew of the recording medium P or an error in the amount of conveyance thereof, the first mark M1 is located at the midpoint between the second marks M2*a* and M2*b* and the first mark M1' is located at the midpoint between the second marks M2*a*' and M2*b*' in the sub-scanning direction B. By contrast, when the conveyance amount L1 differs from the ideal distance (the distance L) or the recording head 6A is tilted or there is skew of the recording medium P or error in the amount of conveyance thereof, the first mark M1 is located between the second marks M2*a* and M2*b* but closer to one of the second marks M2*a* and M2*b*. Similarly, the first mark M1' is located between the second marks M2*a*' and M2*b*' but closer to one of the second marks M2*a*' and M2*b*'. Then, the imaging unit 20 captures an image of the second test pattern and the two-dimensional sensor CPU 140 calculates the respective positions of the first marks M1 and M1' relative to the pair of second marks M2*a* and M2*b* and the pair of second marks M2*a*' and M2*b*' to obtain the amount of deviation in the sub-scanning direction B.

Note that, in forming the mark set Mm illustrated in FIGS. 30A to 30C, the position of the first mark M1 relative to the second marks M2*a* and M2*b* is not limited, but can be set freely, as long as the first mark M1 is formed before the recording medium P is conveyed by the predetermined conveyance amount L1 and the second marks M2*a* and M2*b* are formed after the recording medium P is conveyed by the predetermined conveyance amount L1. In addition, the position and timing to form each of the first mark M1 and the pair of second marks M2*a* and M2*b* of the test pattern are indicated in the pattern data described above. According to the timing mentioned here, the mark is formed in either the forward movement of the carriage 5 or the backward movement of the carriage 5. This applies to formation of the second test pattern illustrated in FIGS. 31A and 31B.

Referring back to FIG. 28, the position detector 142 of the two-dimensional sensor CPU 140 processes the image captured by the imaging unit 20 in a predetermined process such as binarization process to detect the test pattern. Specifically, from the captured image of the first test pattern (mark set Mm) illustrated in FIG. 30C, the position detector 142 detects the first mark M1 and the pair of second marks M2*a* and M2*b*. Additionally, from the captured image of the second test pattern (mark sets M and M') illustrated in FIG. 31B, the position detector 142 detects the first marks M1 and M1' and the second marks M2*a*, M2*b*, M2*a*', and M2*b*'.

The ratio calculator 143 of the two-dimensional sensor CPU 140 calculates the ratio (i.e., a first ratio) between the distance between the second marks M2*a* and M2*b* and the amount of deviation of the first mark M1 in the captured image based on the positions of the first mark M1 and the pair of second marks M2*a* and M2*b* in the captured image of the first and second test patterns illustrated in FIGS. 30C and 31B. Similarly, the ratio calculator 143 calculates the ratio of the deviation of the first mark M1' relative to the distance between the second marks M2*a*' and M2*b*' in the captured image of the mark set M' illustrated in FIG. 31B.

The calculation of the ratios in the second test pattern formed as illustrated in FIGS. 31A and 31B is similar to the calculation according to Embodiment 1 (see FIGS. 17, 18, 19, and 20), and thus redundant descriptions are omitted. The calculation of the ratio in the first test pattern formed as illustrated in FIGS. 30A to 30C is similar to the calculation according to Embodiment 1. The ratio calculator 143 transmits the calculated ratios to the actual distance calculator 114.

Referring back to FIG. 28, regarding the first and second test patterns illustrated in FIGS. 30C and 31B, the actual distance calculator 114 of the CPU 110 multiplies the theoretical distance between the second marks M2*a* and M2*b* by the ratio calculated with the ratio calculator 143, thereby calculating the actual distance of the deviation amount s of the first mark M1 relative to the pair of second marks M2*a* and M2*b*. In the first test pattern illustrated in FIG. 29A and FIG. 30C, the theoretical distance between the second marks M2*a* and M2*b* is the distance by which the carriage 5 moves from formation of one of the second marks M2*a* and M2*b* to formation of the other. In the test pattern illustrated in FIG. 29B and FIG. 30B, the theoretical distance between the second marks M2*a* and M2*b* is the distance between the two nozzles used to form the second marks M2*a* and M2*b*.

The actual distance calculator 114 transmits the calculated actual distance to the inclination calculator 117. Similarly, the actual distance calculator 114 calculates the actual distance of the deviation amount s of the first mark M1' relative to the second marks M2*a*' and M2*b*' of the mark set M' illustrated in FIG. 31B. Thus, from the first test pattern (the mark set Mm) illustrated in FIG. 30C, the actual distance calculator 114 calculates the actual distance of the deviation amount s in the main scanning direction A derived from at least one of the inclination of the recording head 6A and the inclination of the recording medium P. From the second test pattern (mark sets M and M') illustrated in FIG. 31B, the actual distance calculator 114 calculates the actual amounts of the two deviation amounts s in the sub-scanning direction B.

The inclination calculator 117 of the CPU 110 calculates the amount (angle) of inclination based on the actual distance of deviation calculated by the actual distance calculator 114.

Figure 32:
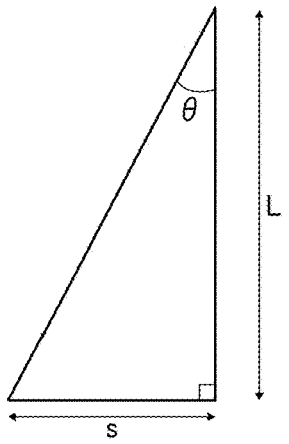
FIG. 32 illustrates a method of calculating an inclination in formation of the test pattern illustrated in FIGS. 30A, 30B, and 30C.

For example, the amount of inclination based on the mark set Mm illustrated in FIG. 30C is calculated as follows. FIG. 32 illustrates a method of calculating the amount of inclination based on the first test pattern (the mark set Mm), illustrated in FIG. 30C. Referring to FIGS. 30A to 30C and 32, the inclination calculator 117 calculates a total inclination angle θ (total inclination amount) based on the actual distance of the deviation in the main scanning direction A calculated by the actual distance calculator 114 and the distance L between the upstream nozzle to form the first mark M1 and the downstream nozzle to form the pair of second marks M2*a* and M2*b*. The total inclination angle θ includes, in addition to the angle of inclination of the recording head 6A (i.e., head inclination angle), the angle of skew (inclination) of the recording medium P and the effect of error in the amount of conveyance of the recording medium P. Accordingly, the angle of skew of the recording medium P is calculated using the first and second test patterns illustrated in FIGS. 29A and 29B.

Figure 33:
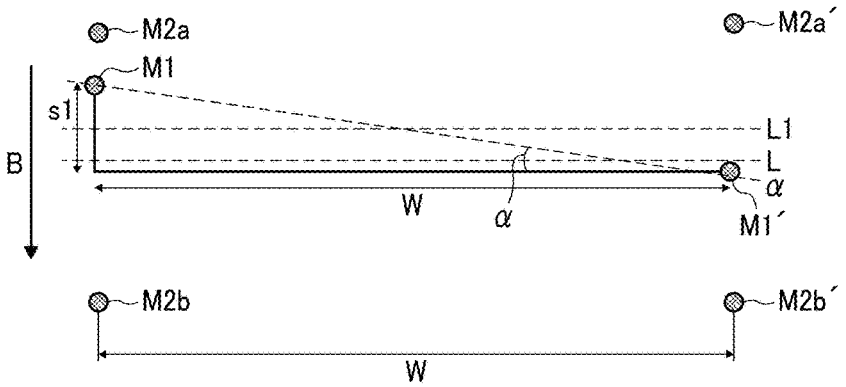
FIG. 33 illustrates a method of calculating an inclination in formation of the test pattern illustrated in FIGS. 31A and 31B.

Next, calculation of the angle of inclination of the recording medium P based on the second test pattern (the mark sets M and M') illustrated in FIG. 31BC is described, with reference to FIG. 33. Referring to FIGS. 31A, 31B, and 33, the inclination calculator 117 calculates a skew angle α (an example of inclination of the recording medium) of the recording medium P, based on a difference s1 between the deviation amounts of the first marks M1 and M1' (relative to the pair of second marks M2*a* and M2*b* and pair of second marks M2*a*' and M2*b*', respectively) and the distance W between the first marks M1 and M1'. The skew angle α represents an angle of inclination when the recording medium P is obliquely conveyed due to defective conveyance.

Figure 34:
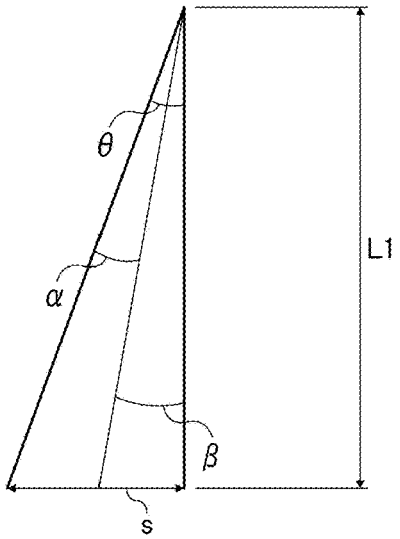
FIG. 34 is a diagram of calculation of a head inclination angle according to Embodiment 3.

The inclination calculator 117 calculates the angle of inclination of the recording head 6A (a head inclination angle β in FIG. 34) based on the total inclination angle θ and the skew angle α of the recording medium P calculated, for example, based on the test pattern illustrated in FIGS. 30C and 31B. FIG. 34 is a diagram of calculation of the head inclination angle β. As illustrated in FIG. 34, the inclination calculator 117 calculates the head inclination angle β, which represents the angle of inclination of the recording head 6A, as the difference between the total inclination angle θ and the skew angle α. That is, the inclination calculator 117 deducts the skew angle α from the total inclination angle θ, thereby calculating the head inclination angle β.

The actual distance calculator 114 calculates the amount of deviation derived from only the inclination of the recording head 6A, based on the head inclination angle β and the conveyance amount L1.

The adjusting unit 115 of the CPU 110 adjusts the inclination of the recording head 6A in accordance with the amount of deviation based on the inclination of the recording head 6A, calculated by the actual distance calculator 114. Although the adjusting unit 115 adjusts the inclination of the recording head 6A in this example, in another embodiment, an operator or service person manually adjusts the recording head 6A.

[Operation of Image Forming Apparatus]

Figure 35A:
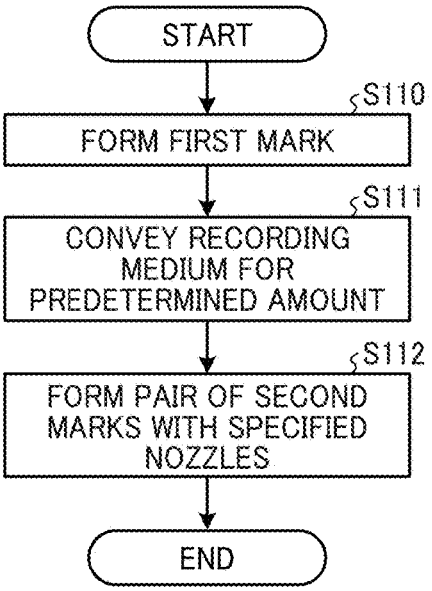
FIGS. 35A, 35B, and 35C are flowcharts of calculation of total inclination angle in the image forming apparatus according to Embodiment 3.
Figure 35B:
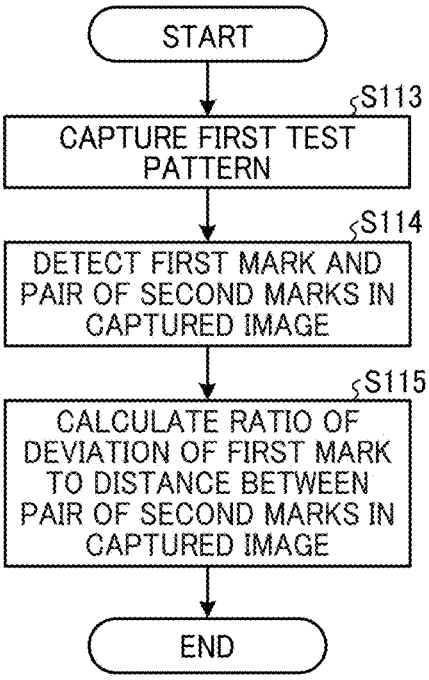
Figure 35C:
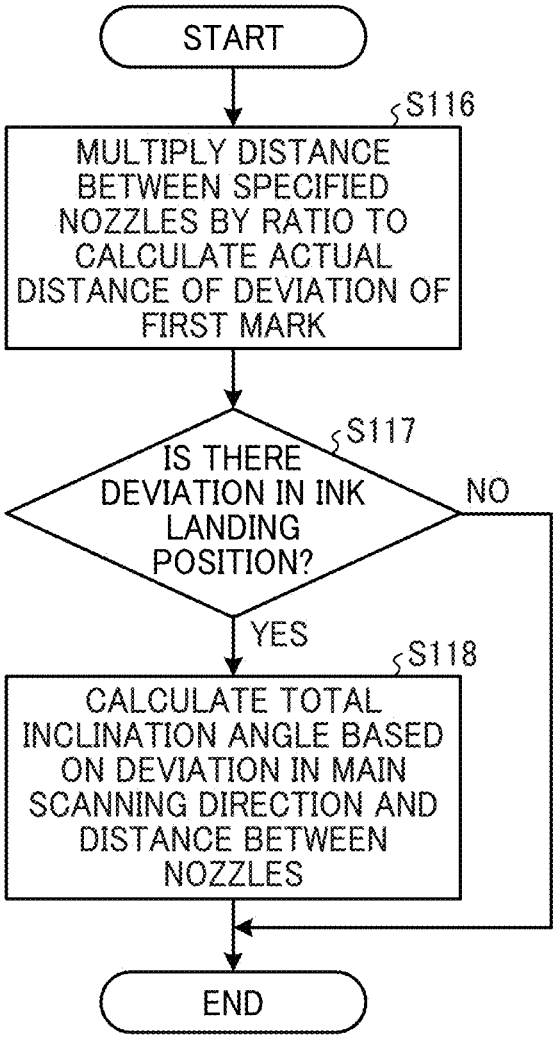
Figure 36A:
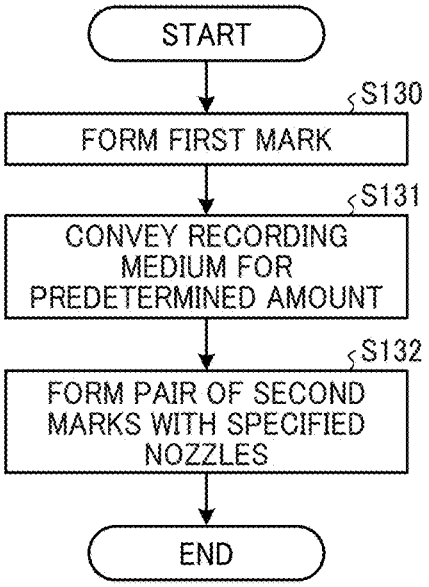
FIGS. 36A, 36B, and 36C are flowcharts of calculation of deviation amount derived from the inclination of the recording head in the image forming apparatus according to Embodiment 3.
Figure 36B:
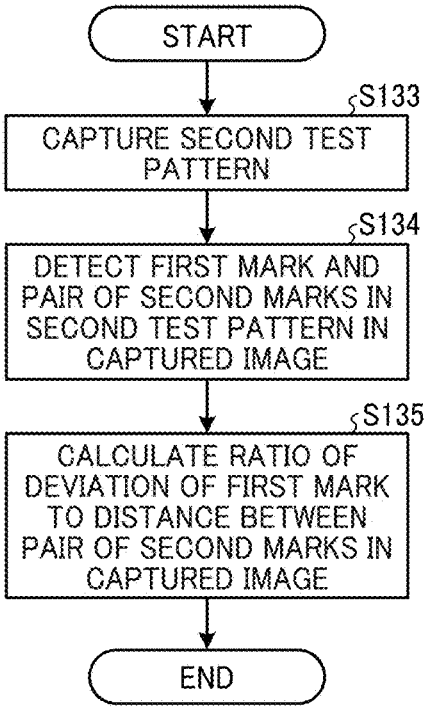
Figure 36C:
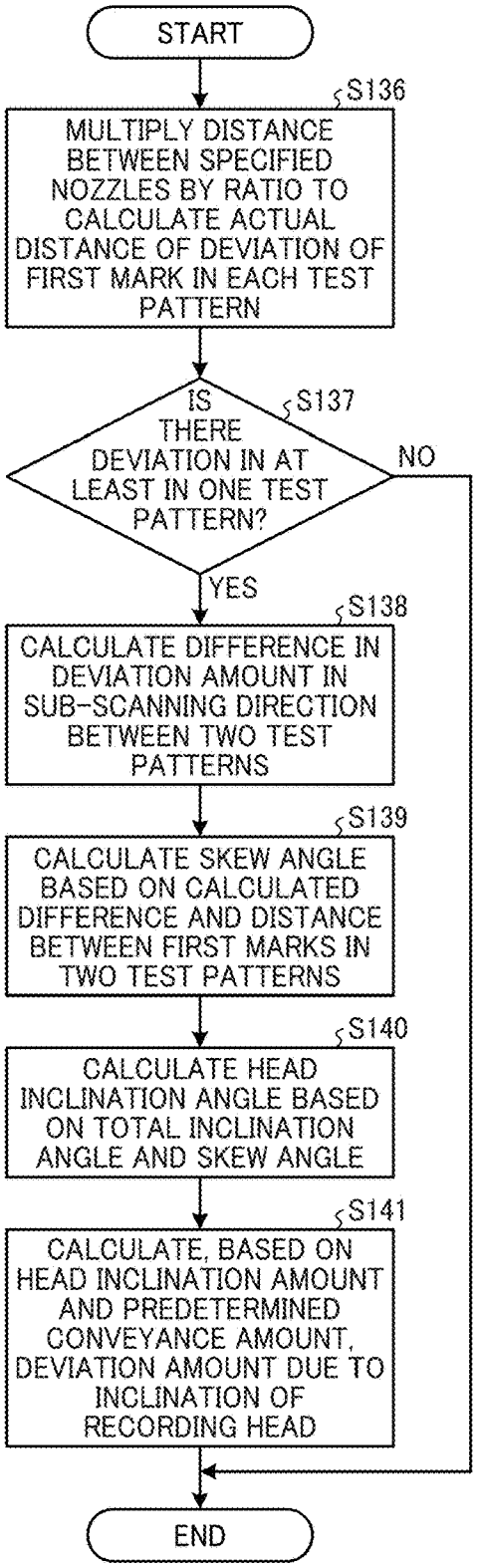

Referring to FIGS. 35A to 36C, descriptions are given of a procedure of calculation of the amount of deviation derived from the inclination of the recording head 6A in the image forming apparatus 100. To calculate the amount of deviation derived from the inclination of the recording head 6A, the inclination calculator 117 calculates the total inclination angle θ based on the mark set Mm illustrated in FIG. 30C and calculates the skew angle α of the recording medium P based on the mark sets M and M' illustrated in FIG. 31. The inclination calculator 117 deducts the skew angle α from the total inclination angle θ, thereby calculating the head inclination angle β (inclination of the recording head 6A). Then, the actual distance calculator 114 calculates the amount of deviation due to the inclination of the recording head 6A, based on the head inclination angle β. FIGS. 35A, 35B, and 35C are flowcharts of calculation of total inclination angle θ in the image forming apparatus 100 according to Embodiment 3. FIGS. 36A, 36B, and 36C are flowcharts of calculation of amount of deviation derived from the inclination of the recording head 6, in the image forming apparatus 100 according to Embodiment 3.

Referring to FIG. 35A, when the recording medium P is set on the platen 16, at S110, the pattern forming unit 111 of the CPU 110 forms, with the upstream nozzle of the recording head 6A, the first mark M1 on the recording medium P. At S111, the conveyance controller 116 of the causes the conveyance roller 152 to convey the recording medium P by the predetermined conveyance amount L1.

At S112, the pattern forming unit 111 causes the recording head 6A to form the pair of second marks M2*a* and M2*b* using the specified nozzles positioned at the distance L from the first mark nozzle in the sub-scanning direction B. The second marks M2*a* and M2*b* are formed at the positions at the distances e forward and backward from the first mark M1 in the main scanning direction A. As a result, the mark set Mm, serving as the first test pattern, that includes the first mark M1 and the pair of second marks M2*a* and M2*b* is formed (see FIGS. 30A to 30C).

Referring to FIG. 35B, at S113, the two-dimensional sensor 27 of the imaging unit 20 captures an image of the first test pattern (the mark set Mm) formed at steps S110 and S112, and outputs the captured image thereof. At S114, the position detector 142 of the two-dimensional sensor CPU 140 detects the position of each of the pair of second marks M2*a* and M2*b* and the first mark M1 in the captured image.

At S115, the ratio calculator 143 of the two-dimensional sensor CPU 140 calculates the ratio between the distance between the pair of second marks M2*a* and M2*b* and the amount of deviation of the first mark M1 in the captured image, using the detected positions of the first mark M1 and the pair of second marks M2*a* and M2*b* in the captured image.

Referring to FIG. 35C, at S116, the actual distance calculator 114 of the CPU 110 multiplies, by the ratio, the actual distance between the second marks M2*a* and M2*b* (the distance between the nozzles to form the second marks M2*a* and M2*b*), using the pattern data used to form the first test pattern at steps S110 and S112 and the ratio calculated at step S115, to calculate the actual distance of deviation of the first mark M1.

At S117, the inclination calculator 117 of the CPU 110 determines, based on the actual distance of deviation of the first mark M1 calculated at step S116, whether the landing position of ink has deviated. When the adjusting unit 115 determines that the landing position of ink has not deviated (No at S117), a sequence of operations is completed.

By contrast, when the adjusting unit 115 determines that the landing position of ink has deviated (Yes at S117), at S118, the inclination calculator 117 calculates the total inclination angle θ based on the calculated deviation amount s in the main scanning direction A and the distance L between the upstream nozzle to form the first mark M1 and the downstream nozzle to form the pair of second marks M2*a* and M2*b*.

The operation illustrated in FIGS. 36A to 36C is described. Referring to FIG. 36A, when the recording medium P is set on the platen 16, at S130, the pattern forming unit 111 of the CPU 110 causes the recording head 6A to form the first marks M1 and M1' with the upstream nozzle on the recording medium P. Specifically, the pattern forming unit 111 causes the recording head 6A to form the first mark M1' at the distance W from the first mark M1 in the main scanning direction A. That is, the carriage 5 moves by the distance W after formation of the first mark M1 before formation of the first mark M1'. At S131, the conveyance controller 116 of the causes the conveyance roller 152 to convey the recording medium P by the predetermined conveyance amount L1.

At S132, the pattern forming unit 111 causes the recording head 6A to form the second marks M2*a*, M2*b*, M2*a*', and M2*b*' on the recording medium P, with the specified nozzles positioned at the distances f forward and backward from the reference nozzle in the sub-scanning direction B. The reference nozzle is at the distance L from the upstream nozzle (with which the first mark M1 has been formed) in the sub-scanning direction B. Specifically, the pattern forming unit 111 causes the recording head 6A to form the pair of second marks M2*a*' and M2*b*' at the distance W from the pair of second marks M2*a* and M2*b* in the main scanning direction A. As a result, the two mark sets M and M' including the first marks M1 and M1' and the second marks M2*a*, M2*b*, M2*a*', and M2*b*' are formed (see FIGS. 31A and 31B).

Referring to FIG. 36B, at S133, the two-dimensional sensor 27 of the imaging unit 20 captures the two mark sets M and M' formed at steps S130 and S132, and outputs the captured image of the mark sets M and M'. At S134, the position detector 142 of the two-dimensional sensor CPU 140 detects the positions of the second marks M2*a*, M2*b*, M2*a*', and M2*b*' and the first marks M1 and M1' in the captured image.

At S135, the ratio calculator 143 of the two-dimensional sensor CPU 140 calculates the ratio between the distance between the second marks M2*a* and M2*b* and the amount of deviation of the first mark M1 in the captured image, using the detected positions of the first mark M1 and the pair of second marks M2*a* and M2*b* in the captured image. Similarly, at S135, the ratio calculator 143 calculates the ratio between the distance between the second marks M2*a*' and M2*b*' and the amount of deviation of the first mark M1' in the captured image, using the detected positions of the first mark M1' and the pair of second marks M2*a*' and M2*b*' in the captured image.

Referring to FIG. 36C, at S136, the actual distance calculator 114 of the CPU 110 multiplies, by the ratio, the distance (2×f, see FIG. 31) between the nozzles used to form the second marks M2*a* and M2*b* (i.e., an actual distance between the second marks M2*a* and M2*b* ), using the pattern data used to form the mark sets M and M' at steps S130 and S132 and the ratio calculated at step S135, to calculate the actual distance of deviation of the first mark M1. Similarly, at S136, the actual distance calculator 114 multiplies, by the ratio, the actual distance between the second marks M2*a*' and M2*b*' (distance between the nozzles used to form the second marks M2*a*' and M2*b*'), using the pattern data and the ratio calculated at step S135, to calculate the actual distance of deviation of the first mark M1'.

At S137, the actual distance calculator 114 of the CPU 110 determines, based on the actual distance of deviation of each of the first marks M1 and M1', calculated at step S136, whether the landing position of ink has deviated in at least one of the mark sets M and M'. When the CPU 110 determines that the landing position of ink has not deviated in the mark sets M and M' (No at S137), a sequence of operations is completed.

By contrast, when the CPU 110 determines that the landing position of ink has deviated in at least one of the mark sets M and M' (Yes at S137), the inclination calculator 117 calculates the difference between the amount of deviation in the mark set M and that in the mark set M' in the sub-scanning direction B, calculated at S136. In other words, at S138, the inclination calculator 117 calculates the difference s1 between the deviation amount of the first mark M1 relative to the pair of second marks M2*a* and M2*b* and the deviation amount of the first mark M1' relative to the pair of second marks M2*a*' and M2*b*'.

The inclination calculator 117 calculates the skew angle α based on the difference s1 between the deviation amounts of the first marks M1 and M1' in the sub-scanning direction B and the distance W between the first marks M1 and M1' of the mark sets M and M'. That is, at S139, the inclination calculator 117 calculates the skew angle α derived from the inclination of the recording medium P, based on the difference s1 (between the deviation amount of the first mark M1 relative to the pair of second marks M2*a* and M2*b* and the deviation amount of the first mark M1' relative to the pair of second marks M2*a*' and M2*b*') and the distance W between the first marks M1 and M1'.

At S140, the inclination calculator 117 calculates the head inclination angle β based on the difference between the total inclination angle θ and the skew angle α. That is, the inclination calculator 117 deducts the skew angle α from the total inclination angle θ, thereby calculating the head inclination angle β. At S141, The actual distance calculator 114 calculates the amount of deviation due to the inclination of the recording head 6A, based on the head inclination angle β and the conveyance amount L1. Then, a sequence of operation completes.

Based on the amount of deviation derived from inclination of the recording head 6A, calculated in the flow described above, the adjusting unit 115 adjusts the inclination of the recording head 6A. Alternatively, the operator manually adjusts the inclination of the recording head 6A. Although the skew angle α is calculated after the total inclination angle θ is calculated in the flowcharts illustrated in FIGS. 35A to 36C, these calculations can be made in parallel.

As described above, to form each of the first and second test patterns, the image forming apparatus 100 according to Embodiment 3 forms the first mark M1, conveys the recording medium P by the predetermined amount (the conveyance amount L1), and then forms the pair of second marks M2*a* and M2*b*. Then, the image forming apparatus 100 captures images of the first and second test patterns with the imaging unit 20. Next, the image forming apparatus 100 detects the position of each of the pair of second marks M2*a* and M2*b* and the first mark M1 in the captured image. Then, the image forming apparatus 100 calculates the ratio between the distance between the second marks M2*a* and M2*b* in the captured image and the amount of deviation of the first mark M1 in the captured image. The image forming apparatus 100 then multiplies the actual distance between the second marks M2*a* and M2*b* by the ratio to calculate the actual distance of deviation of the first mark M1.

Additionally, based on the first test pattern (the mark set Mm) formed by the recording head 6A, the image forming apparatus 100 calculates the amount of deviation of the first mark M1 in the main scanning direction A relative to the pair of second marks M2*a* and M2*b*. The image forming apparatus 100 then calculates, based on the amount of deviation, the total inclination angle θ derived from the inclination of the recording head 6A and the inclination of the recording medium P. Further, based on the second test pattern (the mark sets M and M') formed by the recording head 6A, the image forming apparatus 100 calculates the amount of deviation of the first mark M1 (or M1') in the sub-scanning direction B relative to the second marks M2*a* and M2*b* (or M2*a*' and M2*b*') in each of the mark sets M and M'. The image forming apparatus 100 then calculates the skew angle α (the amount of inclination of the recording medium P) based on the differences between the two deviation amounts and the distance W between the two mark sets M and M'. By deducting the skew angle α from the total inclination angle θ, the head inclination angle β representing the inclination of the recording head 6A is calculated. Further, based on the head inclination angle β, the amount of deviation derived from only the inclination of the recording head 6A is calculated. With this operation, the adjusting unit 115 or the operator can adjust the inclination of the recording head 6A based on the amount of deviation derived from the inclination of the recording head 6A.

Therefore, according to Embodiment 3, even if the distance between the imaging unit 20 and the first test pattern or the second test pattern varies, the image forming apparatus 100 can calculate the actual distance of deviation of the landing position of ink based on the captured image of the test pattern. Then, the adjusting unit 115 or the operator can adjust the inclination of the recording head 6 in accordance with the amount of deviation, thereby improving the image quality.

[Modification of Test Pattern]

The first and second test patterns used in the present embodiment is not limited to the example illustrated in FIGS. 30A to 31B, and can be variously modified. A modification of the first and second test patterns will be described below.

Figure 37:
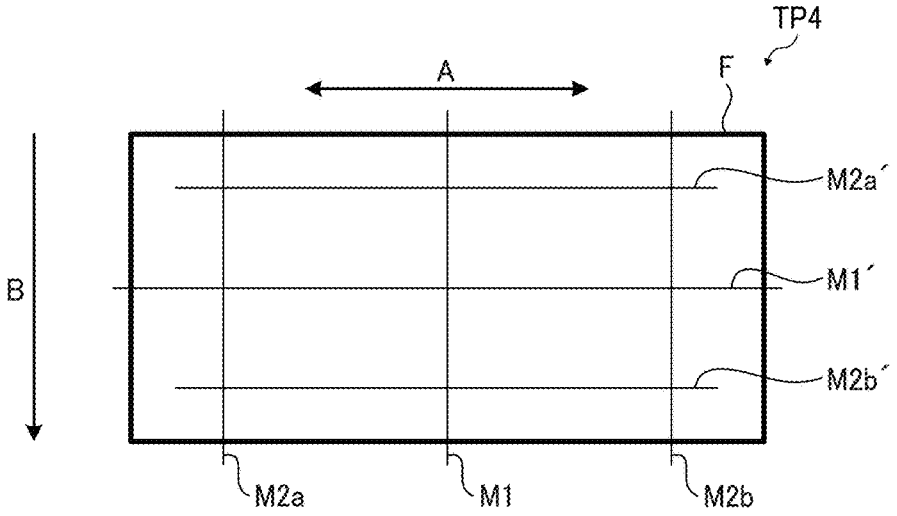
FIG. 37 is a diagram of a test pattern including linear marks according to an embodiment.

Although, in the first and second test patterns illustrated in FIGS. 30C and 31B, the first marks M1 and M1' and the second marks M2*a*, M2*b*, M2*a*', and M2*b*' are formed as dots, alternatively, the marks can be lines. Yet alternatively, the linear marks can be surrounded by a reference frame. FIG. 37 illustrates an example of a test pattern TP4 including linear marks. For example, as illustrated in FIG. 37, the pair of second marks M2*a* and M2*b* and the first mark M1 of the first test pattern illustrated in FIG. 30C are modified into lines extending in the sub-scanning direction B, and the first mark M1 is disposed between the second marks M2*a* and M2*b*. Further, the pair of second marks M2*a*' and M2*b*' and the first mark M1' of the second test pattern illustrated in FIG. 31B are modified into lines extending in the main scanning direction A, and the first mark M1' is disposed between the second marks M2*a*' and M2*b*'. Forming marks into lines described above facilitates the detection of the positions of the marks in the captured image.

Further, when the pair of second marks M2*a* and M2*b* and the first mark M1 (the first test pattern) illustrated in FIG. 30C are modified into lines as illustrated in FIG. 37, the number of the nozzles of the recording head 6 driven increases. Accordingly, the discharge speed of droplet is stable, and the landing position of droplet is less likely to deviate in the main scanning direction A.

Number of Nozzles driven in Recording Head

Next, a description is given of the number of nozzles in the recording head 6. As illustrated in FIG. 3, each of the recording heads 6A, 6B, and 6C according to the present embodiment includes one line of nozzles to discharge ink droplets for each of yellow (Y), cyan (C), magenta (M), and black (K).

Figure 38:
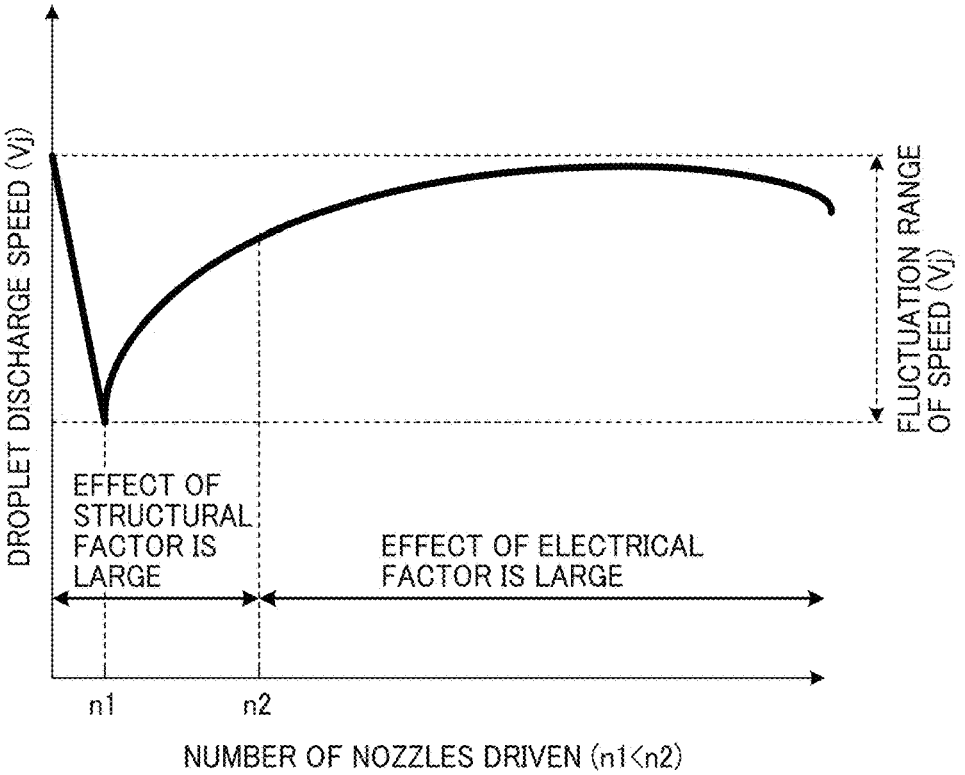
FIG. 38 is a graph of droplet discharge characteristics of the recording head according to Embodiment 3.

A description is given below of the relation between the number of nozzles driven and discharge speed of droplet (ink), as a droplet discharge characteristic. FIG. 38 is a graph for explaining the droplet discharge characteristic of the recording head. The term "number of nozzles driven" represents the number of nozzles in the same recording head 6 that discharge ink droplets concurrently. Corresponding to the number of nozzles driven, the discharge speed of droplet (Vj) changes significantly. The causes of changes include a structural factor and an electrical factor.

For example, in a case where the recording head 6 employs a piezo (piezoelectric element) actuator, there is the following structural factor. In the piezo actuator type, a drive waveform is applied to the piezo to cause a displacement of the piezoelectric element, thereby pressurizing the ink inside a pressurizing chamber to discharge an ink droplet from the nozzle. At that time, depending on the number of nozzles driven, the pressure applied to the ink inside the pressurizing chamber changes, and the discharge speed of droplet (Vj) changes. Even in a thermal inkjet recording apparatus, a similar phenomenon can occur since bubbles are generated inside the pressurizing chamber to pressurize the ink therein.

Regarding an electrical factor, the recording head 6 behaves such that capacitance and inductance change depending on the number of nozzles driven and wiring length. Such changes cause a waveform output from a drive waveform generation circuit to fluctuate, affecting the discharge speed of droplet (Vj).

Depending on the number of nozzles driven, the influence of either of the two factors is dominant. Here, numbers n1 and n2 (in FIG. 38) represent the numbers of nozzles driven and n2 is greater than n1. When the number of nozzles driven is around the number n1, the influence of the structural factor is greater. By contrast, when the number of nozzles driven exceeds the number n2, the influence of the electrical factor is greater. Variations of fluctuation in the discharge speed of droplet (Vj) caused by the electrical factor can be easily suppressed by, for example, adjustment of a circuit constant. By contrast, suppressing variations caused by the structural factor is difficult.

As illustrated in FIG. 38, as the number of nozzles driven increases, the discharge speed of droplet (Vj) becomes stable. Accordingly, preferably, the number of nozzle for each color of the recording head 6 is equal to or greater than the number n2 at which the influence of the electrical factor is greater than that of the structural factor.

Referring back to FIG. 37, the test pattern TP4 includes a reference frame F formed under a condition (e.g., line thickness is different) different from the condition under which the first marks M1 and M1' and the second marks M2*a*, M2*b*, M2*a*', and M2*b* are formed. The reference frame F is formed with lines surrounding the first marks M1 and M1' and the second marks M2*a*, M2*b*, M2*a*', and M2*b* and used as a reference to locate these marks. In detecting these marks, initially detecting the reference frame F makes it easier to locate each mark in the captured image even when the position of the test pattern TP in the captured image is deviated.

Use of the test pattern TP4 illustrated in FIG. 37 is advantageous in that the amount of deviation in the main scanning direction A can be calculated with the three lines (the first mark M1 and the pair of second marks M2*a* and M2*b*) disposed side by side in the main scanning direction A, and the amount of deviation in the sub-scanning direction B can be calculated with the three lines (the first mark M1' and the pair of second marks M2*a*' and M2*b*') disposed side by side in the sub-scanning direction B.

Figure 39A:
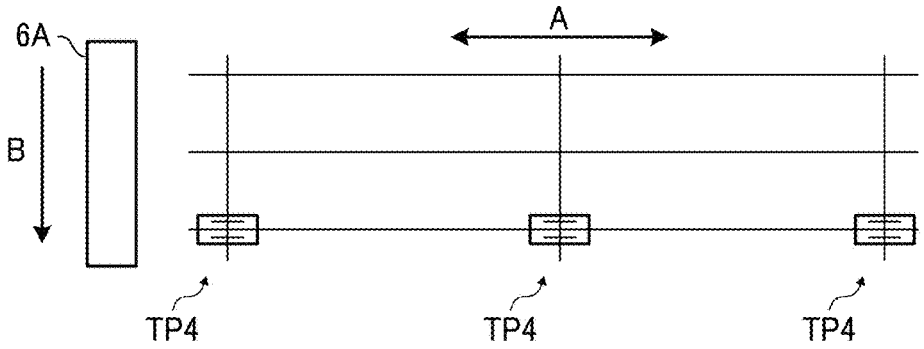
FIGS. 39A, 39B, and 39C are diagrams of an example including a plurality of test patterns illustrated in FIG. 37.
Figure 39B:
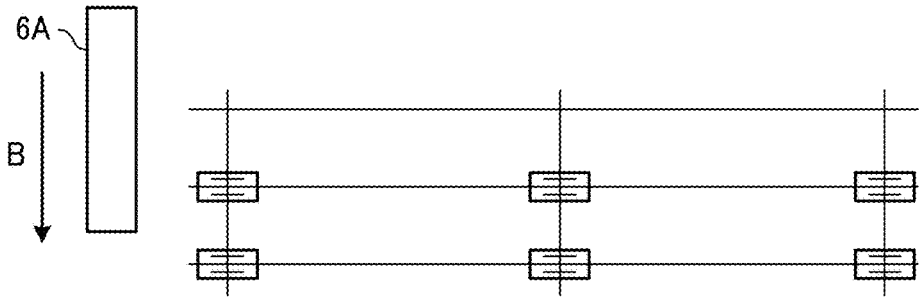
Figure 39C:
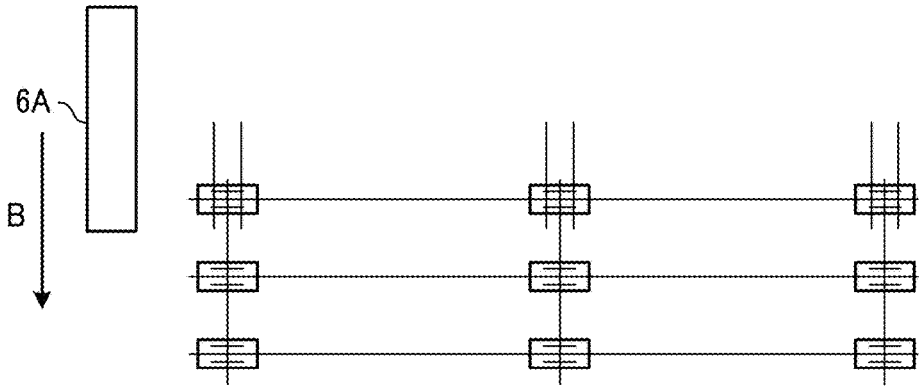

Further, as illustrated in FIG. 39C, a test pattern TP5 including a plurality of test patterns TP4 each including the linear marks surrounded by the reference frame F (illustrated in FIG. 37) can be used. FIGS. 39A, 39B, and 39C are diagrams of formation of the test pattern TP5 including a plurality of test patterns TP4 illustrated in FIG. 37. In the test pattern TP5 illustrated in FIGS. 39A, 39B, and 39C, three test patterns TP4 (illustrated in FIG. 37) are arranged in the main scanning direction A and three test patterns TP4 are arranged in the sub-scanning direction B.

Increasing the number of positions detected in the main scanning direction A and the sub-scanning direction B as illustrated in FIG. 39C enables calculation of the mean value of the amount of deviation and the like. In particular, further increasing the number of positions detected is preferable in a situation where the skew angle is unstable and gradually increases. In a structure in which the nozzles of the recording head 6 are linearly arranged, the amount of deviation in the main scanning direction A can be calculated, using the relative positions between a mark formed with an extreme downstream nozzle and a mark formed with an extreme upstream nozzle.

Embodiment 4

Embodiment 3 concerns the structure and the method to calculate the amount of deviation based on the inclination of one recording head and adjust the inclination of the recording head. In Embodiment 4, descriptions are given below of a structure and a method to calculate the amount of deviation and inclination angle based on relative inclination of a plurality of recording heads and adjust the relative inclination of the plurality of recording heads.

The image forming apparatus 100 according to the present embodiment is similar in hardware structure and functional configuration according to Embodiment 3 (see FIGS. 13 and 28). Additions to Embodiment 3 are described with reference to FIG. 28. Descriptions are given below of an example in which the relative inclination between the recording heads 6A and 6B is detected.

In addition to the capability described in Embodiment 3, the pattern forming unit 111 of the CPU 110 has a capability to cause the recording heads 6A and 6B to form third marks M3 and M3', a pair of fourth marks M4*a* and M4*b*, and a pair of fourth marks M4*a'* and M4*b'* on the recording medium P, with upstream nozzles and downstream nozzles of the recording heads 6A and 6B (hereinafter "test pattern TP6"). The test pattern TP6 is an example of a test pattern including an upstream mark set and a downstream mark set (third test pattern).

In the present embodiment, for example, the pattern forming unit 111 causes the recording head 6A to form the third marks M3 and M3' respectively with an upstream nozzle 6AU and a downstream nozzle 6AD (illustrated in FIG. 40A) thereof and causes the recording head 6B to form the pair of fourth marks M4*a* and M4*b* and the pair of fourth marks M4*a'* and M4*b'* with an upstream nozzle 6BU and a downstream nozzle 6BD (illustrated in FIG. 40B) thereof. Alternatively, the recording head 6B can form the third marks M3 and M3' and the recording head 6A can form the pair of fourth marks M4*a* and M4*b* and the pair of fourth marks M4*a'* and M4*b'*.

Figure 40A:
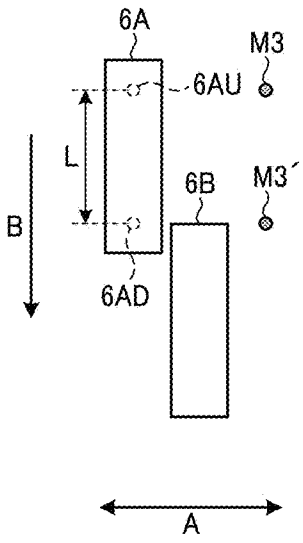
FIGS. 40A, 40B, and 40C illustrate a method of forming a test pattern according to Embodiment 4.
Figure 40B:
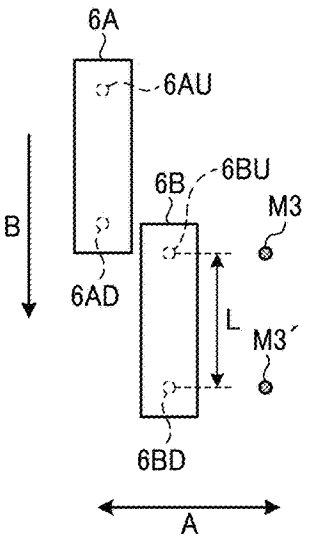
Figure 40C:
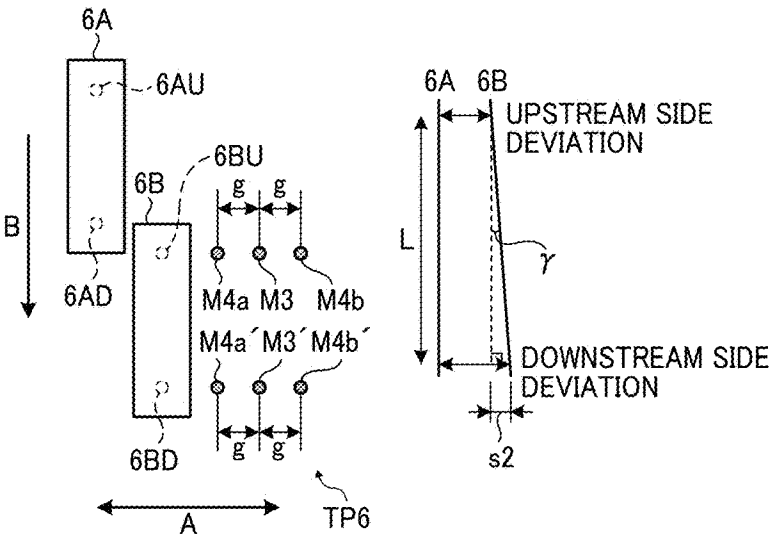

Referring to FIGS. 40A, 40B, and 40C, descriptions are given below of a method of forming the test pattern TP6. The upstream nozzle 6AU and the downstream nozzle 6AD of the recording head 6A are in the same nozzle line and at the distance L from each other. The upstream nozzle 6BU and the downstream nozzle 6BD of the recording head 6B are in the same nozzle line and at the distance L from each other. The recording head 6A serves as a first recording head, and the recording head 6B serves as a second recording head.

The third marks M3 and M3' formed with the upstream nozzle 6AU and the downstream nozzle 6AD in the same nozzle line of the recording head 6A are lined in the sub-scanning direction B in the drawings. Similarly, the fourth marks M4*a* and M4*b* and the fourth marks M4*a'* and M4*b'* are formed with the upstream nozzle 6BU and the downstream nozzle 6BD in the same nozzle line of the recording head 6B and are lined in the sub-scanning direction B in the drawings.

The fourth marks M4*a* and M4*b* are formed at positions equally away (by a distance g) from the third mark M3 on both sides in the main scanning direction A. Similarly, the fourth marks M4*a'* and M4*b'* are formed at positions equally away (by the distance g) from the third mark M3' on both sides in the main scanning direction A. Thus, the theoretical distance (actual distance) between the fourth marks M4*a* and M4*b* (and that between the fourth marks M4*a'* and M4*b'*) is the distance represented as 2×g.

Formation of the test pattern TP6 will be described below with reference to FIGS. 40A to 40C. Initially, as illustrated in FIG. 40A, the pattern forming unit 111 causes the recording head 6A to form, with the upstream nozzle 6AU and the downstream nozzle 6AD in the sub-scanning direction B, the third marks M3 and M3' on the recording medium P. Subsequently, as illustrated in FIG. 40B, the conveyance controller 116 conveys, with the conveyance roller 152, the recording medium P by a predetermined amount in the sub-scanning direction B. After the recording medium P is conveyed by the predetermined amount, as illustrated in FIG. 40C, the pattern forming unit 111 causes the recording head 6B to form the pair of fourth marks M4*a* and M4*b* and the pair of fourth marks M4*a'* and M4*b*40 with the upstream nozzle 6BU and the downstream nozzle 6BD thereof.

The position detector 142 of the two-dimensional sensor CPU 140 performs the processing described in Embodiment 3 and detects, from the captured image obtained by the imaging unit 20, the test pattern TP6 according to the present embodiment. Specifically, from the captured image of the test pattern TP6 illustrated in FIG. 40C, the position detector 142 detects the third marks M3 and M3' and the pair of fourth marks M4*a* and M4*b* and the pair of fourth marks M4*a'* and M4*b.'*

The ratio calculator 143 of the two-dimensional sensor CPU 140 calculates the ratio (i.e., a second ratio) between the distance between the pair of fourth marks M4*a* and M4*b* on the upstream side in the captured image and the amount of deviation of the third mark M3 on the upstream side in the captured image, similar to the operation regarding the mark set Mm in Embodiment 3. Additionally, the ratio calculator 143 calculates the ratio (i.e., a third ratio) between the distance between the pair of fourth marks M4*a'* and M4*b'* on the downstream side in the captured image and the amount of deviation of the third mark M3' on the downstream side in the captured image.

In addition to the capability described in Embodiment 3, the actual distance calculator 114 of the CPU 110 multiplies, by the second ratio, the distance between the nozzles used to form the pair of fourth marks M4*a* and M4*b* on the upstream side in the captured image, thereby calculating the actual distance of deviation of the third mark M3 on the upstream side, relative to the pair of fourth marks M4*a* and M4*b* (i.e., deviation amount on the upstream side). Further, the actual distance calculator 114 multiplies, by the third ratio, the distance between the nozzles used to form the pair of fourth marks M4*a*' and M4*b*' on the downstream side in the captured image, thereby calculating the actual distance of deviation of the third mark M3' on the downstream side, relative to the pair of fourth marks M4*a*' and M4*b*' (i.e., deviation amount on the downstream side). The actual distance calculator 114 calculates the difference (s2 in FIG. 40C) between the deviation amounts on the upstream side and the downstream side, as a deviation amount s2 derived from the inclination of the recording head 6B relative to the recording head 6A.

In addition to the capability described in Embodiment 3, the inclination calculator 117 of the CPU 110 calculates the amount of inclination of the recording head 6B relative to the recording head 6A (i.e., a relative inclination angle γ serving as a relative inclination amount), using the deviation amount s2 calculated by the actual distance calculator 114 (derived from the inclination of the recording head 6B relative to the recording head 6A) and the predetermined distance L representing the distance from the upstream nozzle to the downstream nozzle of the recording head 6A or the recording head 6B.

The adjusting unit 115 of the CPU 110 adjusts the inclination of the recording head 6B relative to the recording head 6A in accordance with the relative inclination angle γ calculated by the inclination calculator 117. Alternatively, the relative inclination of the recording head 6B is adjusted in accordance with the amount of deviation derived from the relative inclination of the recording head 6B, calculated by the actual distance calculator 114. Although the image forming apparatus 100 adjusts the inclination of the recording head 6B in this example, in another embodiment, an operator or service person manually adjusts the recording head 6B.

Figure 41A:
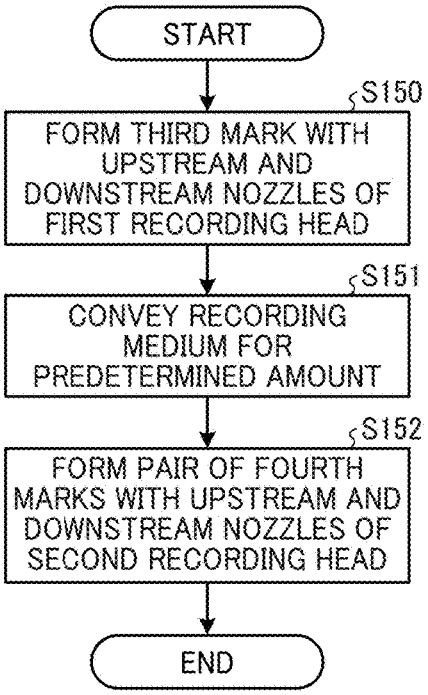
FIGS. 41A, 41B, and 41C are flowcharts of calculation of amount of deviation and relative inclination angle in the image forming apparatus according to Embodiment 4.
Figure 41B:
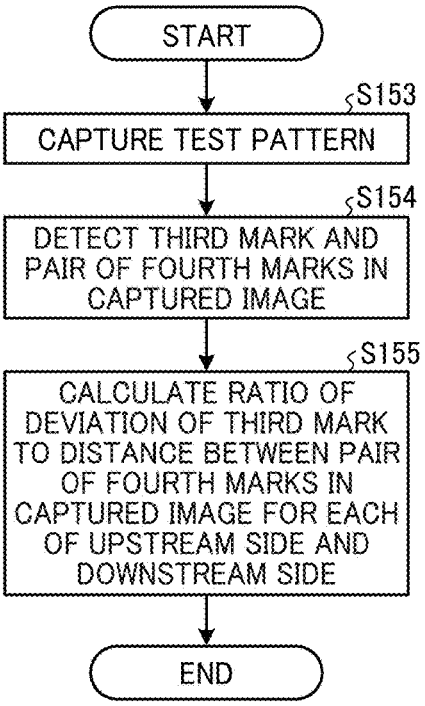
Figure 41C:
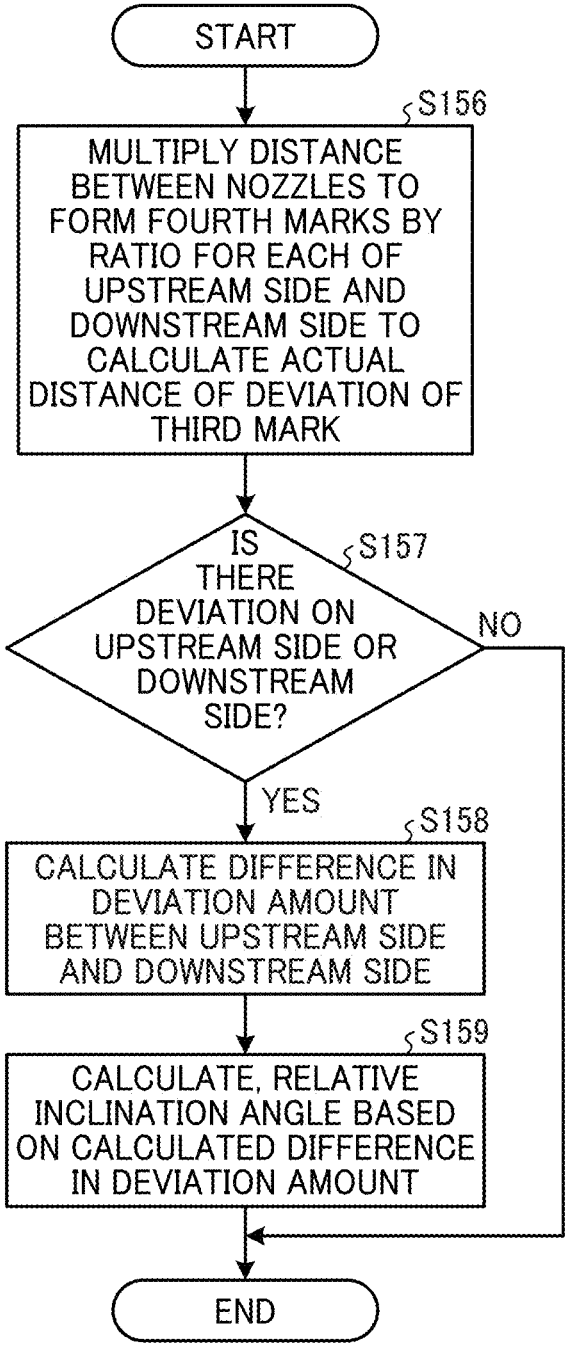

Referring to FIGS. 41A to 41C, descriptions are given of a procedure of calculation of the amount of deviation derived from the inclination of the recording head 6B relative to the recording head 6A and the relative inclination angle γ. FIGS. 41A, 41B, and 41C are flowcharts of calculation of such amount of deviation and relative inclination angle according to Embodiment 4.

When the recording medium P is set on the platen 16, at S150, the pattern forming unit 111 of the CPU 110 causes the recording head 6A (the first recording head) to form the third marks M3 and M3' with the upstream nozzle 6AU and the downstream nozzle 6AD, respectively on the recording medium P. At S151, the conveyance controller 116 of the causes the conveyance roller 152 to convey the recording medium P by the predetermined conveyance amount.

At S152, the pattern forming unit 111 causes the recording head 6B (the second recording head) to form the pair of fourth marks M4*a* and M4*b* and the pair of fourth marks M4*a*' and M4*b*' on the recording medium P, with the upstream nozzle 6BU and the downstream nozzle 6BD, at the respective positions at distances g on both sides of the third marks M3 and M3' in the main scanning direction A. As a result, the test pattern TP6 (see FIG. 40C) including the third marks M3 and M3', the pair of fourth marks M4*a* and M4*b*, and the pair of fourth marks M4*a*' and M4*b*' is formed.

Referring to FIG. 41B, at S153, the two-dimensional sensor 27 of the imaging unit captures an image of the test pattern TP6 formed at steps S150 and S152, and outputs the captured image. At S154, the position detector 142 of the two-dimensional sensor CPU 140 detects the positions of the third marks M3 and M3', the pair of fourth marks M4*a* and M4*b*, and the pair of fourth marks M4*a*' and M4*b*' in the captured image.

Using the detected positions of third marks M3 and M3', the pair of fourth marks M4*a* and M4*b*, and the pair of fourth marks M4*a*' and M4*b*' in the captured image, the ratio calculator 143 of the two-dimensional sensor CPU 140 calculates, on each of the upstream side and the downstream side, the ratio between the distance between the pair of fourth marks M4*a* and M4*b* (or M4*a*' and M4*b*') in the captured image and the amount of deviation of the third mark M3 (or M3') in the captured image.

That is, at S155, the ratio calculator 143 calculates the ratio (the second ratio) between the distance between the fourth marks M4*a* and M4*b* in the captured image and the amount of deviation of the third mark M3 in the captured image. The ratio calculator 143 further calculates the ratio (the third ratio) between the distance between the fourth marks M4*a*' and M4*b*' in the captured image and the amount of deviation of the third mark M3' in the captured image.

Referring to FIG. 41C, at S156, the actual distance calculator 114 of the CPU 110 multiplies, by the ratio, the actual distance between the nozzles used to form the fourth marks M4*a* and M4*b* (or M4*a*' and M4*b*'), using the pattern data used to form the test pattern TP6 at steps S150 and S152 and the second and third ratios calculated at step S155, to calculate the actual distance of deviation of the third mark M3 (or M3') on each of the upstream side and the downstream side.

Specifically, at S156, the actual distance calculator 114 multiplies, by the second ratio, the actual distance between the nozzles used to form the fourth marks M4*a* and M4*b*, thereby calculating the actual distance of deviation of the third mark M3 (the deviation amount on the upstream side). Further at S156, the actual distance calculator 114 multiplies, by the third ratio, the actual distance between the nozzles used to form the fourth marks M4*a*' and M4*b*', thereby calculating the actual distance of deviation of the third mark M3' (the deviation amount on the downstream side).

At S157, the actual distance calculator 114 of the CPU 110 determines, based on the actual distance of deviation of the third mark M3 and that of the third marks M3'calculated at step S156, whether the landing position of ink has deviated on at least one of the upstream side and the downstream side. When the actual distance calculator 114 determines that the landing position of ink has not deviated on the upstream side or the downstream side (No at S157), a sequence of operations is completed.

By contrast, when the actual distance calculator 114 determines that the landing position of ink has deviated on at least one of the upstream and downstream sides (Yes at S157), at S158, the actual distance calculator 114 calculates the difference between the amount of deviation on the upstream side and that on the downstream side, calculated at S156.

At S159, the inclination calculator 117 calculates the relative inclination angle γ representing the inclination of the recording head 6B relative to the recording head 6A, using the difference between the amounts of deviation on the upstream and downstream sides (the deviation amount s2 derived from the inclination of the recording head 6B relative to the recording head 6A) and the distance L between the upstream nozzle and the downstream nozzle of the recording head 6A.

Although the present embodiment concerns the configuration to calculate the amount of deviation derived from the inclination of two recording heads and relative inclination therebetween, the present embodiment can be modified for three or more recording heads.

As described above, based on the test pattern TP6 formed with the upstream nozzles and the downstream nozzles of the recording heads 6A and 6B (first and second recording heads), the image forming apparatus 100 according to Embodiment 4 calculates the deviation amounts on the upstream and downstream sides and calculates the difference between the deviation amounts on the upstream side and the downstream side, as the deviation amount s2 derived from the inclination of the recording head 6B relative to the recording head 6A. Based on the amounts of deviation and the distance L between the upstream and downstream nozzles used to form the test pattern TP6, the relative inclination angle, that is, the inclination of the recording head 6B relative to the recording head 6A, can be calculated. Accordingly, in addition to the effect attained in Embodiment 3, in the image forming apparatus 100 according to Embodiment 4, the inclination of the recording head 6B can be adjusted in accordance with the amount of deviation derived from the inclination of the recording head 6B relative to the recording head 6A and the relative inclination angle.

[Modification of Test Pattern]

The test pattern used in the present embodiment is not limited to the example illustrated in FIGS. 40A to 40C, and can be variously modified. A modification of the test pattern TP6 will be described below.

Although, in the test pattern TP6 illustrated in FIG. 40C, the third marks M3 and M3', the pair of fourth marks M4*a* and M4*b*, and the pair of fourth marks M4*a'* and M4*b'* are formed as dots, alternatively, the marks can be lines. Yet alternatively, the linear marks can be surrounded by a reference frame.

Figure 42:
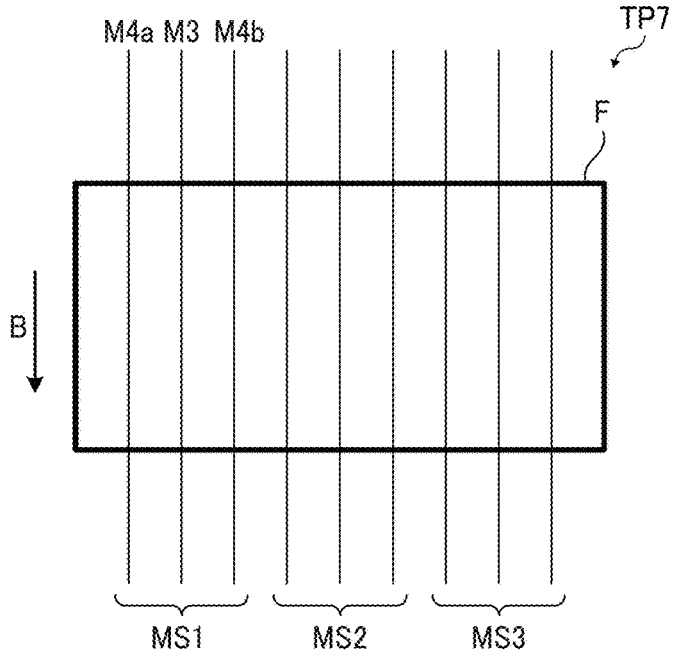
FIG. 42 is a diagram of a test pattern including linear marks according to an embodiment.

FIG. 42 illustrates an example of such test pattern including linear marks. For example, in a test pattern TP7 illustrated in FIG. 42, the third mark M3 and the fourth marks M4*a* and M4*b* illustrated in FIG. 40C are modified into lines extending in the sub-scanning direction B. Forming marks into lines described above facilitates the detection of the positions of the marks in the captured image. Further, when the marks illustrated in FIG. 40C are modified into lines, the number of the nozzles of the recording head 6 driven increases. Accordingly, the discharge speed of droplet is stable, and the landing position of droplet is less likely to deviate in the main scanning direction A. To calculate relative deviation and relative inclination among, for example, three recording heads, as illustrated in FIG. 42, three mark sets MS1, MS2, and MS3 are formed. To calculate such relative deviation and relative inclination, for example, the mark set MS1 is used for a combination of the recording heads 6A and 6B, the mark set MS2 is used for a combination of the recording heads 6B and 6C, and the mark set MS3 is used for a combination of the recording heads 6A and 6C.

The test pattern TP7 illustrated in FIG. 42 further includes a reference frame F formed under a condition (e.g., line thickness is different) different from the condition under which the third marks M3 and the fourth marks M4*a* and M4*b* are formed. The reference frame F is formed with lines surrounding (or overlapping) the third marks M3 and the fourth marks M4*a* and M4*b* and used as a reference to locate these marks. In detecting these marks, initially, the reference frame F is detected. This facilitates locating each mark in the captured image even when the position of the test pattern TP in the captured image is deviated.

Embodiment 5

Embodiment 3 concerns the structure and the method to calculate the amount of deviation based on the inclination of one recording head and adjust the inclination of the recording head. In Embodiment 5, descriptions are given below of a structure and a method to calculate the amount of misalignment among a plurality of recording heads in the sub-scanning direction B and adjust the misalignment among the plurality of recording heads.

The image forming apparatus 100 according to the present embodiment is similar in hardware structure and functional configuration according to Embodiment 3 (see FIGS. 13 and 28). Additions to Embodiment 3 are described with reference to FIG. 28. Descriptions are given below of an example in which the misalignment in the sub-scanning direction B among the recording heads 6A and 6B is calculated.

Figure 43:
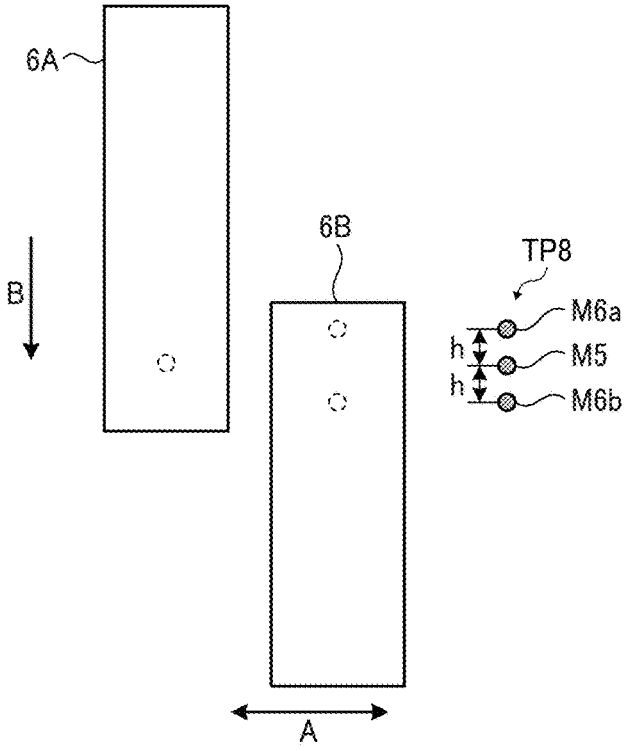
FIG. 43 illustrates a test pattern according to Embodiment 5.

Referring to FIG. 43, in the image forming apparatus 100 according to the present embodiment, the recording head 6B mounted on the carriage 5 includes a nozzle line partly overlapping in the sub-scanning direction B with a nozzle line of the recording head 6A. In other words, as illustrated in FIG. 43, an upstream portion in the sub-scanning direction B of the nozzle line (i.e., overlapping nozzles) of the recording head 6B overlaps with a downstream portion in the sub-scanning direction B of the nozzle line (i.e., overlapping nozzles) of the recording head 6A when projected in the main scanning direction A. A fifth mark M5 is formed with the overlapping nozzle of one of the recording heads 6A and 6B, and a pair of sixth marks M6*a* and M6*b* is formed with the overlapping nozzles of the other of the recording heads 6A and 6B, to calculate the amount of deviation between the marks in the sub-scanning direction B.

In addition to the capability described in Embodiment 3, the pattern forming unit 111 of the CPU 110 causes the recording heads 6A and 6B to form a test pattern TP8 (a fourth test pattern) including the fifth mark M5 and the pair of sixth marks M6*a* and M6*b* on the recording medium P, with the upstream and downstream nozzles of the recording heads 6A and 6B.

In the present embodiment, for example, the pattern forming unit 111 causes the recording head 6A to form the fifth mark M5 with the overlapping nozzle on the downstream side thereof and causes the recording head 6B to form the pair of sixth marks M6*a* and M6*b* with the overlapping nozzles on the upstream size thereof. Alternatively, the fifth mark M5 can be formed with the overlapping nozzle on the upstream size of the recording head 6B, and the pair of sixth marks M6*a* and M6*b* can be formed with the overlapping nozzle on the downstream side of the recording head 6A.

FIG. 43 is a diagram of formation of the test pattern TP8. As illustrated in FIG. 43, the downstream nozzles of the recording head 6A and the upstream nozzles of the recording head 6B are disposed overlapping with each other in the sub-scanning direction B. The recording head 6A serves as a first recording head, and the recording head 6B serves as a second recording head.

As illustrated in FIG. 43, the fifth mark M5 is formed with the overlapping nozzle on the downstream side of the recording head 6A. The pair of sixth marks M6*a* and M6*b* is formed with the overlapping nozzles on the upstream side (specified overlapping nozzles) of the recording head 6B. In the sub-scanning direction B, the specified overlapping nozzles are equally away (at distance h) from and on both sides of the overlapping nozzle of the recording head 6A used to form the fifth mark M5. The fifth mark M5 and the sixth marks M6*a* and M6*b* are lined up in the sub-scanning direction B.

The position detector 142 of the two-dimensional sensor CPU 140 performs the processing described in Embodiment 3 and detects, from the captured image obtained by the imaging unit 20, the test pattern TP8 according to the present embodiment. Specifically, from the captured image of the test pattern TP8 illustrated in FIG. 43, the position detector 142 detects the fifth mark M5 and the pair of sixth marks M6*a* and M6*b*.

The ratio calculator 143 of the two-dimensional sensor CPU 140 calculates the ratio (i.e., a fourth ratio) between the distance between the pair of sixth marks M6*a* and M6*b* in the captured image and the amount of deviation of the fifth mark M5 in the captured image, similar to the operation described in Embodiment 3.

The actual distance calculator 114 of the CPU 110 multiplies the distance (2×h) between the specified overlapping nozzles used to form the sixth marks M6*a* and M6*b* by the calculated ratio, thereby calculating the actual distance of deviation of the fifth mark M5 relative to the pair of sixth marks M6*a* and M6*b*. The amount of deviation of the fifth mark M5 relative to the pair of sixth marks M6*a* and M6*b* represents an amount of misalignment in the sub-scanning direction B of the recording head 6B relative to the recording head 6A.

The adjusting unit 115 of the CPU 110 adjusts the inclination of the recording head 6B, in accordance with the amount of deviation in the sub-scanning direction B calculated by the actual distance calculator 114, derived from the inclination of the recording head 6B relative to the recording head 6A. Although the image forming apparatus 100 adjusts the inclination of the recording head 6B in this example, in another embodiment, an operator or service person manually adjusts the recording head 6B.

Figure 44A:
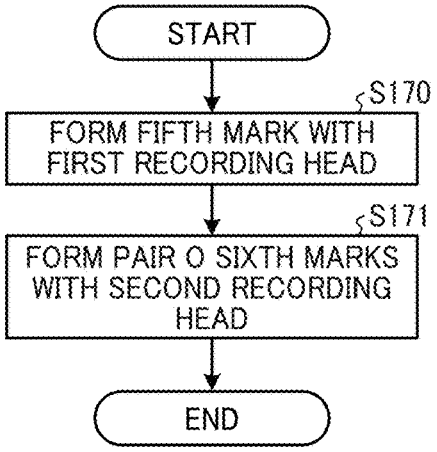
FIGS. 44A, 44B, and 44C are flowcharts of calculation of amount of deviation in the image forming apparatus according to Embodiment 5.
Figure 44B:
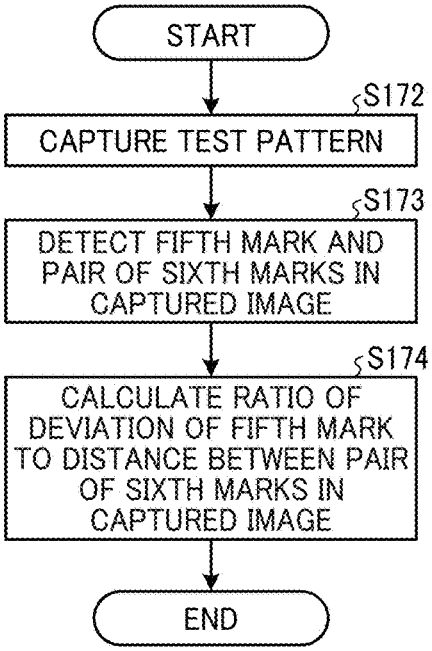
Figure 44C:
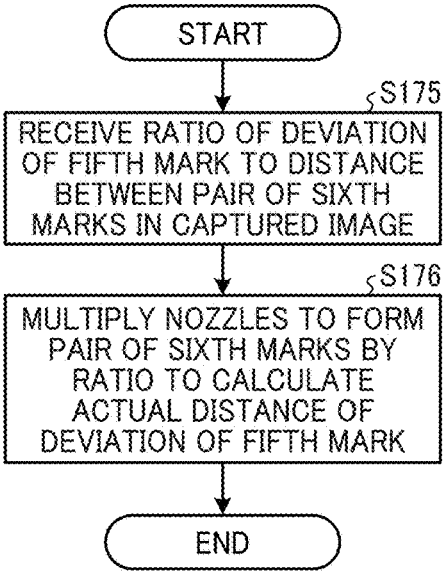

Referring to FIGS. 44A to 44C, descriptions are given of a procedure of calculation of the amount of deviation in the sub-scanning direction B, derived from the inclination of the recording head 6B relative to the recording head 6A in the image forming apparatus 100. FIGS. 44A, 44B, and 44C are flowcharts of calculation of amount of deviation in the image forming apparatus according to Embodiment 5.

Referring to FIG. 44A, when the recording medium P is set on the platen 16, at S170, the pattern forming unit 111 of the CPU 110 causes the recording head 6A to form the fifth mark M5, with the overlapping nozzle on the downstream side of the recording head 6A, on the recording medium P.

At S171, the pattern forming unit 111 causes the recording head 6B (the second recording head) to form the pair of sixth marks M6*a* and M6*b* on the recording medium P, with the specified overlapping nozzles on the upstream side of the recording head 6B, which are disposed at the distances h on both sides of the overlapping nozzle used to form the fifth mark M5 in sub-scanning direction B. As a result, the test pattern TP8 including the fifth mark M5 and the pair of sixth marks M6*a* and M6*b* is formed as illustrated in FIG. 43.

Referring to FIG. 44B, at S172, the two-dimensional sensor 27 of the imaging unit 20 captures an image of the test pattern TP8 formed at steps S170 and S171, and outputs the captured image. At S173, the position detector 142 of the two-dimensional sensor CPU 140 detects the position of each of the fifth mark M5 and the pair of sixth marks M6*a* and M6*b* in the captured image.

At S174, the ratio calculator 143 of the two-dimensional sensor CPU 140 calculates the ratio of deviation amount of the fifth mark M5 relative to the distance between the sixth marks M6*a* and M6*b* in the captured image, using the detected positions of the fifth mark M5 and the pair of sixth marks M6*a* and M6*b* in the captured image.

Referring to FIG. 44C, at S175, the actual distance calculator 114 of the CPU 110 receives the calculated ratio of deviation of the fifth mark M5 relative to the distance between the sixth marks M6*a* and M6*b* in the captured image. At S176, the actual distance calculator 114 multiplies, by the ratio, the distance between the nozzles used to form the sixth marks M6*a* and M6*b*, using the pattern data used to form the test pattern TP8 at steps S170 and S171 and the ratio calculated at step S174, to calculate the actual distance of deviation of the fifth mark M5. Then, the operation completes.

Thus, according to Embodiment 5, based on the test pattern TP8 formed by the recording heads 6A and 6B having the nozzle lines partly overlapping in the sub-scanning direction B, the image forming apparatus 100 can calculate the amount of deviation in the sub-scanning direction B derived from the misalignment of the recording head 6B relative to the recording head 6A. Accordingly, in the image forming apparatus 100 according to Embodiment 5, the misalignment of the recording head 6B can be adjusted in accordance with the amount of deviation in the sub-scanning direction B, calculated as described above.

[Modification of Test Pattern]

The test pattern used in the present embodiment is not limited to the example illustrated in FIG. 43, and can be variously modified. A modification of the test pattern TP8 will be described below.

Although, in the test pattern TP8 illustrated in FIG. 43, the fifth mark M5 and the pair of sixth marks M6*a* and M6*b* are formed as dots, alternatively, the marks can be lines. Yet alternatively, the linear marks can be surrounded by a reference frame.

Figure 45:
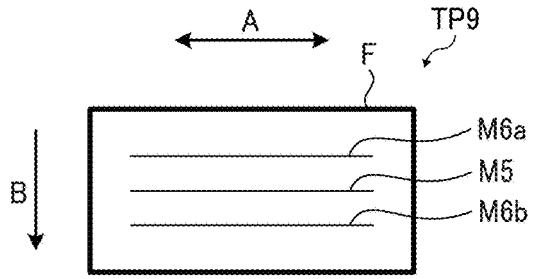
FIG. 45 is a diagram of a test pattern including linear marks according to an embodiment.

FIG. 45 illustrates an example of such test pattern including linear marks. For example, in a test pattern TP9 illustrated in FIG. 45, the fifth mark M5 and the pair of sixth marks M6*a* and M6*b* illustrated in FIG. 43 are modified into lines extending in the main scanning direction A. Forming marks into lines described above facilitates the detection of the positions of the marks in the captured image.

The test pattern TP9 illustrated in FIG. 45 further includes a reference frame F formed under a condition (e.g., line thickness is different) different from the condition under which the fifth mark M5 and the pair of sixth marks M6*a* and M6*b* are formed. The reference frame F is formed with lines surrounding the fifth mark M5 and the pair of sixth marks M6*a* and M6*b* and used as a reference to locate these marks. In detecting these marks, initially, the reference frame F is detected. This facilitates locating each mark in the captured image even when the position of the test pattern in the captured image is deviated.

Embodiment 6

Although, in Embodiments 3 to 5, the two-dimensional sensor CPU mounted in the carriage performs the position detection of the test pattern in the captured image and the ratio calculation, alternatively, the main control board can perform the position detection and ratio calculation.

The hardware configuration of the image forming apparatus 200 according to the present embodiment is similar to that of Embodiment 2, illustrated in FIG. 26. Configurations except the central processing unit (CPU) 210 and the imaging unit 40 are similar to those of Embodiment 3, and thus redundant descriptions are omitted.

Similar to Embodiment 3, the CPU 210 controls the entire image forming apparatus 200. In particular, the image forming apparatus 200 according to the present embodiment uses the CPU 210 to implement a function of forming the test pattern TP, a function as a distance measurement device, and a function of calculating the amount of deviation and the angle of inclination of the recording head, based on the distance.

The imaging unit 40 includes the two-dimensional sensor 27 and captures an image of the test pattern (e.g., the mark set Mm in FIG. 30C and the mark sets M and M' in 31B) on the recording medium P, controlled by the CPU 210.

The two-dimensional sensor 27 is, for example, a CCD sensor or a CMOS sensor as described above. The two-dimensional sensor 27 captures an image of the test pattern TP under predetermined operation conditions according to various setting signals transmitted via the control FPGA 120 from the CPU 210. Then, the two-dimensional sensor 27 transmits the captured image via the control FPGA 120 to the CPU 210.

Figure 46:
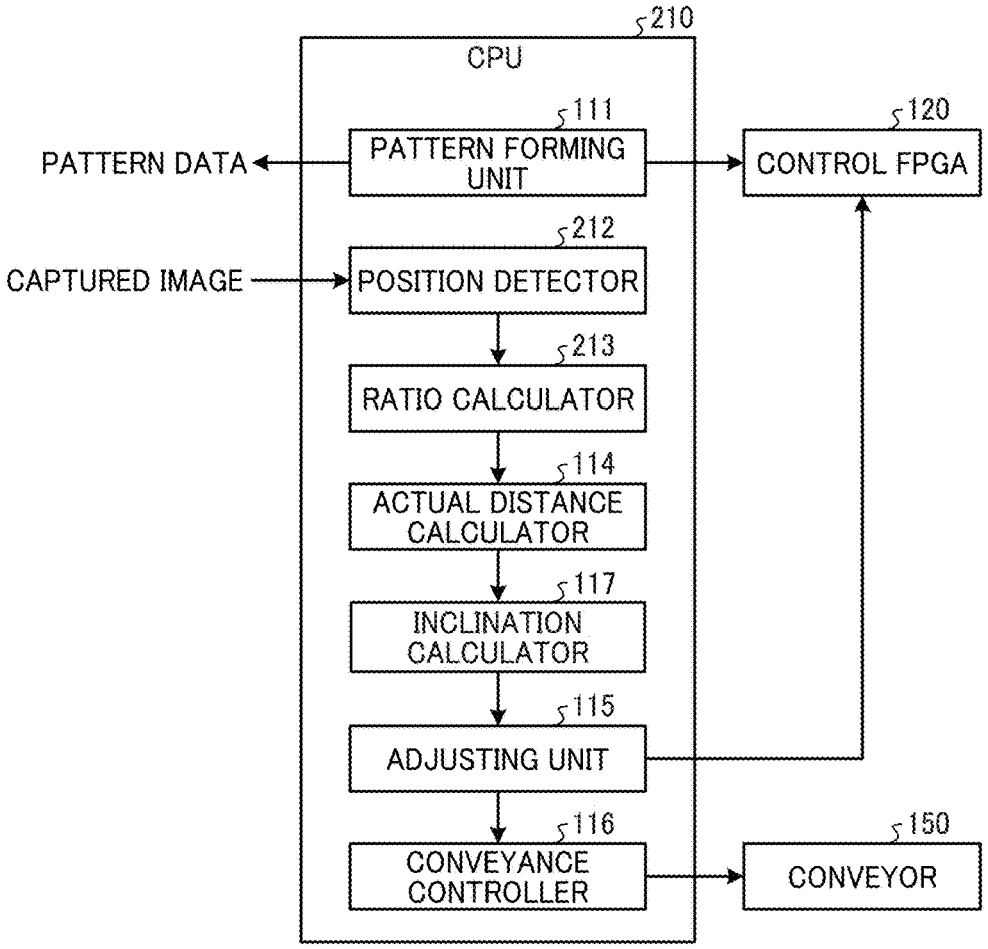
FIG. 46 is a block diagram of a functional configuration of an image forming apparatus according to Embodiment 6.

Referring to FIG. 46, characteristic functions implemented by the CPU 210 of the image forming apparatus 200 will be described. FIG. 46 is a block diagram of a functional configuration of the image forming apparatus according to Embodiment 6.

For example, the CPU 210 uses the RAM 103 as a work area to execute a control program stored on the ROM 102, in order to implement the functions of the pattern forming unit 111, the position detector 212, the ratio calculator 213, the actual distance calculator 114, the adjusting unit 115, the conveyance controller 116, the inclination calculator 117, and the like.

Functions of the pattern forming unit 111, the actual distance calculator 114, the adjusting unit 115, the conveyance controller 116, and the inclination calculator 117 are similar to those of Embodiment 3, and thus redundant descriptions are omitted.

Although functions of the position detector 212 and the ratio calculator 213 are similar to those of the position detector 142 and the ratio calculator 143 of Embodiment 3, the position detector 212 and the ratio calculator 213 are implement in the CPU 210, differently from Embodiment 3.

In the image forming apparatus 200 according to Embodiment 6, the sequence of processes to calculate the amount of deviation at the image formation position derived from the inclination of the recording head is similar to that in Embodiment 3 (see FIGS. 35A to 36C), and thus redundant descriptions are omitted.

Thus, in the image forming apparatus 200 according to the present embodiment, the CPU 210 of the main control board 230 performs all of the functions including the position detector 212 and the ratio calculator 213. This configuration attains the effects similar to those attained by the image forming apparatus 100 according to Embodiment 3.

Note that the computer programs performed in the image forming apparatus according to the above-described embodiments are preliminarily installed in a memory device such as a read only memory (ROM). Alternatively, the computer programs executed in the image forming apparatus according to the above-described embodiments can be provided as files being in an installable format or an executable format and stored in a computer-readable recording medium, such as a compact disc read only memory (CD-ROM), a flexible disk (FD), a compact disc recordable (CD-R), and a digital versatile disk (DVD).

Alternatively, the computer programs executed in the image forming apparatus according the above-described embodiments can be stored in a computer connected to a network such as the Internet and downloaded through the network. Alternatively, the computer programs executed in the image forming apparatus can be supplied or distributed via a network such as the Internet.

Programs executed in the image forming apparatus according to the above-described embodiment are in the form of module including the above-described functional units (the pattern forming unit, the position detector, the ratio calculator, the actual distance calculator, the inclination calculator, the adjusting unit, and the conveyance controller). As the CPU (a processor) reads out the program from the ROM and executes the program, the above-described functional units are loaded and implemented (generated), as hardware, in a main memory. Alternatively, for example, a portion or all of the above-described functions can be implemented by a dedicated hardware circuit.

The above-described embodiments are illustrative and do not limit the present invention.

For example, although the image forming apparatus described above is a serial head inkjet printer, aspects of this disclosure are applicable to a variety of image forming apparatuses. For example, in a line head inkjet printer, misalignment between recording heads can cause deviations in the landing position of ink. Applying aspects of this disclosure enables accurate calculation of the deviation amount and adjustment of inclination of the recording head in accordance with the deviation amount, thereby improving the image quality.

Additionally, for example, in a tandem electrophotographic image forming apparatus, misalignment between photoconductor drums can cause a deviation of image position equivalent to deviations in the landing position of ink in an inkjet printer. Applying aspects of this disclosure enables accurate calculation of the deviation amount and adjustment of inclination of the recording head in accordance with the deviation amount at the occurrence of such deviation of image position, thereby improving the image quality.

Additionally, for example, in a thermal printer to perform printing on a recording medium with heat, misalignment or deviation of a thermal head can cause a positional deviation of an image equivalent to deviations in the landing position of ink in an inkjet printer. Applying aspects of this disclosure enables accurate calculation of the deviation amount and adjustment of inclination of the recording head in accordance with the deviation amount at the occurrence of such deviation of image position, thereby improving the image quality.

Image formation according to this disclosure includes, in addition to output on recording media such as sheets, formation of boards. Although the image forming apparatus according to the above-described embodiment is a printer, aspects of this disclosure are applicable to other type image forming apparatuses such as copiers and multifunction peripherals (MFPs) having at least two of copying, printing, scanning, and facsimile transmission capabilities.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:

a conveyor to convey a recording medium;

an image forming device including at least one recording head to form, on the recording medium, a test pattern including at least one mark set including a first mark and a pair of second marks, the at least one recording head including a plurality of nozzles to discharge ink;

an imaging device to obtain a captured image of the test pattern; and at least one processor including:

a pattern forming unit configured to cause the image forming device to form one of the first mark and the pair of second marks on the recording medium and cause the image forming device to form the other of the first mark and the pair of second marks after the conveyor conveys the recording medium by a predetermined conveyance amount;

a position detector configured to detect a position of the first mark and a position of the pair of second marks in the captured image;

a ratio calculator configured to calculate a ratio between a distance between the pair of second marks in the captured image and an amount of deviation of the first mark in the captured image; and a distance calculator configured to calculate an actual distance of the deviation of the first mark based on a theoretical distance between the pair of second marks and the ratio.

2. The image forming apparatus according to claim 1, wherein the at least one recording head includes a plurality of nozzle lines extending in a direction of conveyance of the recording medium, and wherein the pattern forming unit causes the image forming device to discharge ink from an identical nozzle line to form the first mark and the pair of second marks.

3. The image forming apparatus according to claim 1, wherein the at least one recording head includes a plurality of nozzle lines, and wherein the pattern forming unit causes the image forming device to discharge ink from different nozzle lines to form the first mark and the pair of second marks.

4. The image forming apparatus according to claim 1, wherein the pattern forming unit causes the image forming device to form the first mark and the pair of second marks with different nozzles disposed at different positions in a direction of conveyance of the recording medium, as marks arranged in the direction of conveyance of the recording medium, and wherein the theoretical distance between the pair of second marks is a distance between two of the different nozzles to form the pair of second marks.

5. The image forming apparatus according to claim 4, wherein the plurality of nozzles includes:

a first nozzle to form the first mark; and a reference nozzle disposed, from the first nozzle, at an ideal distance of the predetermined conveyance amount in the direction of conveyance of the recording medium;

a second nozzle disposed downstream from the reference nozzle in the direction of conveyance of the recording medium; and a third nozzle disposed upstream from the reference nozzle in the direction of conveyance of the recording medium, wherein the pattern forming unit causes the image forming device to form the first mark, with the first nozzle, before the conveyor conveys the recording medium by the predetermined conveyance amount, and wherein the pattern forming unit causes the image forming device to form the pair of second marks, with the second nozzle and the third nozzle, after the conveyor conveys the recording medium by the predetermined conveyance amount.

6. The image forming apparatus according to claim 1, wherein the image forming device further includes a carriage on which the at least one recording head is mounted, the carriage to reciprocate in a direction perpendicular to a direction of conveyance of the recording medium, wherein the plurality of nozzles includes:

a first nozzle to form the first mark; and a second nozzle disposed, from the first nozzle, at an ideal distance of the predetermined conveyance amount in the direction of conveyance of the recording medium the second nozzle to form the pair of second marks, wherein the pair of second marks is arranged in a direction of travel of the carriage; and the distance calculator is configured to calculate the actual distance of the deviation of the first mark in the direction of travel of the carriage, wherein the at least one processor further includes an inclination calculator configured to calculate, based on the actual distance of the deviation of the first mark and the ideal distance of the predetermined conveyance amount, a total inclination amount including at least one of an inclination of the at least one recording head and an inclination of the recording medium.

7. The image forming apparatus according to claim 6, wherein the test pattern in which the pair of second marks is arranged in the direction of travel of the carriage is referred to as a first test pattern, wherein the pattern forming unit is configured to cause the image forming device to form a second test pattern including a first mark set and a second mark set arranged in the direction of travel of the carriage, wherein, in each of the first mark set and the second mark set, the pair of second marks is arranged in the direction of conveyance of the recording medium, wherein the distance calculator is further configured to calculate the actual distance of the deviation of the first mark relative to the pair of second marks in the direction of conveyance of the recording medium in each of the first mark set and the second mark set, and wherein the inclination calculator is further configured to:

calculate a difference between the actual distance of the deviation in the first mark set and the actual distance of the deviation in the second mark set;

calculate an amount of inclination of the recording medium based on the difference and a distance between the first mark set and the second mark set in the direction of travel of the carriage;

calculate an amount of inclination of the recording medium based on the difference in the actual distance of the deviation and a distance between the first mark set and the second mark set of the second test pattern; and calculate an amount of inclination of the at least one recording head based on a difference between the total inclination amount and the amount of inclination of the recording medium.

8. The image forming apparatus according to claim 7, wherein the distance calculator is configured to calculate an actual distance of deviation derived from the inclination of the at least one recording head, based on the amount of inclination of the at least one recording head and the predetermined conveyance amount.

9. The image forming apparatus according to claim 1, wherein the image forming device further includes a carriage on which the at least one recording head is mounted, the carriage to reciprocate in a direction perpendicular to a direction of conveyance of the recording medium, wherein the at least one mark set includes a first mark set and a second mark set arranged in a direction of travel of the carriage, wherein, in each of the first mark set and the second mark set, the pair of second marks is arranged in the direction of conveyance of the recording medium, wherein the distance calculator is configured to calculate the actual distance of the deviation of the first mark relative to the pair of second marks in the direction of conveyance of the recording medium in each of the first mark set and the second mark set, and wherein the at least one processor further includes an inclination calculator configured to calculate a difference between the actual distance of the deviation in the first mark set and the actual distance of the deviation in the second mark set and calculate an amount of inclination of the recording medium based on the difference and a distance between the first mark set and the second mark set in the direction of travel of the carriage.

10. The image forming apparatus according to claim 1, wherein the image forming device further includes a carriage on which the at least one recording head is mounted, the carriage to reciprocate in a direction perpendicular to a direction of conveyance of the recording medium, wherein the at least one recording head includes a first recording head and a second recording head each of which includes an upstream nozzle and a downstream nozzle disposed at different positions in the direction of conveyance of the recording medium;

wherein the at least one mark set includes an upstream mark set and a downstream mark set each of which includes the first mark and the pair of second marks, the downstream mark set being disposed downstream from the upstream mark set in the direction of conveyance of the recording medium, wherein the pattern forming unit is configured to cause the image forming device to form: the first mark of the upstream mark set and the first mark of the downstream mark set with the upstream nozzle and the downstream nozzle of the first recording head, respectively;

the pair of second marks of the upstream mark set with the upstream nozzle of the second recording head; and the pair of second marks of the downstream mark set with the downstream nozzle of the second recording head, wherein the theoretical distance between the pair of second marks is a distance by which the carriage moves from formation of one of the pair of the second marks to formation of the other of the pair of second marks, wherein the position detector is configured to detect a position of each of the first marks, the pair of second marks of the upstream mark set, and the pair of second marks of the downstream mark set in the captured image;

wherein the ratio calculator is configured to calculate, the ratio between the distance between the pair of second marks in the captured image and the amount of the deviation of the first mark in the captured image regarding each of the upstream mark set and the downstream mark set, and wherein the distance calculator is configured to:

calculate, regarding each of the upstream mark set and the downstream mark set, the actual distance of the deviation of the first mark, based on the theoretical distance between the pair of second marks and the ratio, and calculate a difference between the actual distance of the deviation in the upstream mark set and the actual distance of the deviation in the downstream mark set, the difference being the amount of deviation derived from an inclination of the second recording head relative to the first recording head.

11. The image forming apparatus according to claim 10, wherein the at least one processor further includes an inclination calculator configured to calculate an amount of inclination of the second recording head relative to the first recording head, based on the amount of the deviation derived from the inclination of the second recording head relative to the first recording head.

12. The image forming apparatus according to claim 1, wherein the first mark and the pair of second marks are lines.

13. A method for calculating an actual distance of a deviation, performed in an image forming apparatus, the method comprising:

forming one of a first mark and a pair of second marks on a recording medium;

conveying the recording medium by a predetermined conveyance amount after forming the one of the first mark and the pair of second marks;

forming the other of the first mark and the pair of second marks after conveying the recording medium by the predetermined conveyance amount;

obtaining a captured image of a test pattern including the first mark and the pair of second marks;

detecting a position of the first mark and a position of the pair of second marks in the captured image; and calculating an actual distance of a deviation of the first mark, based on a distance between the pair of second marks in the captured image, a position of the first mark in the captured image, and a theoretical distance between the pair of second marks.

14. A computer-readable non-transitory recording medium storing a program for causing a computer to execute a method, the method comprising:

forming one of a first mark and a pair of second marks on a recording medium;

conveying the recording medium by a predetermined conveyance amount after forming the one of the first mark and the pair of second marks;

forming the other of the first mark and the pair of second marks after conveying the recording medium by the predetermined conveyance amount;

obtaining a captured image of a test pattern including the first mark and the pair of second marks;

detecting a position of the first mark and a position of the pair of second marks in the captured image;

calculating a ratio between a distance between the pair of second marks in the captured image and a deviation of the first mark in the captured image; and calculating an actual distance of the deviation of the first mark based on a theoretical distance between the pair of second marks and the ratio.

* * * * *